US007222769B2

(12) United States Patent
Yoshie et al.

(10) Patent No.: US 7,222,769 B2
(45) Date of Patent: May 29, 2007

(54) ELECTRIC STAPLER

(75) Inventors: Toru Yoshie, Tokyo (JP); Takuya Kitamura, Tokyo (JP)

(73) Assignee: Max Co., Ltd., Tokyo (JP)

( * ) Notice: Subject to any disclaimer, the term of this patent is extended or adjusted under 35 U.S.C. 154(b) by 0 days.

(21) Appl. No.: 11/221,711

(22) Filed: Sep. 9, 2005

(65) Prior Publication Data

US 2006/0016849 A1 Jan. 26, 2006

Related U.S. Application Data

(62) Division of application No. 10/497,001, filed as application No. PCT/JP02/12554 on Nov. 29, 2002, now Pat. No. 7,083,073.

(30) Foreign Application Priority Data

| | | |
|---|---|---|
| Nov. 29, 2001 | (JP) | 2001-365145 |
| Dec. 3, 2001 | (JP) | 2001-369264 |
| Dec. 4, 2001 | (JP) | 2001-370502 |
| Dec. 27, 2001 | (JP) | 2001-397828 |
| Dec. 29, 2001 | (JP) | 2001-365132 |
| Jan. 18, 2002 | (JP) | 2002-010630 |
| Jan. 18, 2002 | (JP) | 2002-010643 |
| Jan. 22, 2002 | (JP) | 2002-013307 |
| Jan. 22, 2002 | (JP) | 2002-013313 |

(51) Int. Cl.
*B25C 5/06* (2006.01)

(52) U.S. Cl. ..... 227/155; 227/111; 227/131

(58) Field of Classification Search ..... 227/111, 227/131, 148, 155
See application file for complete search history.

(56) References Cited

U.S. PATENT DOCUMENTS

| | | | |
|---|---|---|---|
| 4,194,666 A | 3/1980 | Spehrley et al. | 227/155 |
| 4,770,334 A | 9/1988 | Hoshi et al. | 227/85 |
| 5,009,355 A | 4/1991 | Akizawa et al. | 227/114 |

(Continued)

FOREIGN PATENT DOCUMENTS

EP 838315 A2 4/1998

(Continued)

*Primary Examiner*—Thanh Truong
(74) *Attorney, Agent, or Firm*—Morgan, Lewis & Bockius LLP

(57) ABSTRACT

Two slide bases (106) synchronizingly traveled on linear guides (105) arranged upwardly and downwardly in parallel with each other are rotatably attached with a clincher unit (107) and a driver unit (104) and provided with a click stop mechanism for fixing the clincher unit (103) and the driver unit (104) at a 0 degree position or a 45 degree rotated position. Respective outer peripheral portion thereof are provided with claw portions (119), (120), in correspondence with the 0 degree position and the 45 degree rotated position and a stopper pin (121) is arranged at a traveling path. When the driver unit and the clincher unit are traveled from an initial position to a skewed binding position, the 0 degree claw portion 119 impinges on the stopper pin (121) and the driver unit and the clincher unit are rotated to the 45 degree rotated position to fix. When the driver unit and the clincher unit are traveled reversely to the initial position, the 45 degree claw portion (120) impinges on the stopper pin (121) and the driver unit and the clincher unit are returned to the 0 degree position to fix.

5 Claims, 63 Drawing Sheets

U.S. PATENT DOCUMENTS

| | | | | |
|---|---|---|---|---|
| 5,029,745 | A | 7/1991 | Akizawa et al. | 227/155 |
| 5,413,266 | A | 5/1995 | Jairam | 227/129 |
| 5,586,710 | A | 12/1996 | Golicz | 227/155 |
| 5,662,318 | A | 9/1997 | Harada et al. | 270/58.05 |
| 5,772,197 | A | 6/1998 | Aoki et al. | 270/58.08 |
| 5,799,935 | A * | 9/1998 | Yamanushi et al. | 270/58.08 |
| 5,806,750 | A | 9/1998 | Yamanushi et al. | 227/155 |
| 5,842,624 | A | 12/1998 | Ishida | 227/111 |
| 5,975,396 | A * | 11/1999 | Manabe | 227/2 |
| 6,050,471 | A * | 4/2000 | Yagi | 227/119 |
| 6,056,183 | A | 5/2000 | Tanabe | 227/155 |
| 6,092,712 | A | 7/2000 | Rueckl | 227/111 |
| 6,164,511 | A | 12/2000 | Chung et al. | 227/148 |
| 6,223,965 | B1 | 5/2001 | Nakatsuka | 227/111 |
| 6,308,948 | B1 * | 10/2001 | Azumi | 271/207 |
| 6,341,772 | B1 | 1/2002 | Waragai et al. | 270/58.08 |
| 6,343,785 | B1 | 2/2002 | Yamada et al. | 270/58.08 |
| 6,402,006 | B1 | 6/2002 | Nunes et al. | 227/110 |
| 6,474,633 | B1 | 11/2002 | Hirai | 270/58.09 |
| 6,641,024 | B2 | 11/2003 | Sato et al. | 227/155 |

FOREIGN PATENT DOCUMENTS

| | | |
|---|---|---|
| EP | 968798 A2 | 1/2000 |
| JP | 8-108378 | 4/1996 |
| JP | 9-136760 | 5/1997 |
| JP | 9-183559 | 7/1997 |
| JP | 9-183560 | 7/1997 |
| JP | 11-60045 | 3/1999 |
| JP | 2002-273705 A | 9/2002 |

* cited by examiner

ELECTRIC STAPLER

This divisional application of copending application Ser. No. 10/497,001 filed May 27, 2004, now U.S. Pat. No. 7,083,073 , which is a national stage of PCT Application No. PCT/JP02/12554 filed Nov. 29, 2002, which claims the benefit of Japanese Patent Application No. 2002-013313 filed Jan. 22, 2002, Japanese Patent Application No. 2002-013307 filed Jan. 22, 2002, Japanese Patent Application No. 2002-010643 filed Jan. 18, 2002, Japanese Patent Application No. 2002-010630 filed Jan. 18, 2002, Japanese Patent Application No. 2001-397828 filed Dec. 27, 2001, Japanese Patent Application No. 2001-370502 filed Dec. 4, 2001, Japanese Patent Application No. 2001-369264 filed Dec. 3, 2001, Japanese Patent Application No. 2001-365145 filed Nov. 29, 2001, and Japanese Patent Application No. 2001-365132 filed Nov. 29, 2001.

TECHNICAL FIELD

The present invention relates to an electric stapler, particularly to an electric stapler shown below.

(1) An electric stapler having a stapler rotating mechanism.

(2) An electric stapler provided with a moving mechanism of a stapler.

(3) An electric stapler improving a buckling preventing mechanism of a staple.

(4) An electric stapler of a moving type included in a copier, particularly an electric stapler smoothing to feed paper.

(5) An electric stapler facilitating operation of interchanging a staple cartridge.

(6) An electric stapler improving a clincher mechanism.

(7) An electric stapler stabilizing clinching operation.

BACKGROUND ART

According to an electric stapler included in a copier, a driver unit and a clincher unit are separated from each other upwardly and downwardly interposing a sheet table, and paper fed from a copying mechanism portion to a sheet table of an electric stapler is bound by a staple and thereafter discharged by passing an interval between the driver unit and the clincher unit.

Further, there is an electric stapler having a skewed binding function of moving the electric stapler at a vicinity of a corner portion of paper, rotating the electric stapler horizontally by 45 degrees and striking a staple in addition to a normal back binding function of striking a staple in parallel with a side of paper. There is posed a first problem that an electric stapler of this kind is provided with a motor for transverse movement and a motor for rotation, the mechanism is complicated, and in order to make rotational angles of the driver unit and the clincher unit separated upwardly and downwardly accurately coincide with each other, high accurate working of parts and adjustment in integration are needed and the cost is required therefor.

Further, a moving type electric stapler included in a copier is constituted such that a driver unit and a clincher unit are respectively engaged with two pieces of guide shafts arranged in parallel with each other and the driver unit and the clincher unit are moved in synchronism with each other by feeding means of a timing belt or a feed screw or the like.

The driver unit and the clincher unit of the moving type electric stapler of the background art are supported in air by the guide shafts. Therefore, there is posed a second problem that the guide shafts are bent by a reaction force in injecting and clinching a staple and when a number of sheets of paper is large and a striking load is large, a failure in penetrating a staple or buckling thereof or the like is brought about.

Further, according to an electric stapler using a linear staple, a staple sheet at inside of a staple cartridge is fed frontward by a staple feed mechanism and both sides of a staple other than a center portion thereof coming out from a staple outlet of the cartridge to outside is struck by a forming plate to form in a gate-like shape. A formed front staple is brought into a driver path having a predetermined lateral width formed at a guide plate on a front side and the staple is injected by a driver and at the same time, and when a staple at a successive row is formed by the forming plate and the driver returns to a standby position, a successive gate-like staple is fed into the driver path. At this occasion, when an attitude of the staple is inclined in a front and rear direction or a left and right direction, the driver cannot accurately strike a horizontal crown portion of the gate-like staple and the staple is buckled at inside of the driver path to clog. Therefore, in order to correctly maintain the attitude of the staple until striking the staple, a leaf spring is provided at a front end face on a side of the staple outlet of the staple cartridge, a front end portion of the plate spring is brought into elastic contact with the front wall face of the driver path and the staple is injected while rubbing the leaf spring by the staple and the driver to thereby prevent the staple from being inclined by the leaf spring.

The electric stapler of the background art maintains the attitude in injecting the staple by the leaf spring arranged at the driver path. However, there poses a third problem that since the staple and the driver pass the driver path by rubbing the leaf spring, a spring pressure of the leaf spring constitutes a drive load of the driver and loss of power and striking energy is considerable.

Further, there is a copier including an electric stapler simultaneously binding a plurality of locations of paper by a plurality of the electric staplers and there is a copier successively binding a plurality of locations of paper by moving a single piece of the electric stapler by a feed mechanism. Further, according to a copier constituted to laminate paper on the feed table by disposing a copy face of paper to a lower side for convenience of collation, in order to penetrate a staple from tail to head of paper, the driver unit of the electric stapler is arranged below the sheet table and the clincher unit is arranged above the sheet table. The staple guide of the driver unit is brought into a hole formed at the sheet table from a lower side to be brought into contact with paper face, the clincher unit on the upper side is moved down and pinches paper on the sheet table along with the staple guide and leg portions of the staple penetrating paper from the lower side are folded to bend by the clincher.

According to the copier in which the staple guide is made to advance into the hole of the sheet table in order to pinch paper on the sheet table by the staple guide of the driver unit and the clincher unit, and the single piece of the electric stapler is moved laterally by the feed mechanism, there is constructed a constitution in which a long hole in a lateral direction is formed at the sheet table and the staple guide of the driver unit is moved at in side of the long hole. Therefore, there poses a fourth problem that in feeding paper to the sheet table after having been processed by a copying step, a front edge portion of paper is caught by the long hole of the sheet table and a failure in feeding paper is brought about. Further, by forming the long hole at the sheet table, a bending strength of the sheet table is reduced and therefore, it is preferable that a dimension of the hole is as small as possible.

Further, the copier is arranged with a mechanism portion for traveling paper in a left and right direction to copy and discharge and copied paper is discharged to a tray provided at a left side face of the copier. A shaft of an electrostatic drum and a shaft of a feed roller of the copy mechanism portion are arranged orthogonally to a paper feeding direction and the included electric staple is arranged transversely in view from a front side of the copier in accordance with the direction of feeding paper.

Although the electric stapler is constituted by a structure of charging the staple cartridge from an upper side or a rear face side, inside of the copier is occupied by the copying mechanism portion and normally, there is not a space sufficiently for attaching and detaching the staple cartridge. Therefore, in interchanging the staple cartridge, a total of the unit of the electric stapler must be drawn out of the copier to this side by opening a front cover of the copier. Therefore, there is posed a fifth problem that time and labor is taken in operation of attaching and detaching the staple cartridge and replenishing the staple.

Further, the electric stapler is interposed with a suspension mechanism using a spring brought into contact with paper on the sheet table at the driver portion or the clincher portion which is constituted to absorb a difference in paper thickness by contracting the suspension mechanism in pinching paper by the driver portion and the clincher portion to deal with prints having various thicknesses.

A copier of a stapler including type is constituted to laminate paper on the sheet table by disposing a copy face of paper on the lower side for convenience of collation, the driver portion of the electric stapler is arranged below the sheet table and the clincher portion is arranged above the sheet table. Therefore, in this case, the suspension mechanism is interposed in the clincher portion, the clincher portion is moved down from the upper side to be brought into press contact with paper on the sheet table, the driver portion strikes out a staple from the lower side and leg portions of the staple penetrating paper are folded to bend by a clincher arm of the clincher portion to bind paper.

In the above-described electric stapler, there poses a sixth problem that when the clincher portion is brought into press contact with paper on the sheet table, an operating load for compressing the spring of the suspension mechanism is considerable and power consumption is considerable. Further, when the clincher portion is moved up after stapling, the suspension mechanism is released of being compressed to abruptly return to the initial state to thereby pose also a problem that mechanical noise is large.

Further, there is known an electric stapler of arranging the clincher portion and the driver portion opposedly to each other, pinching paper by the clincher portion and the driver portion and folding to bend leg portions of a staple injected by a driver by a movable type clincher. According to an electric stapler of this kind, the clincher portion and the driver portion are separated from each other. Therefore, there poses a seventh problem that high accuracy is requested in working and integrating parts in order to accurately coincide positions of the driver and the clincher. Further, when a position of the staple struck out by the driver is shifted frontward or rearward, a failure in clinching may be brought about since the clincher cannot normally clinch the staple.

Further, the electric staple included in the copier is constituted to pinch paper by the driver unit and the clincher unit separated upwardly and downwardly to staple and there is an electric stapler arranged with a plurality of sets of driver units and clincher units in accordance with positions of binding paper and there is an electric stapler of a moving type for moving one set of a driver unit and a clincher unit to staple a plurality of locations of paper.

According to the moving type electric stapler, the driver unit and the clincher unit are moved in synchronism with each other by timing belts respectively engaged with guide shafts. Initial stage gears or cams of drive gear mechanisms of the driver unit and the clincher unit are respectively fit slidably with two pieces of drive shafts of spline shafts or D-type section shafts or the like made to span in parallel with the guide shafts and by driving to rotate the two pieces of drive shafts, the driver and the clincher are driven via the gears or the cams to carry out binding operation. Further, there is also known a moving type electric stapler constituted to respectively mount motors to the driver unit and the clincher unit and carry out binding operation by controlling a traveling motor, a driver drive motor and a clincher drive motor by a control circuit.

When the moving type electric stapler is added with a corner skewedly binding function for striking a staple to a side of paper by an angle of substantially 45 degrees in addition to a back binding function of striking staples to a plurality of locations of a side of paper, there is needed a mechanism of rotating the driver unit and the clincher unit horizontally by about 45 degrees. In this case, according to a power transmission mechanism of the background art for driving the driver and the clincher by drive shafts made to span an interval of a frame, the driver unit and the clincher unit cannot be rotated horizontally relative to the drive shafts and therefore, it is general to construct a constitution of respectively mounting motors to the driver unit and the clincher unit and separately driving the driver and the clincher. However, there poses an eighth problem that according to the above-described constitution, in addition to the driver drive mechanism and the clincher drive mechanism, horizontal rotation drive mechanisms are respectively provided, the constitution is complicated to thereby bring about an increase in a number of parts, large-sized formation and an increase in cost.

SUMMARY OF THE INVENTION

Hence, there is brought about a technical problem to be resolved in order to promote simplification and operational accuracy of a rotating mechanism of an electric stapler and it is a first object of the invention to resolve the above-described problem.

Further, there is brought about a technical problem to be resolved in order to resolve a concern of a failure in binding by enabling to carry out stapling firmly regardless of large or small of a striking load.

Further, there is brought about a technical problem to be resolved in order to alleviate a drive load of an electric stapler and it is a third object of the invention to resolve the above-described problem.

Further, there is brought about a technical problem to be resolved in order to resolve a concern of a failure in feeding paper by dispensing with a long hole of a sheet table in a moving type stapler and it is a fourth object of the invention to resolve the above-described problem.

Further, there is brought about a technical problem to be resolved in order to facilitate to attach and detach a stapler cartridge and it is a fifth object of the invention to resolve the above-described problem.

Further, there is brought about a technical problem to be resolved in order to resolve a reduction in an operational load and power consumption in compressing a spring of a suspension mechanism and a reduction in mechanical noise in returning to an initial state and it is a sixth object of the invention to resolve the above-described problem.

Further, there is brought about a technical problem to be resolved in order to stabilize clinching operation by enabling to firmly clinch a staple even when a relative positional shift of the staple relative to a clincher is brought about and it is a seventh object of the invention to resolve the above-described problem.

Further, there is brought about a technical problem to be resolve in order to provide a further concise mechanism of horizontally rotating a driver unit and a clincher unit and it is an eighth object of the invention to resolve the above-described problem.

The invention is proposed in order to achieve the above-described objects and with regard to the first object, the invention provides an electric stapler constituted by an electric stapler arranged with a driver unit and a clincher unit upwardly and downwardly to be opposed to each other and including a mechanism of transversely moving and a mechanism of horizontally rotating the driver unit and the clincher unit:

wherein the electric stapler is provided with a synchronizingly drive mechanism arranged with two pieces of linear rails upwardly and downwardly in parallel with each other, attached with slide bases respectively at the two pieces of linear rails and traveling the two slide bases in synchronism with each other and provided with a click stop mechanism attached with a driver unit horizontally rotatably at one of the slide bases, attached with a clincher unit horizontally rotatably at other of the slide bases, making the driver unit and the clincher unit opposed to each other and capable of fixing respectives of the driver unit and the clincher unit at a 0 degree position or a 45 degree rotated position in which respective outer peripheral portions of the driver unit and the clincher unit are provided with claw portions in correspondence with the 0 degree position and the 45 degree rotated position, a skewed binding position on a traveling path is arranged with a stopper member of a stopper pin or a projected portion or the like, when the driver unit and the clincher unit are traveled from an initial position to the skewed binding position, the claw portion of the 0 degree position impinges on the stopper member and the driver unit and the clincher unit are rotated by 45 degrees to fix and when the driver unit and the clincher unit are traveled reversely to the initial position, the claw portion of the 45 degree rotated position impinges on the stopper member and the driver unit and the clincher unit are rotated to the 0 degree position to fix.

Further, with regard to the second object, the invention provides an electric stapler constituted by an electric stapler in which a frame is arranged with two pieces of linear guide members in parallel with each other, a clincher unit is mounted to one of the linear guide members, a driver unit is mounted to other of the linear guide members and a front face of the driver unit and a front face of the clincher unit are made to be opposed to each other and the clincher unit and the driver unit are traveled in synchronism with each other by a synchronizingly moving mechanism:

wherein the frame is provided with slide ways brought into contact with respective rear faces of the clincher unit and the driver unit and reaction forces operated to the clincher unit and the driver unit in binding operation are received by the slide ways.

Further, with regard to a third object, the invention provides an electric stapler constituted by an electric stapler including a forming mechanism for forming a linear staple in a gate-like shape, a driver mechanism for injecting the staple formed in the gate-like shape and a clinch mechanism for folding to bend two leg portions of a staple in the gate-like shape:

wherein the electric stapler is provided with an anvil guide mechanism for attaching an anvil supporting a middle portion of the linear staple in forming to an anvil supporting member pivotably in a front and rear direction, forming the anvil supporting member and the anvil to move up and down integrally with the driver by integrating the anvil supporting member to the driver mechanism, maintaining the anvil in a state of being projected to a front side of a front end face of the driver immediately before the anvil is brought into contact with an object of stapling and thereafter escaping the anvil from a path of the driver by inclining the anvil forward and a horizontal crown portion of the staple in the gate-like shape is supported by the anvil immediately before finishing to strike the staple by the driver.

Further, with regard to the fourth object, the invention provides an electric stapler characterized in an electric stapler arranged with two pieces of linear guide members in parallel with each other by interposing a sheet table, mounted with a clincher unit at one of the linear guide members, mounted with a driver unit at other of the linear guide members and making a front face of the driver unit and a front face of the clincher unit opposed to each other and traveling the clincher unit and the driver unit by a synchronizing moving mechanism, wherein the driver unit is attached with a staple guide for maintaining a staple in striking the staple to the driver unit to be able to move up and down, provided with a mechanism of moving up and down the staple guide moved in cooperation with a mechanism of driving the driver and the staple guide is projected in a direction of injecting the staple in starting to strike the staple, brought into a through hole of the sheet table to pinch paper along with the clincher unit and the staple guide is escaped from the hole after finishing to strike the staple.

Further, the invention provides an electric stapler formed such that the staple guide is provided at a staple cartridge and the staple guide is moved up and down by the mechanism of moving up and down the staple guide moved in cooperation with the mechanism of driving the driver.

Further, with regard to the fifth object, the invention provides an electric stapler which is an electric stapler including a transverse moving mechanism for traveling the stapler along a transverse rail:

wherein the electric stapler is provided with a staple cartridge charging port at a rear face of the staple arranged with a driver at a front portion thereof and provided with a rotating mechanism for rotating the stapler horizontally by 90 degrees and the staple cartridge charging port at the rear face of the stapler is directed in a direction of an extended line of the transverse rail by traveling the stapler to one end portion of the transverse rail and horizontally rotating the stapler by 90 degrees.

Further, the invention provides an electric stapler constituted such that the rotating mechanism comprises a plurality of claw portions aligned radially at an outer periphery of the stapler capable of being rotated horizontally and a plurality of stopper members provided in parallel with each other at a vicinity of an end of the transverse rail, wherein the plurality of claw portions and the plurality of stopper members are successively brought in mesh with each other and the stapler is rotated horizontally by 90 degrees by traveling the stapler to one end portion of the transverse rail.

Further, the invention provides an electric stapler, wherein the stapler is an upwardly and downwardly separated type stapler separating the driver portion and the clincher portion upwardly and downwardly to be opposed to each other and traveling the driver portion and the clincher portion in synchronism with each other by a synchronizingly traveling mechanism wherein a 90 degree horizontal rotating mechanism(s) is(are) provided to only the driver portion or both of the driver portion and the clincher portion.

Further, with regard to the sixth object, the invention provides an electric stapler characterized in an electric stapler including first driving means arranged with a clincher portion and a driver portion opposedly to each other for moving the clincher portion to the driver portion, and second driving means for moving the clincher to the driver portion by way of a clincher pusher provided at inside of the clincher portion, in which the clincher portion is moved by the first driving means and paper is pinched by the clincher portion and the driver portion by the first driving means, and the clincher is moved and a leg portion of the staple is folded to bend by the second driving means after injecting the staple by the driver of the driver portion:

wherein the clincher portion and the clincher pusher are engaged by the single piece of feed screw and the first and the second driving means are constituted by a feed screw mechanism.

Further, the invention provides an electric stapler in which the electric stapler includes first detecting means for detecting pinching of a sheet by the clincher portion and the driver portion, and second detecting means for detecting finishing of clinching the staple by the clincher and includes controlling means for controlling the feed screw in accordance with detected signals of the first detecting means and the second detecting means.

Further, with regard to the sixth object, the invention provides an electric stapler characterized in an electric stapler arranged with a driver below a sheet table, arranged with a clincher on an upper side of the sheet table, in which the driver and the clincher are made to be opposed to each other by interposing the sheet table, the clincher is moved down to be grounded on paper on the sheet table, the clincher is moved down to ground on paper on the sheet table, the staple is injected to an upper side by way of a hole of the sheet table and a leg portion of the staple penetrating paper is folded to bend by the clincher, wherein a mechanism of moving up and down the clincher is constituted by a mechanism of a feed screw driven by a motor, a grounding sensor for detecting grounding of the clincher is provided, and controlling means for stopping to driver to move down the clincher in accordance with a grounding detecting signal of the grounding sensor is provided.

Further, the invention provides an electric stapler wherein the electric stapler is provided with an injection detecting sensor for detecting finishing of injecting a staple by the driver and provided with controlling means for returning a clincher to an initial position by reversely rotating a clincher drive motor after a leg portion of a staple is folded to bend by driving a clincher in accordance with an injection finish signal of the injection detecting sensor.

Further, the invention provides an electric stapler characterized in an electric stapler arranged with a driver below a sheet table, arranged with a clinch mechanism portion including a clincher of an upwardly and downwardly movable type on an upper side of the sheet table, making the driver and the clinch mechanism portion opposed to each other by interposing the sheet table, moving down the clinch mechanism portion to ground on paper on the sheet table, injecting a staple to an upper side by way of a hole of the sheet table by the driver and folding to bend a leg portion of the staple by moving down the clincher of the clincher mechanism portion:

wherein the clincher mechanism portion and the mechanism of moving up and down the clincher are constituted by a mechanism of a feed screw driven by a motor, the electric stapler is provided with a grounding sensor for detecting grounding of the clincher mechanism portion and a clinch sensor for detecting finishing of clinching the staple by the clincher and provided with controlling means for stopping to drive to move down the clinch mechanism portion in accordance with a grounding detecting signal of the grounding sensor and stopping to drive to move down the clincher in accordance with a grounding detecting signal of the clinch sensor.

Further, the invention provides an electric stapler provided with an injection detecting sensor for detecting finishing of injecting the staple by the driver, and controlling means for stopping to drive to move down the clinch mechanism portion in accordance with a grounding detecting signal of the grounding sensor, successively injecting the staple by starting the driver, folding to bend a leg portion of the staple by driving to move down the clincher in accordance with an injection finish signal of the injection detecting sensor and reversely rotating the clincher drive motor in accordance with a clinch finish signal of the clinch sensor to return the clinch mechanism portion and the clincher to an initial position.

Further, with regard to the seventh object, the invention provides an electric stapler characterized in an electric stapler arranged with a clincher portion including a movable type clincher and a driver portion including a driver to be opposed to each other, pinching paper by the clincher portion and the driver portion by moving one of the clincher portion and the driver portion and folding to bend a leg portion of a staple injected by the driver of the driver portion by the clincher:

wherein the electric stapler is constituted by an automatic arranging mechanism attaching the clincher to a clincher holder covering two front and rear faces of the clincher, attaching the clincher holder to the clincher portion movably in a front and rear direction, forming a guide face inclined to a depth side of inside of the clincher holder from two edge portions in the front and rear direction to a face of the clincher holder opposed to the driver and the clincher is aligned to the staple by automatically aligning a position of the clincher holder in the front and rear direction when a front end of the staple presses the guide face.

Further, with regard to the eighth object, the invention provides an electric stapler characterized in being constituted by a moving type electric stapler slidably engaging the stapler to a guide shaft and a drive shaft arranged in parallel with each other, moving the stapler along the guide shaft by a stapler moving mechanism, and carrying out a binding processing by driving the stapler by driving to rotate the drive shaft, wherein the electric stapler is constituted by a stapler driving mechanism attaching the stapler to a carriage slidably engaged with the guide and the drive shaft to be able to rotate horizontally and connecting a gear shaft passing a center of rotating the stapler and the drive shaft by a bevel gear, the stapler is driven by transmitting power from the drive shaft to the gear shaft, the stapler is provided with a brake for braking the gear shaft and the stapler is horizontally rotated by braking the gear shaft by driving the brake by brake controlling means and driving to rotate the drive shaft.

Further, the invention provides an electric stapler provided with a stopper mechanism for stopping the stapler at a predetermined rotational position and releasing the stapler from being stopped.

Further, the invention provides an electric stapler, wherein the stapler is provided with a pivoting type lever and lever driving means, the lever is switchable to two positions of a stapler rotatable portion for braking the bevel gear and the gear shaft by bringing a front end thereof in mesh with the bevel gear of the gear shaft and a stapler fixing position for stopping to rotate the stapler by engaging other end thereof to a stopper portion of a hole, a claw or the like formed at the carriage and the lever is switched to the stapler rotatable position and the stapler fixing position by the lever driving means.

Figure 1:
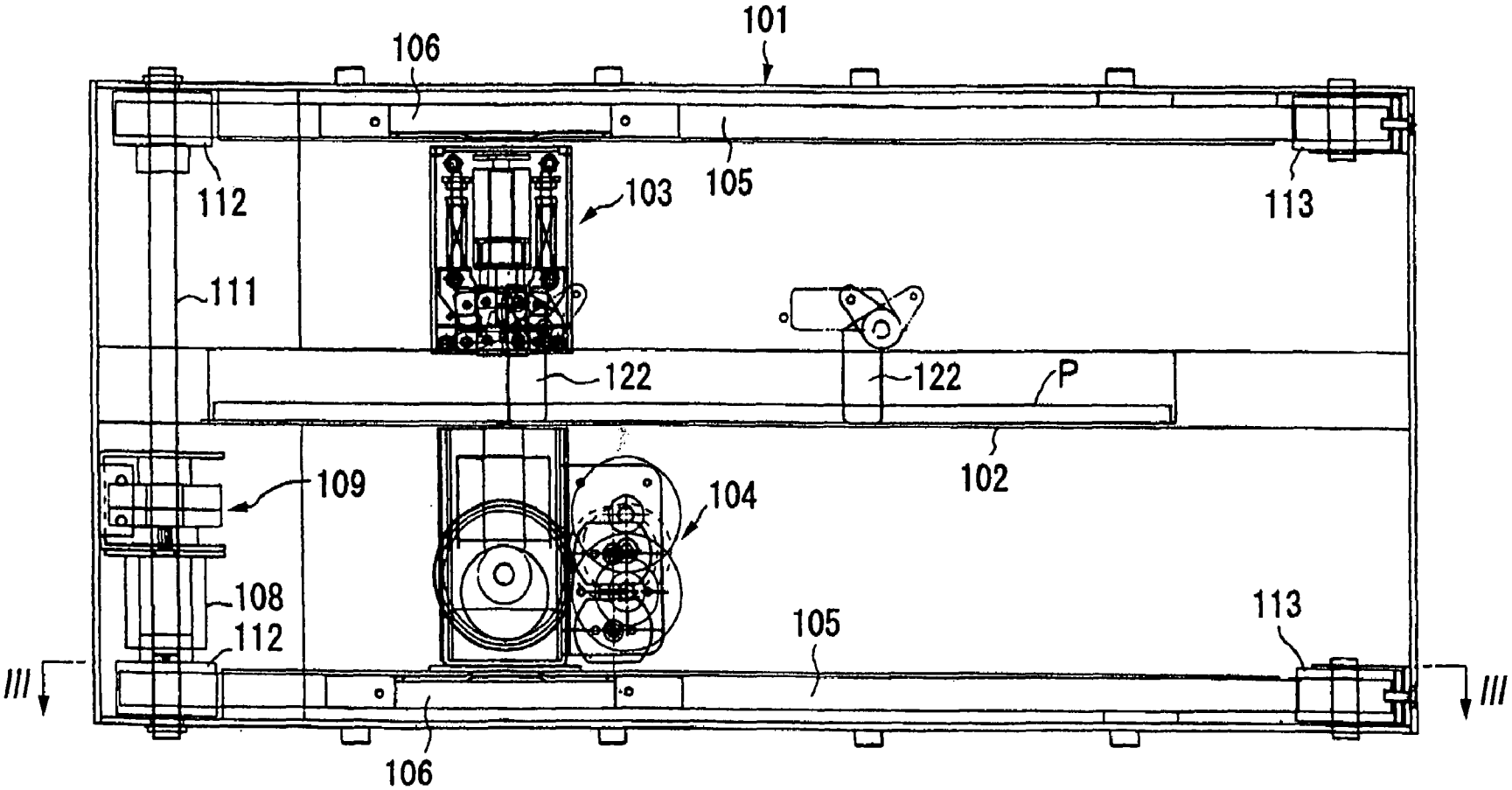
FIG. 1 is a front view of an electric stapler showing an embodiment of the invention.

Further, in notations in the drawings, numeral 101 designates a frame, numeral 102 designates a sheet table, numeral 103 designates a clincher unit, numeral 104 designates a driver unit, numeral 106 designates a slide base, numeral 107 designates a shaft, numeral 112 designates a gear pulley, numeral 113 designates a driven gear pulley, numeral 114 designates a timing belt, numeral 115 designates a guide groove, notation 115*a* designates a catch portion, numeral 117 designates a swing pin, notation 117*a* designates a spring, numeral 118 designates a base plate, numeral 119 designates a 0 degree claw portion, numeral 120 designates a 45 degree claw portion, numeral 121 designates a stopper pin, numeral 201 designates a frame, numeral 202 designates a sheet table, numeral 203 designates a clincher unit, numeral 204 designates a driver unit, numeral 206 designates a slide base, numeral 207 designates a shaft, numeral 212 designates a gear pulley, numeral 213 designates a driven gear pulley, numeral 214 designates a timing belt, numeral 215 designates a slide way, numeral 304 designates a driver unit, numeral 321 designates a cam shaft, numeral 322 designates a driver cam, numeral 323 designates a front guide plate, notation 323*a* designates a rib, numeral 324 designates a driver cam follower, numeral 325 designates an anvil, notation 325*a* designates a fold-to-bend portion, notation 325*b* designates a claw portion, numeral 326 designates a front base plate, notation 326*b* designates a projection, numeral 327 designates a driver guide plate, numeral 328 designates a driver assisting plate, numeral 329 designates a driver, numeral 330 designates a forming plate, numeral 331 designates a center base plate, numeral 332 designates a forming cam follower, numeral 333 designates a forming cam, numeral 334 designates a rear base plate, numeral 335 designates a staple feed cam follower, numeral 336 designates a staple feed cam, numeral 401 designates a frame, numeral 402 designates a sheet table, numeral 403 designates a clincher unit, numeral 404 designates driver unit, numeral 423 designates a hole, numerals 435, 435 designate a pair of link levers, numeral 436 designates a staple feed cam follower, numeral 451 designates a staple cartridge, numeral 459 designates a leaf spring, numeral 460 designates a staple guide, numeral 461 designates a slider, numeral 462 designates a leaf spring, numeral 463 designates a feed claw, numeral 464 designates an arm, numeral 501 designates a frame, numeral 502 designates a sheet table, numeral 503 designates a clincher unit, numeral 504 designates a driver unit, numeral 506 designates a slide base, numeral 507 designates a shaft, numeral 515 designates a cartridge containing portion, numeral 521 designates a first stopper pin, numeral 522 designates a second stopper pin, numeral 523 designates a base plate, numeral 524 designates a 0 degree claw portion, numeral 525 designates a 45 degree claw portion, numeral 526 designates a third claw portion, numeral 531 designates a staple cartridge, numeral 532 designates an opening portion, numeral 534 designates a slide door, numeral 541 designates a staple pack, numeral 542 designates a staple sheet, numeral 601 designates a frame, numeral 602 designates a sheet table, numeral 603 designates a clincher portion, numeral 604 designates a driver portion, numeral 613 designates a clincher drive motor, numeral 614 designates a clincher frame, numeral 615 designates a gear, numeral 617 designates a gear holder, numeral 618 designates a screw shaft, numeral 619 designates a front cover frame, numeral 620 designates a rear cover frame, numeral 621 designates an upper support frame, numeral 622 designates a clincher unit, notation 622*a* designates a support plate, numeral 625 designates a clincher pusher, numeral 628 designates a stopper plate, numeral 630 designates clincher, numeral 631 designates a support shaft, numeral 632 designates a leaf spring, numeral 634 designates a clincher holder, numeral 635 designates a spacer, numeral 638 designates a guide face, numeral 639 designates a slider, numeral 647 designates a grounding sensor, numeral 648 designates a clinch sensor, numeral 701 designates a frame, numeral 702 designates a sheet table, numeral 703 designates a clincher unit, numeral 704 designates a driver unit, numeral 713 designates a clincher drive motor, numeral 714 designates a clincher frame, numeral 716 designates a gear, numeral 717 designates a gear holder, numeral 718 designates a screw shaft, numeral 719 designates a front cover frame, numeral 720 designates a rear cover frame, numeral 721 designates an upper support frame, numeral 722 designates a support plate, numeral 725 designates a clincher pusher, numeral 728 designates a stopper plate, numeral 730 designates a clincher, numeral 734 designates a slider, numeral 742 designates a grounding sensor, numeral 743 designates a clinch sensor, numeral 744 designates an initial position detecting sensor, numeral 749 designates a driver, numeral 755 designates an injection detecting sensor, numeral 756 designates an initial position detecting sensor, numeral 761 designates a staple cartridge, notation A8 designates a clincher portion, notation B8 designates a driver portion, numeral 801 designates a clincher carriage, numeral 802 designates a clincher unit, numeral 803 designates a driver carriage, numeral 804 designates a driver unit, numeral 806 designates a guide shaft, numeral 807 designates a drive shaft, numeral 808 designates a reduction gear, numeral 809 designates a motor, numeral 815 designates a gear shaft, numeral 819 designates a brake lever, numeral 821 designates a groove hole, notation 821*a* designates a 0 degree recess portion, notation 821*b* designates a 45 degree recess portion, notation a8, b8, c8, d8 designate bevel gears.

DESCRIPTION OF THE PREFERRED EMBODIMENTS

Figure 2:
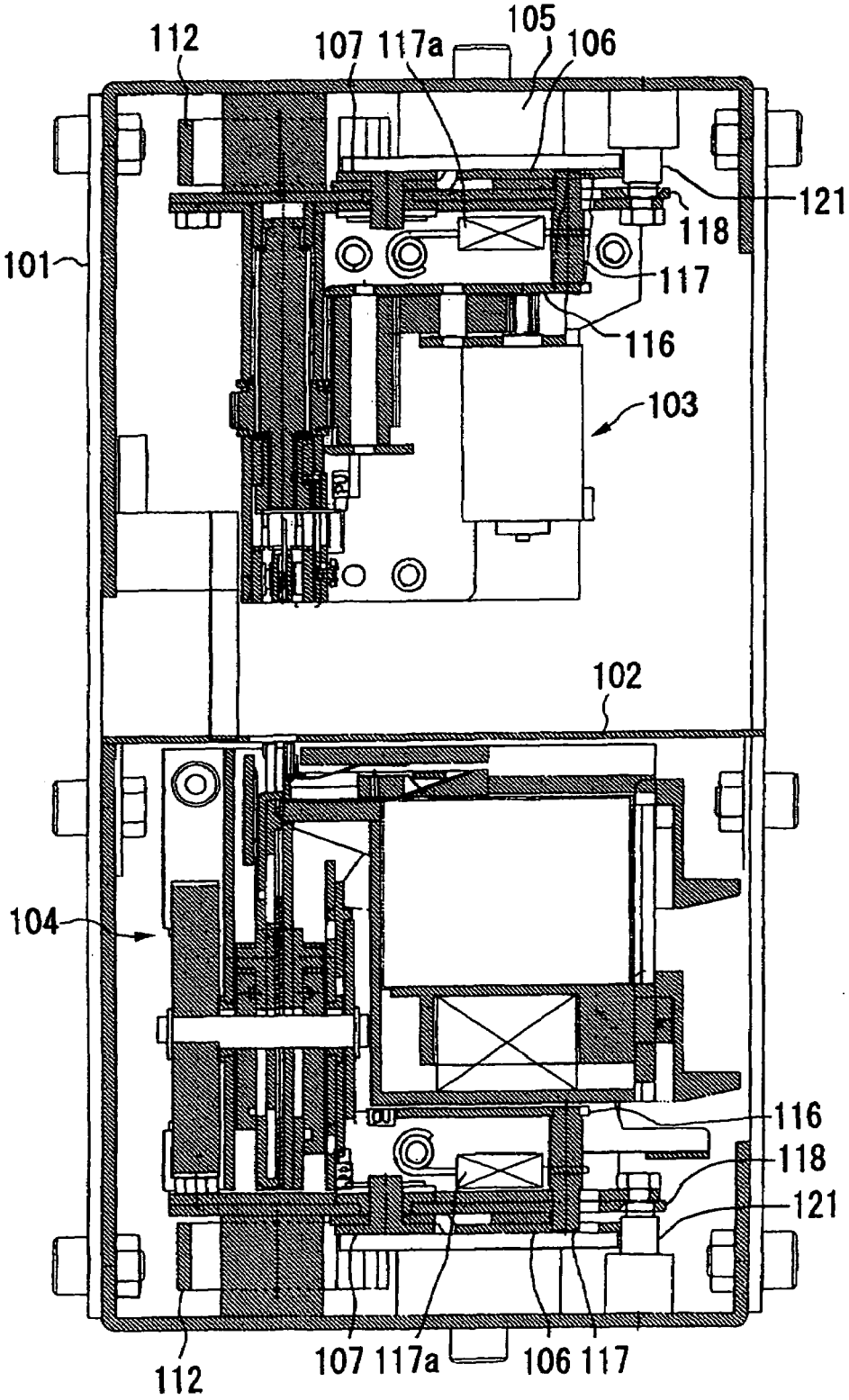
FIG. 2 is a side view of the electric stapler.
Figure 3:
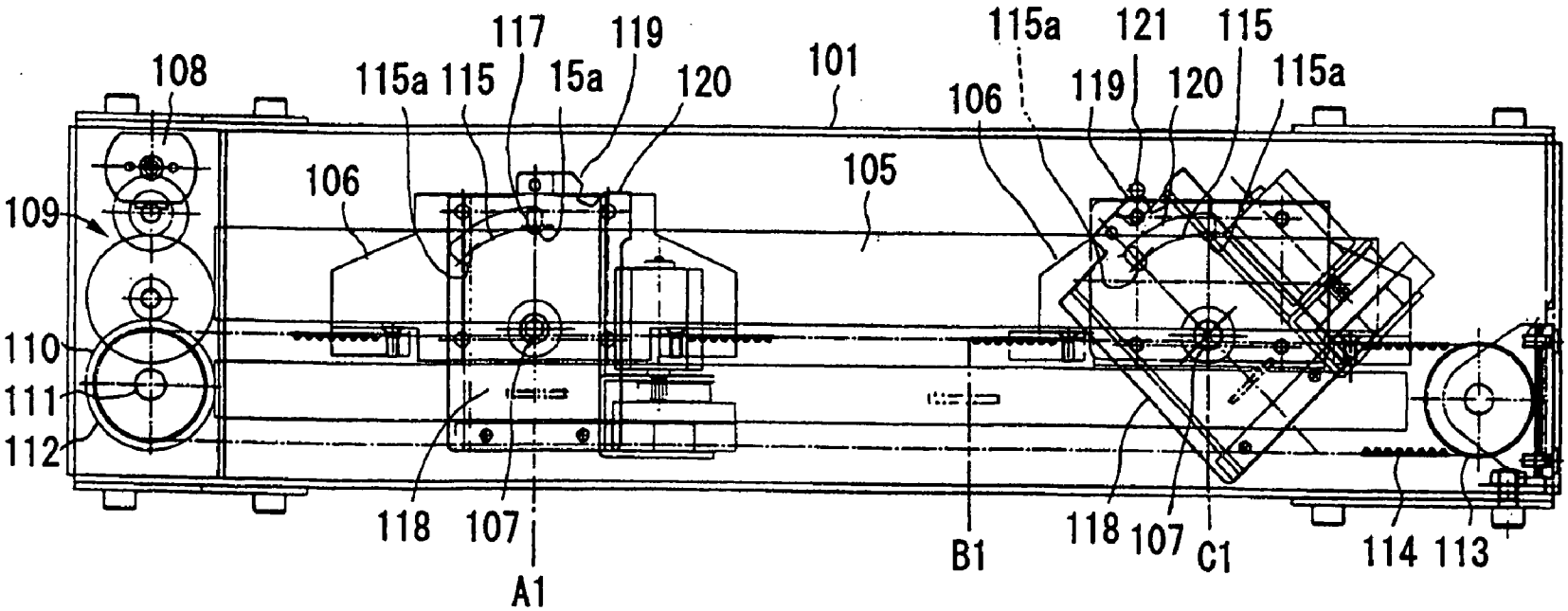
FIG. 3 is a view taken along a line III—III of FIG. 1.

A detailed description will be given of a first embodiment of the invention in reference to the drawings as follows. FIG. 1 is a front view of an electric stapler, FIG. 2 is a side view thereof and FIG. 3 is a sectional view taken along a line III—III of FIG. 1, and FIG. 3 illustrates states of moving a clincher unit and a driver unit to an initial position (left) and a skewed binding position (right) in the same drawing. In the drawings, numeral 101 designates the frame, numeral 102 designates the sheet table made to span a middle portion in an up and down direction of the frame 101, the clincher unit 103 is arranged on an upper side of the sheet table 102, the driver unit 104 is arranged on a lower side of the sheet table 102 and the clincher unit 103 and the driver unit 104 are integrally traveled to the right along linear guides 105 respectively provided at a ceiling face and a bottom face of the frame 101. Traveling mechanisms and rotating mechanisms of the clincher unit 103 and the driver unit 104 are constructed by the same constitution, the clincher unit 103 and the driver unit 104 are attached to the shafts 107 provided at the central portions of the slide bases 106, and the clincher unit 103 and the driver unit 104 can be rotated in a horizontal direction.

As shown by FIG. 1 and FIG. 3, a motor 108 for moving the stapler is arranged at a left end portion of the frame 101, and the gear pulleys 112 are attached to two upper and lower end portions of a vertical drive shaft 111 attached with a gear 110 at a final stage of a reduction gear train 109. Both ends of the timing belt 114 hung around the gear pulley 112 on the upper side and the driven gear pulley 113 arranged at an upper portion of a right end of the frame 101 stay to be attached to the slide base 106 supporting the clincher unit 103, and both ends of the timing belt 114 hung around the gear pulley 112 on a lower side of the drive shaft 111 and the driven gear pulley 113 arranged at a lower portion of a right end of the frame 101 stay to be attached to the side base 106 supporting the driver unit 104 to thereby constitute a stapler moving mechanism for traveling the clincher unit 103 and the driver unit 104 in synchronism with each other.

As shown by FIG. 3, the slide base 106 is provided with the guide groove 115 in a 45 degree circular arc shape constituting a radius center by the shaft 107 and both end portions of the guide groove 115 are formed with the catch portions 115*a* recessed in the direction of the radius center. As shown by FIG. 2, head portions of the swing pins 117 attached to brackets 116 at inside of frames of clincher unit 103 and the driver unit 104 are engaged with the guide grooves 115 of the slide base 106. The swing pins 117 are inclinable by constituting fulcra by attaching points thereof, and maintained in an erected attitude by the springs 117*a* to operate as click stop mechanisms for fixing the clincher unit 103 and the driver unit 104 at 0 degree positions or 45 degree rotated positions. That is, when the clincher unit 103 and the driver unit 104 are at rotational angles other than the 0 degree positions or the 45 degree rotated positions shown in FIG. 3, the swing pins 117 are inclined to be brought into elastic contact with side faces of the guide grooves 115 and when the clincher unit 103 of the driver unit 104 are pivoted to the 0 degree positions or the 45 degree rotated positions, the swing pins 117 are engaged with the catch portions 115*a* at either of the both ends of the guide grooves 115 by a recovery force of the spring 117*a* to return to the erected attitude and the clincher unit 103 and the driver unit 104 are fixed.

Front edge portions (upper side of FIG. 3) of the respective base plates 118 (plates in contact with the slide base) of the clincher unit 103 and the driver unit 104 are formed with the 0 degree claw portions 119 projected to the front side and the 45 degree claw portions 120 projected to the front side in the right 45 degree direction and distances of the 0 degree claw portion 119 and the 45 degree claw portion 120 from the shaft 107 is made to be substantially equal to each other. As shown by FIG. 2 and FIG. 3, the stopper pins 121 for rotating the clincher unit 103 and the driver unit 104 are fixed to a ceiling face and an inner bottom face of the frame 101. The stopper pins 121 are disposed at vicinities of right ends of ranges of traveling the clincher unit 103 and the driver unit 104 and provided at positions at which the stopper pins 121 are brought into contact with the side faces of the above-described 0 degree claw portions 119 when the clincher unit 103 and the driver unit 104 are traveled to the right side.

Next, an explanation will be given of operation of the electric stapler. The electric stapler carries out back binding for binding two locations of the side of paper or skewed binding of striking a staple to a corner portion of paper by an angle of 45 degrees by being controlled by a control portion of a copier. When one copy set of paper P is fed from a copying mechanism portion to the sheet table 102, in the case of the back binding mode, a staple is struck at an A1 position shown in FIG. 3 and a staple is struck by moving the clincher unit 103 and the driver unit 104 to a B1 position by a stapler moving mechanism. Further, numeral 122 shown in FIG. 1 designates a stopper for aligning paper and the stopper is escaped from the path of paper by being rotated to the upper side by 90 degrees after the binding processing and the paper P is discharged.

When the skewed binding is set, the clincher unit 103 and the driver unit 104 are moved to a C1 position at a right end from the A1 position. At this occasion, immediately before reaching the C1 position, the 0 degree claw portions 119 of the base plates impinge on the stopper pins 121 of the frame 101 and by moving the slide faces 106 further to the right, the clincher unit 103 and the driver unit 104 are rotated to the left by being pressed by the stopper pins 121, and when the clincher unit 103 and the driver unit 104 are rotated by 45 degrees, the swing pins 117 of the clincher unit 103 and the driver unit 104 are engaged with the left end catch portions 115*a* of the guide grooves 115 of the slide bases 106 to fix to the 45 degree rotated positions. After striking the staple to paper, when the clincher unit 103 and the driver unit 104 start traveling to the left by driving to rotate the stapler moving mechanism reversely, the 45 degree claw portions 120 disposed at the 0 degree rotated positions impinge on the stopper pins 121 to rotate the clincher unit 103 and the driver unit 104 in the clockwise direction to respectively return to the 0 degree rotated positions, the swing pins 117 are engaged with the right end catch portions 115*a* of the guide grooves 115 of the slide bases 106 to fix to the 0 degree rotated positions and at the same time, the 45 degree claw portions 120 are detached from the stopper pins 121 and the clincher unit 103 and the driver unit 104 are traveled further to the left to return to the A1 position.

Figure 4:
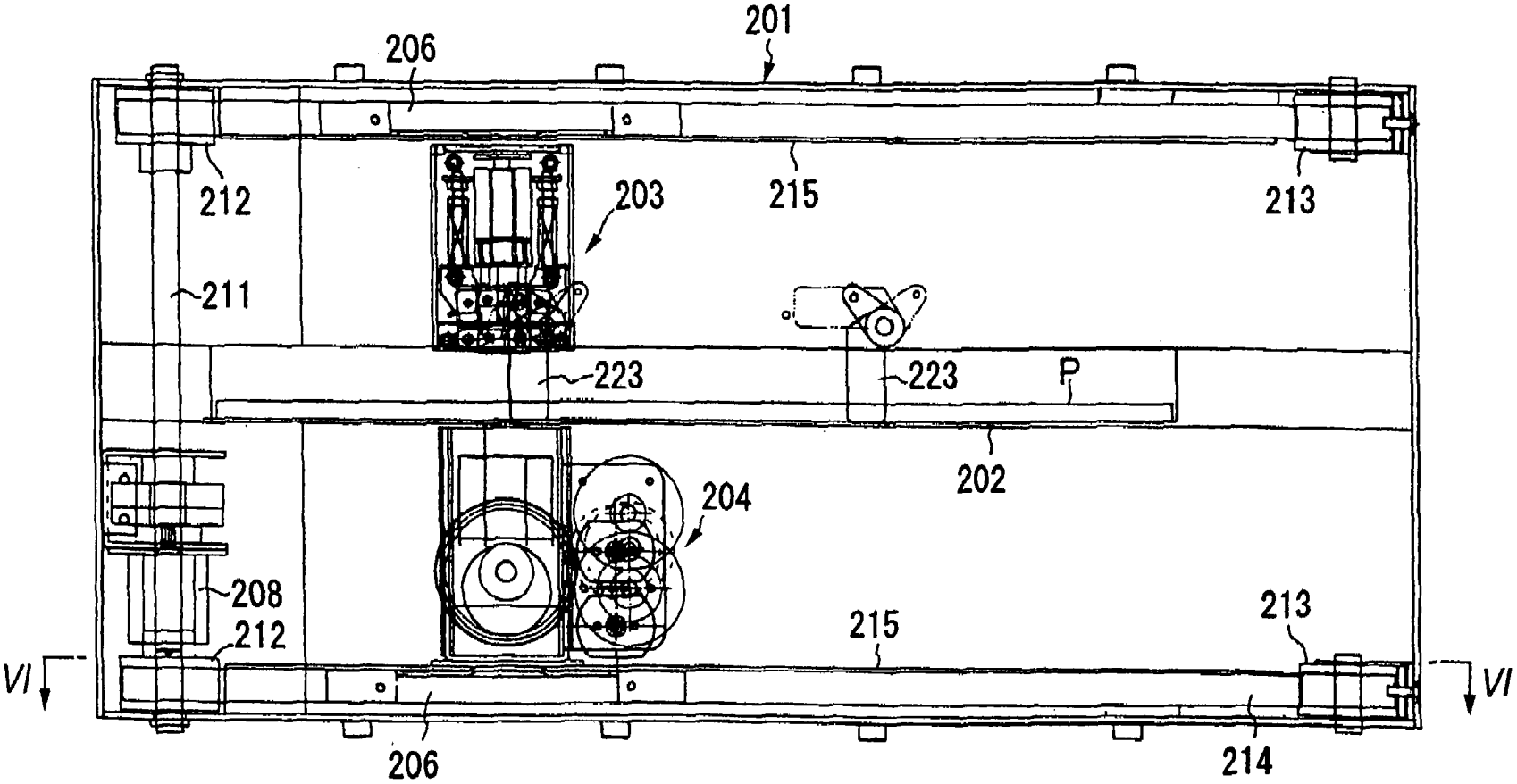
FIG. 4 is a front view of an electric stapler showing an embodiment of the invention.
Figure 5:
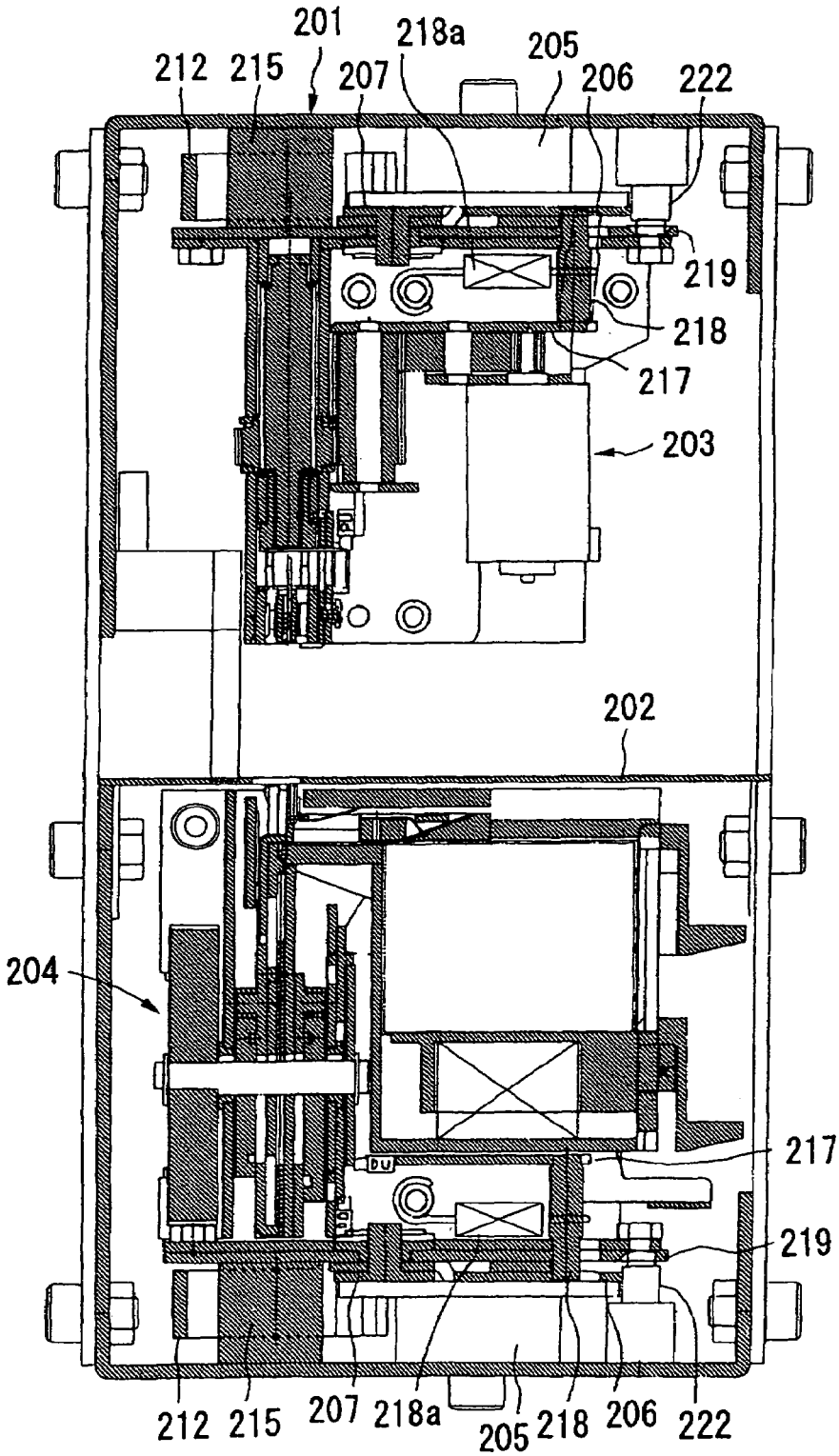
FIG. 5 is a side view of the electric stapler.
Figure 6:
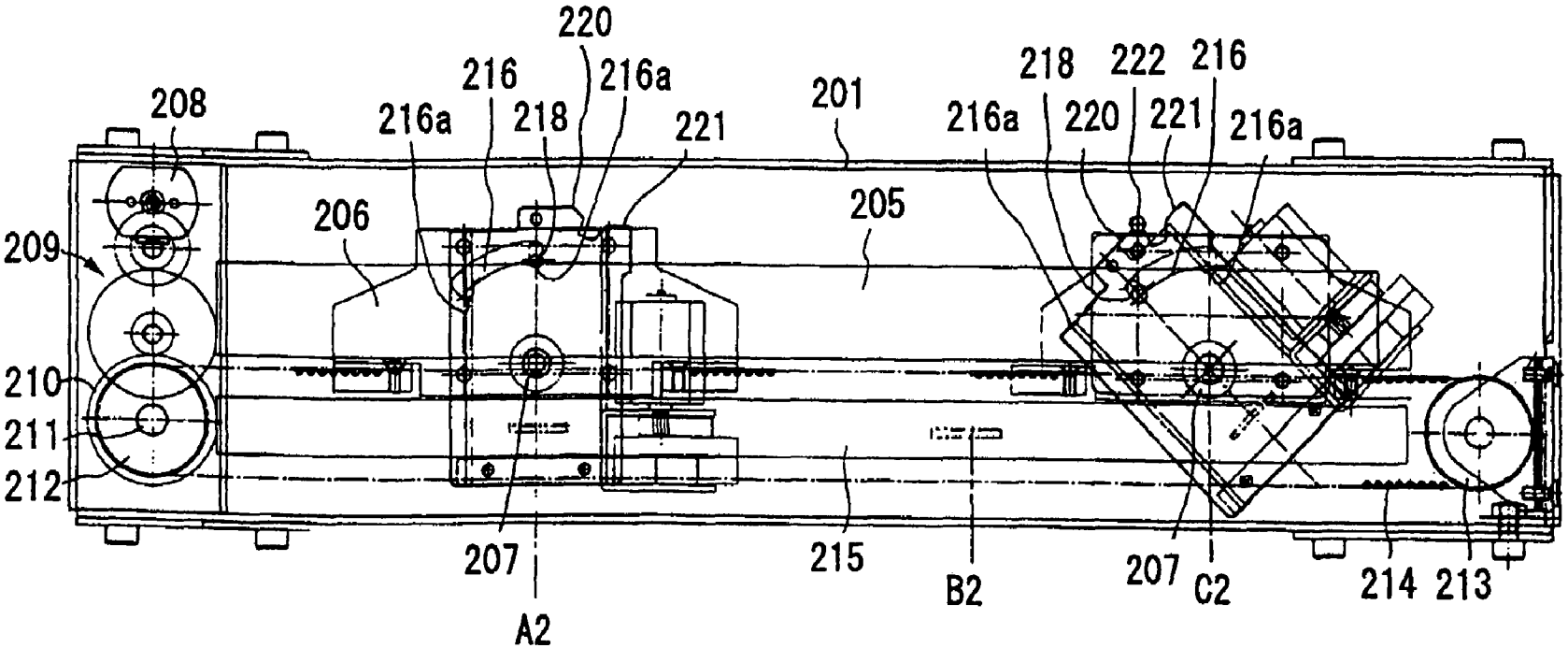
FIG. 6 is a view taken along a line VI—VI of FIG. 4.

Next, a detailed description will be given of a second embodiment of the invention in reference to the drawings. FIG. 4 is a front view of an electric stapler, FIG. 5 is a side view and FIG. 6 is a sectional view taken along a line VI—VI of FIG. 4 and FIG. 6 illustrates states of moving a clincher unit and a driver unit to an initial position (left) and a skewed binding position (right) in the same drawing. In the drawings, numeral 201 designates the frame 201, numeral 202 designates the sheet table made to span a middle portion in an up and down direction of the frame 201, the clincher unit 203 is arranged on the upper side of the sheet table 202, the clincher unit 203 and the driver unit 204 are respectively engaged with linear guides 205 provided at a ceiling face and an inner bottom face of the frame 210 and are traveled to reciprocate between the initial position on the left side and the skewed binding position on the right side.

Traveling mechanisms and rotating mechanisms of the clincher unit 203 and the driver unit 204 are constructed by the same constitution, the clincher unit 203 and the driver unit 204 are attached to the shafts 207 provided at central portions of the slide bases 206 engaged with the linear guides 205 and the clincher unit 203 and the driver unit 204 can be rotated in the horizontal direction.

As shown by FIG. 4 and FIG. 5, a motor 208 for moving the stapler is arranged at a left end portion of the frame 201 and the gear pulleys 212 are attached to two upper and left end portions of a vertical drive shaft 211 attached with a gear 210 at a final stage of a reduction gear train 209. Both ends of the timing belt 213 hung around the gear pulley 212 on an upper side and the driven gear pulley 213 arranged at an upper portion of a right end of the frame 201 stay to be attached to the side base 202 supporting the clincher unit 203 and both ends of the timing belt 214 hung around the gear pulley 212 of a lower portion of the drive shaft 211 and the driven gear pulley 213 arranged at a lower portion of a right end of the frame 201 stay to be attached to the slide base 206 supporting the driver unit 204 to thereby constitute a stapler moving mechanism for traveling the clincher unit 203 and the driver unit 204 in synchronism with each other.

As shown by FIG. 5 and FIG. 6, slide ways 215 in parallel with the linear guides 205 are arranged on respective front sides of two upper and lower pieces of the linear guides 205. Two pieces of the slide ways 215 fixed to the ceiling face and the inner bottom face of the frame 201 are smooth sliding guide members which are brought into contact with a back face (upper side in FIG. 5) at a portion of the driver unit 204 including a driver and a back face (lower side in FIG. 5) of a portion of the driver unit 204 including a driver to receive a reaction force when the driver is moved up to inject a staple and a reaction force when the clincher is moved down to hold to bent a staple in an entire region of a range of moving the stapler.

Next, an explanation will be given of a staple rotating mechanism. As shown by FIG. 6, the slide base 206 is provided with a guide groove 216 in a 45 degree circular arc shape constituting a radius center by the shaft 207 and both end portions of the guide grooves 216 are formed with catch portions 216*a* recessed in a direction of a radius center. As shown by FIG. 5, head portions of swing pins 218 attached to brackets 217 at inside of frames of the clincher unit 203 and the driver unit 204 are engaged with guide grooves 216 of the slide bases 206. The slide pins 218 are inclinable by constituting fulcra by attaching points thereof, maintained in an erected state by springs 218*a* to operate as a click stop mechanism for fixing the clincher unit 203 and the driver unit 204 at 0 degree positions or 45 degree rotated positions. That is, when the clincher unit 203 and the driver unit 204 are at a rotational angles other than the 0 degree positions or the 45 degree rotated positions, the swing pins 28 are inclined to be brought into elastic contact with side faces of the guide grooves 216 and when the clincher unit 203 and the driver unit 204 are pivoted to the 0 degree positions or the 45 degree rotated positions, the swing pins 218 are engaged with the catch portions 216*a* at either of the both ends of the guide grooves 216 by the recovery force of the springs 218*a* to return to the erected attitude and the clincher unit 203 and the driver unit 204 are fixed.

Front end portions (upper side of FIG. 6) of base plates 219 (plates in contact with the slide bases) are formed with 0 degree claw portions 220 projected to the front side and 45 degree claw portions 221 projected to the front side in the right 45 degree direction and distances of the 0 degree claw portion 120 and the 45 degree claw portion 221 from the shaft 207 are made to be substantially equal to each other. As shown by FIG. 5 and FIG. 6, the ceiling face and the inner bottom face of the frame 201 are fixed with stopper pins 222 for rotating the clincher unit 203 and the driver unit 204. The stopper pins 222 are disposed at vicinities of right ends of ranges of traveling the clincher unit 203 and the driver unit 204 and provided at positions at which the stopper pins 222 are brought into contact with side faces of the above-described 0 degree claw portions 220 when the clincher unit 203 and the driver unit 204 are traveled to the right side.

The electric stapler is controlled by a control portion of a copier and carries out back binding of binding two locations of a side of paper or skewed binding of striking a staple to a corner portion of paper by an angle of 45 degrees. When 1 copy set of paper P is fed from a copying mechanism portion to the sheet table 202, in the case of a back binding mode, a staple is stuck at an A2 position shown in FIG. 6, the clincher unit 203 and the driver unit 204 are moved to a B2 position by a stapler moving mechanism to strike a staple. Further, numeral 223 shown in FIG. 4 designates a stopper for aligning paper and the stopper is escaped from a path of paper by being rotated to an upper side by 90 degrees after the binding processing and paper P is discharged.

When skewed binding is set, the clincher unit 203 and the driver unit 204 are moved from the A2 position to a C2 position at a right end. At this occasion, immediately before reaching the C2 position, the 0 degree claw portions 220 of the base plates impinge on the stopper pins 222 of the frame 201, the clincher unit 203 and the driver unit 204 are rotated to the left by being pressed by the stopper pins 222 by moving the slide bases further to the right and when the clincher unit 203 and the driver unit 204 are rotated by 45 degrees, the swing pins 218 of the clincher unit 203 and the driver unit 204 are engaged with the left end catch portions 216*a* of the guide grooves 216 of the slide bases 206 to be fixed to the 45 degree rotated positions. After striking the staple to paper, when the clincher unit 203 and the driver unit 204 start traveling to the left by driving to rotate the stapler moving mechanism reversely, the 45 degree claw portions 221 disposed at the 0 degree rotated positions impinge on the stopper pins 222 to rotate to the right and when the 45 degree claw portions 221 respectively return to the 0 degree rotated positions, the swing pins 218 are engaged with the right end catch portions 216*a* of the guide grooves 216 of the slide bases 206 to fix to the 0 degree rotated positions and at the same time, the 45 degree claw portions 221 are detached from the stopper pins 222, and the clincher unit 203 and the driver unit 204 are made to travel further to the left to return to the A2 position.

Figure 7:
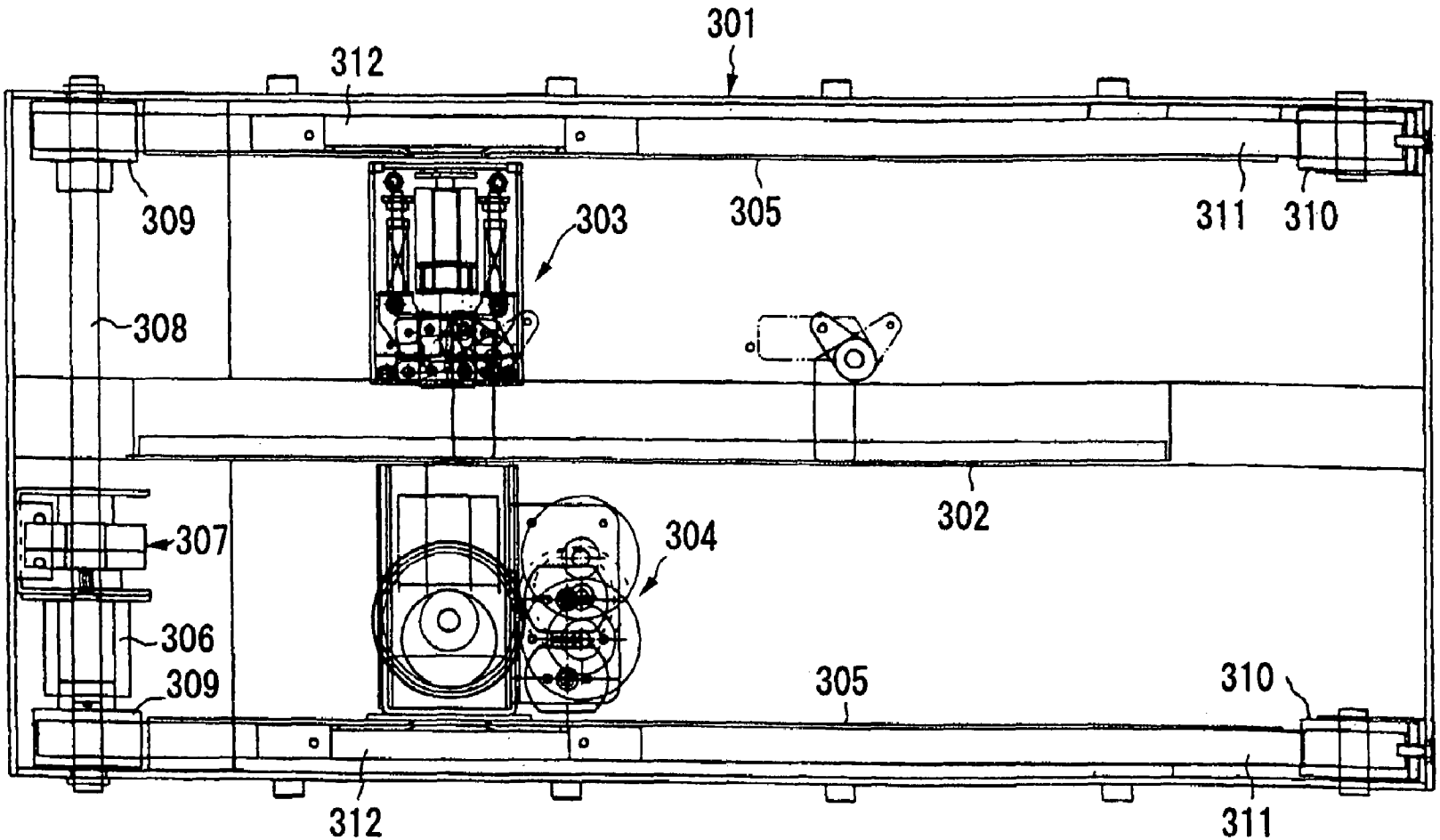
FIG. 7 is a front view of an electric stapler showing an embodiment of the invention.
Figure 8:
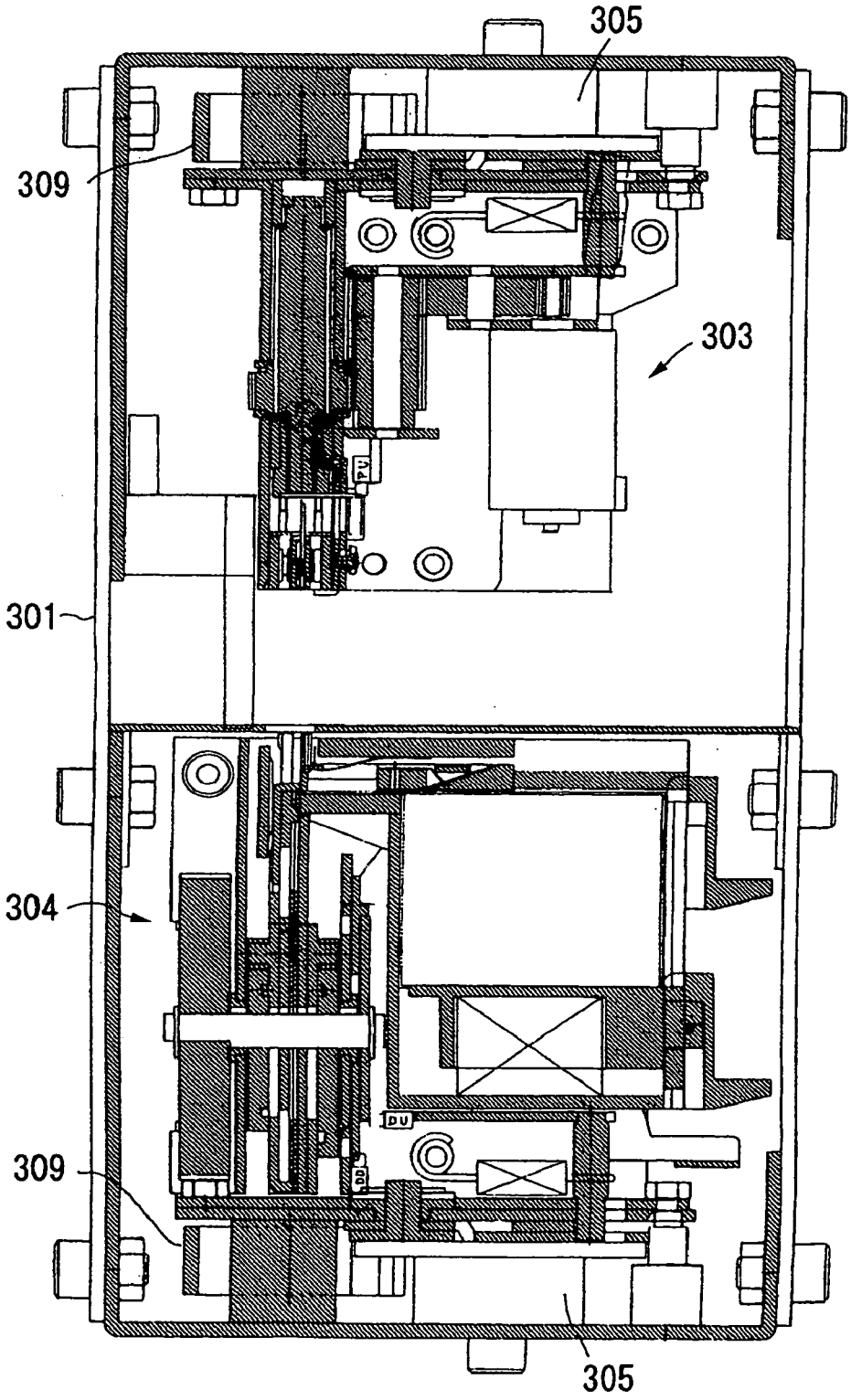
FIG. 8 is a side sectional view of the electric stapler.
Figure 9:
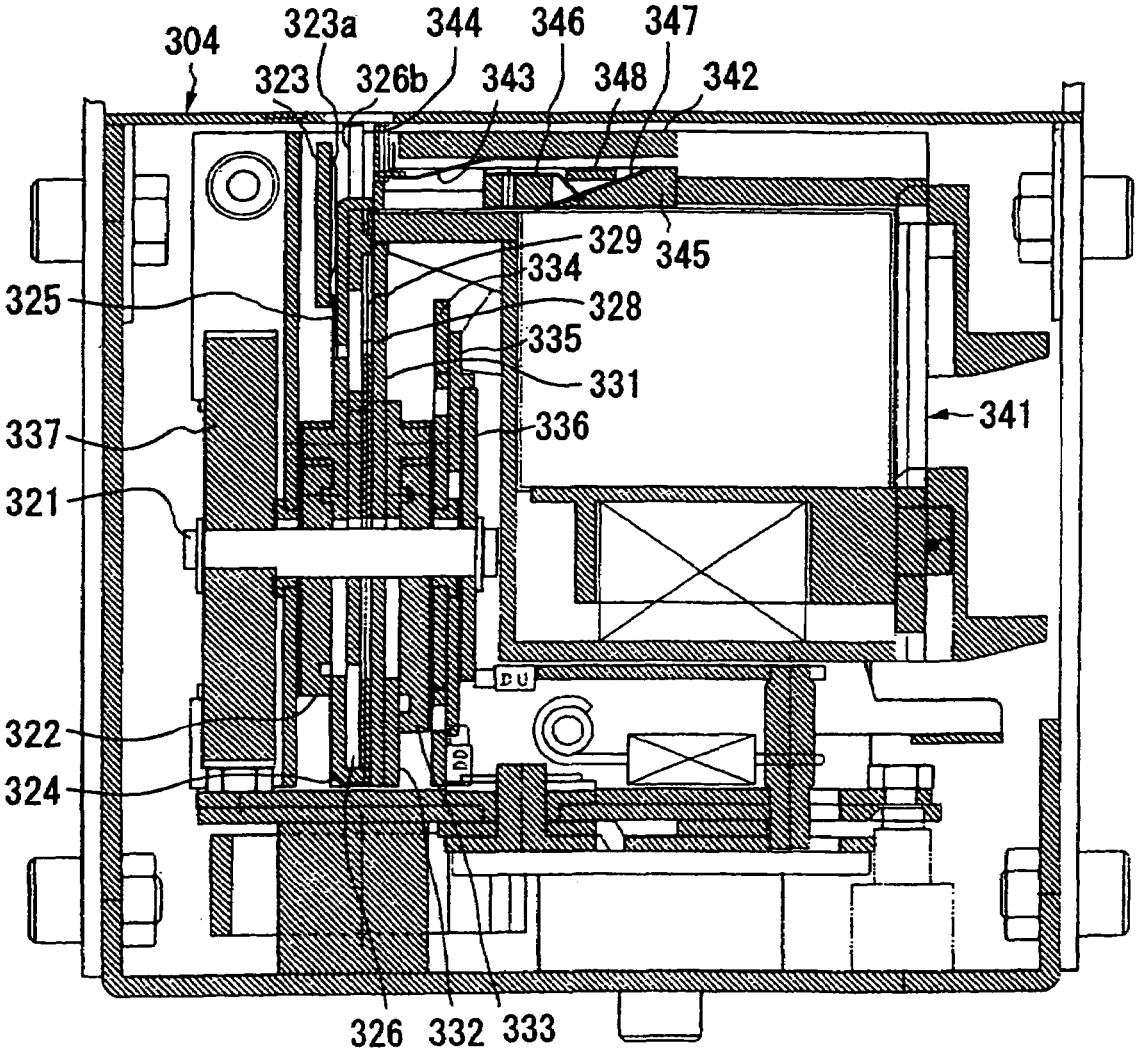
FIG. 9 is a side sectional view enlarging a lower half portion of FIG. 8.
Figure 10:
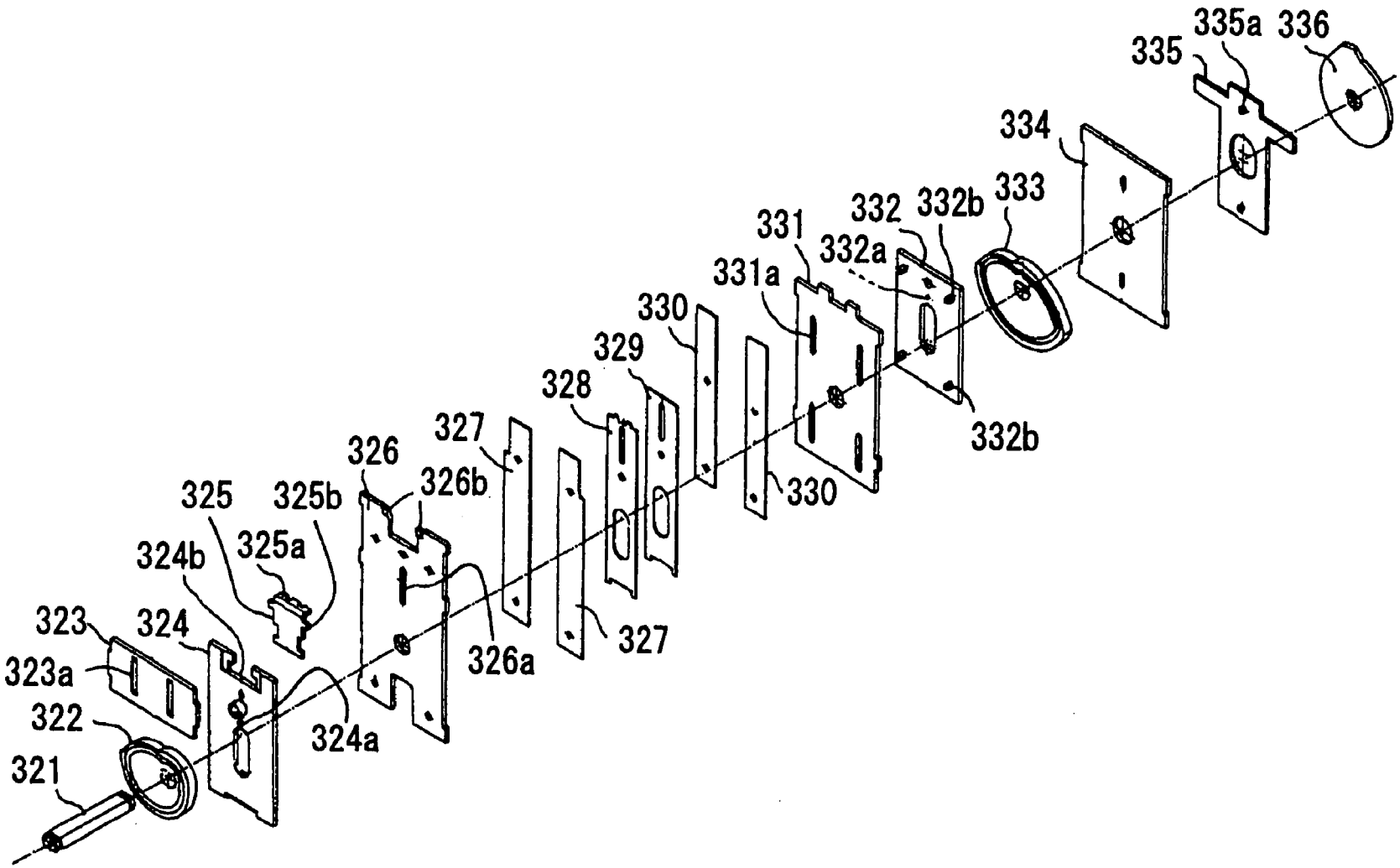
FIG. 10 is a constitution view of parts of a driver mechanism.

Next, a detailed description will be given of a third embodiment of the invention in reference to the drawings. FIG. 7 is a front view of an electric stapler, FIG. 8 is a side sectional view and FIG. 9 is a view enlarging a lower half portion of FIG. 8. FIG. 10 is a constitution view of parts of a driver mechanism. In FIG. 7, numeral 301 designates a frame, numeral 302 designates a sheet table made to span a middle portion in an up and down direction of the frame 301, a clincher unit 303 is arranged on an upper side of the sheet table 202, the driver unit 304 is arranged on a lower side of the sheet table 302, and the clincher unit 303 and the driver unit 304 are respectively engaged with linear guides 305 provided at a ceiling face and an inner bottom face of the frame 301.

The motor 306 for moving the stapler is arranged at a left end portion of the frame 301 to drive a vertical drive shaft 308 via a reduction gear 307. Gear pulleys 309 are attached to two upper and lower end portions of the vertical drive shaft 308, both ends of a timing belt 311 hung around the gear pulley 309 on the upper side and a driven gear pulley 310 arranged at an upper portion of a right end of the frame 301 stay to be attached to a slide base 312 supporting the clincher unit 303. Similarly, both ends of a timing belt 311 hung around the gear pulley 309 on the lower side and a driven gear pulley 310 arranged at a lower portion of the right end of the frame 301 stay to be attached to a slide base 312 to constitute a stapler moving mechanism for traveling the clincher unit 303 and the driver unit 304 in synchronism with each other.

Next, an explanation will be given of a constitution of a driver mechanism of the driver unit 304 in reference to FIG. 9 and FIG. 10. The driver unit 304 supports movable members by three sheets of plates of the front base plate 326, the center base plate 331, and the rear base plate 334 shown in FIG. 10. The driver cam 322 and the driver cam follower 324 in a plate-like shape are arranged at a front face of the front base plate 326. The pair of left and right forming plates 330, the driver 329 arranged between two sheets of the forming plates 330, the driver assisting plate 328 overlapped to the driver 329 for preventing a staple from being detached to a front side, and the pair of the driver guide plates 327 are interposed between the front base plate 326 and the center base plate 331. An interval between the center base plate 331 and the rear base plate 334 is interposed with the forming cam follower 332 coupled to the forming plate 330 by a pin via a guide groove 331*a* formed at the center base plate 331 and the forming cam 333. The staple feed cam follower 335 and the staple feed cam 336 for driving a feed claw of a staple cartridge are arranged at a rear face of the rear base plate 334. The driver cam 322 and the forming cam 333 and the staple feed cam 336 are attached to a single piece of the cam shaft 321 for driving a gear 337 attached to a front end of the cam shaft 321 via a motor and a reduction gear as shown by FIG. 9.

The driver cam 322 and the forming cam 333 shown in FIG. 10 are heart cams, and a pin 34*c* provided at the driver cam follower 324 is engaged with a cam face of the driver cam 322. The driver 329 and the driver assisting plate 328 are coupled by a pin with a pin 324*a* at a rear face of the driver cam follower 324 via a guide groove 326*a* in an up and down direction formed at the front base plate 326 and the driver cam follower 324 and the driver 329 and the driver assisting plate 328 are moved up and down in accordance with rotation with the driver cam 322. A center of an upper end portion of the driver cam follower 324 is formed with a groove 324*a* in an inverse-T-like shape and a lower portion of the anvil 325 is engaged with the groove 324*b* and the anvil 325 is supported thereby pivotably in a front and rear direction by constituting a fulcrum by a lower portion thereof. An upper end portion of the anvil 325 is folded to bend to a rear side and when a linear staple is formed in a gate-like shape, a middle portion of the linear staple is supported by a lower face of a fold-to-bend portion 325*a* thereof.

A front face side of the driver cam follower 324 is arranged with the front guide face 323 made to span a frame of the driver unit 304 and the anvil 325 is restricted from being inclined forwardly by the front guide plate 323. Further, projections 326*b* are provided at an upper end of a front face of the front base plate 326, claw portions 325*b* in correspondence with the projections 326*b* are provided at two left and right side faces of the anvil 325 and when the driver cam follower 324 and the anvil 325 are moved up to upper limit positions, the claw portions 325*b* and the anvil 325 ride over the projections 326*b* of the front base plate 326 to thereby incline the anvil 325 forwardly to thereby escape the fold-to-bend portions 325*a* from a path of the driver 329.

A pin 332*a* provided at a rear face of the forming cam follower 332 is engaged with a cam groove of the forming cam 333, the forming cam follower 332 and the forming plate 330 are coupled by a pin 332*b* of the forming cam follower 332 via the guide groove 331*a* in an up and down direction of the center base plate 331 and the forming cam follower 332 and the forming plate 330 are moved up and down in accordance with rotation of the forming cam 333.

A pin 335*a* provided at a rear face of the staple feed cam follower 335 is brought into contact with an outer peripheral face of the staple feed cam 336 at the rearmost portion and the staple feed cam follower 335 is moved up and down in accordance with rotation of the staple feed cam 336.

In one cycle of stapling operation, the driver cam 322 and the forming cam 333 and the staple feed cam 336 are set with operational timings such that first, the staple feed cam follower 335 is moved down to feed a staple, next, the forming plate 330 is driven to move up to form the linear staple and the successively, the anvil 325, the driver 329 and the driver assisting plate 328 are integrally moved up.

Next, an explanation will be given of a staple cartridge 341 in reference to FIG. 9. The staple cartridge 341 mounted to the driver unit 304 is attached to a lower face of a ceiling plate portion 342 by directing a leaf spring 343 in a skewed front lower direction and a guide plate 344 constituting a guide of a rear face side (right side in the drawing) of the driver 329 is attached to a front end of the leaf spring 343. The guide plate 344 is opposed to the front guide plate 323 provided at the driver unit 304 and a clearance between the guide plate 344 and the front guide plate 323 constitutes a path of the anvil 325, the driver 329 and the forming plate 330.

A slider 345 slidable in a front and rear direction is provided below the ceiling portion 342, the leaf spring 346 is attached to a front portion of the slider 345 in a skewed rear lower direction and a front end portion of the leaf spring 346 is attached with a feed claw 347. A front portion of the leaf spring 343 attached with the guide plate 344 is moved down from an upper face of the slider 346 in an initial state and when the slider 345 and the feed claw 347 are made to advance, the slider 345 impinges on the lower face of the leaf spring 343 to push up the leaf spring 343 and the guide plate 344 to an upper side.

Figure 11:
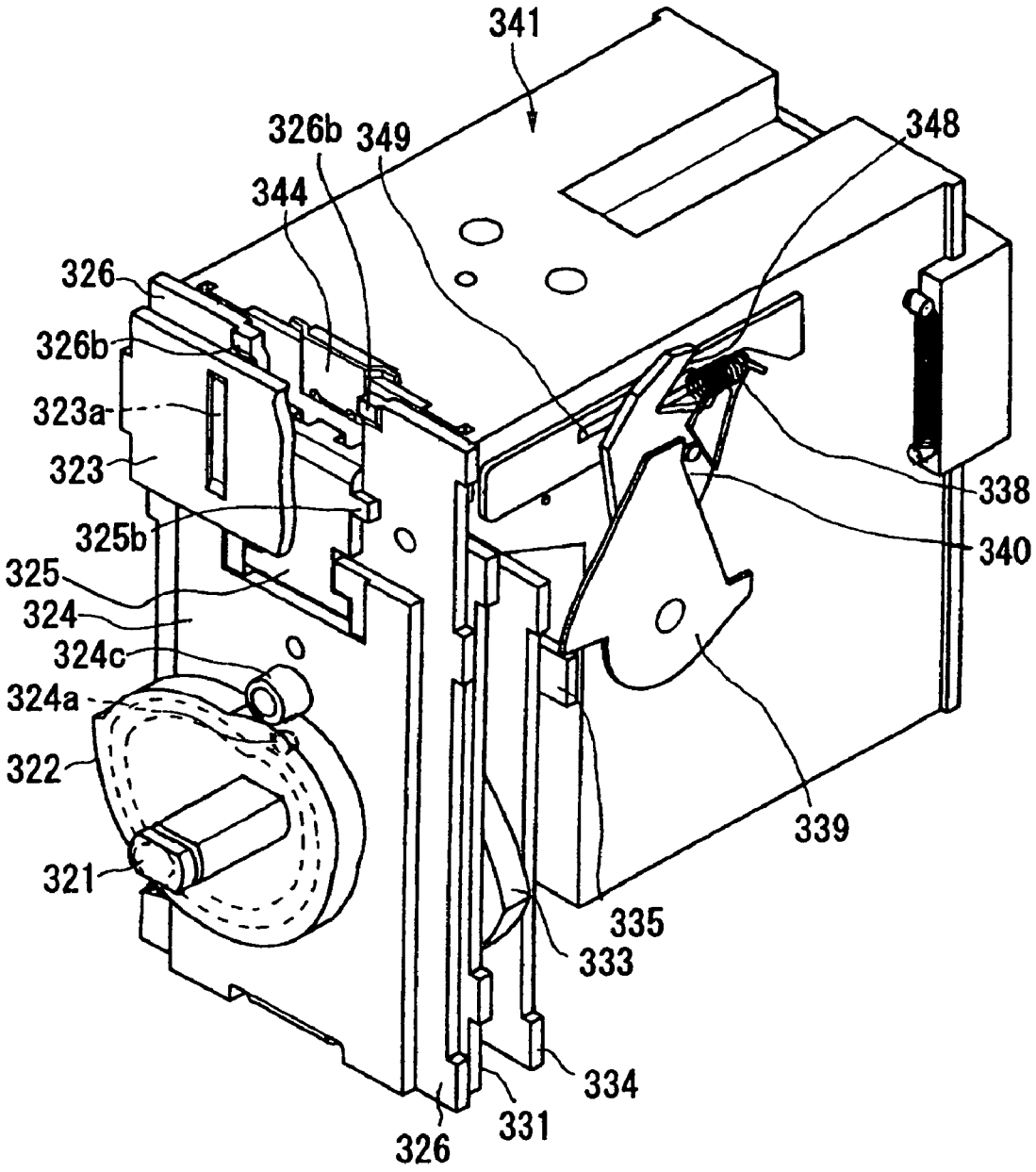
FIG. 11 is a perspective view of an initial state of the driver mechanism.
Figure 12:
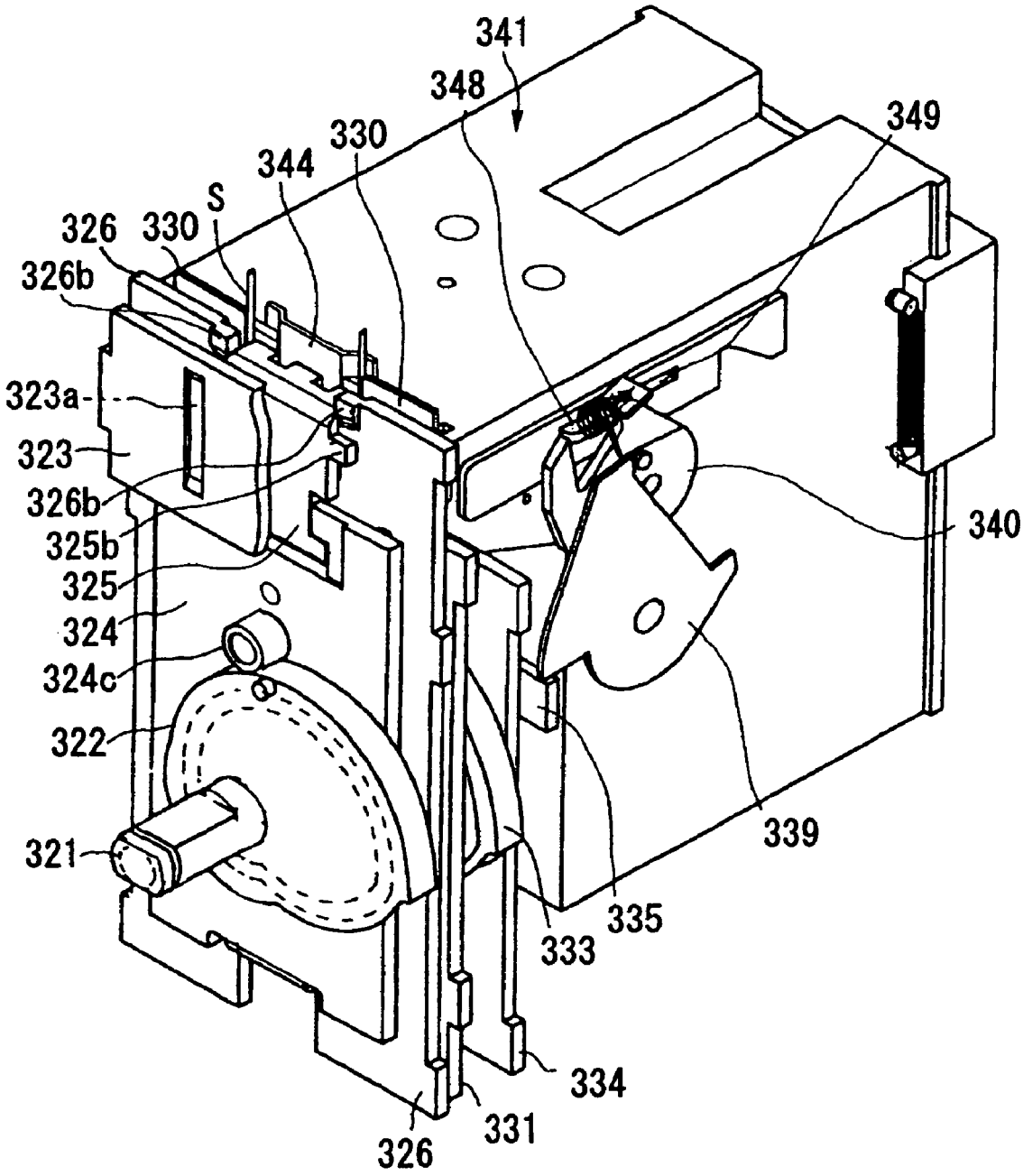
FIG. 12 is a perspective view showing a forming step of the driver mechanism.

An upper face of the slider 345 is attached with an arm 348 and as shown by FIG. 11, two left and right ends of the arm 348 are projected to outer sides by passing grooves 349 formed at two left and right side walls of the staple cartridge 341. When the driver unit 305 is started, as shown by FIG. 12, first, the staple feed cam follower 335 is moved down, staple feed link levers 339, 340 urged by a tension coil spring 338 are rotated in the counterclockwise direction in the drawing, the arm 348 and the slider 345 of the staple cartridge 341 are moved forward, a staple sheet is fed to the front side by the feed claw 347, the slider 345 pushes up the guide plate 344 to the upper side and the guide plate 344 is made to advance into a hole of the sheet table (not illustrated). Simultaneously therewith, the clincher unit 303 shown in FIG. 7 is moved down to pinch paper on the sheet table along with the driver unit 304. Successively, the forming plates 330 are moved up to form the linear staple in the gate-like shape. At this occasion, the claw portion 325*b* of the anvil 325 is brought into contact with a rib 323*a* at a rear face of the front guide plate 323 shown in FIG. 12 to maintain in a vertical attitude and a middle portion of the staple is supported by the fold-to-bend portion 325*a*. Further, after finishing to form the linear staple, the driver 239, the driver assisting plate 328 and the anvil 325 are moved up.

Figure 13:
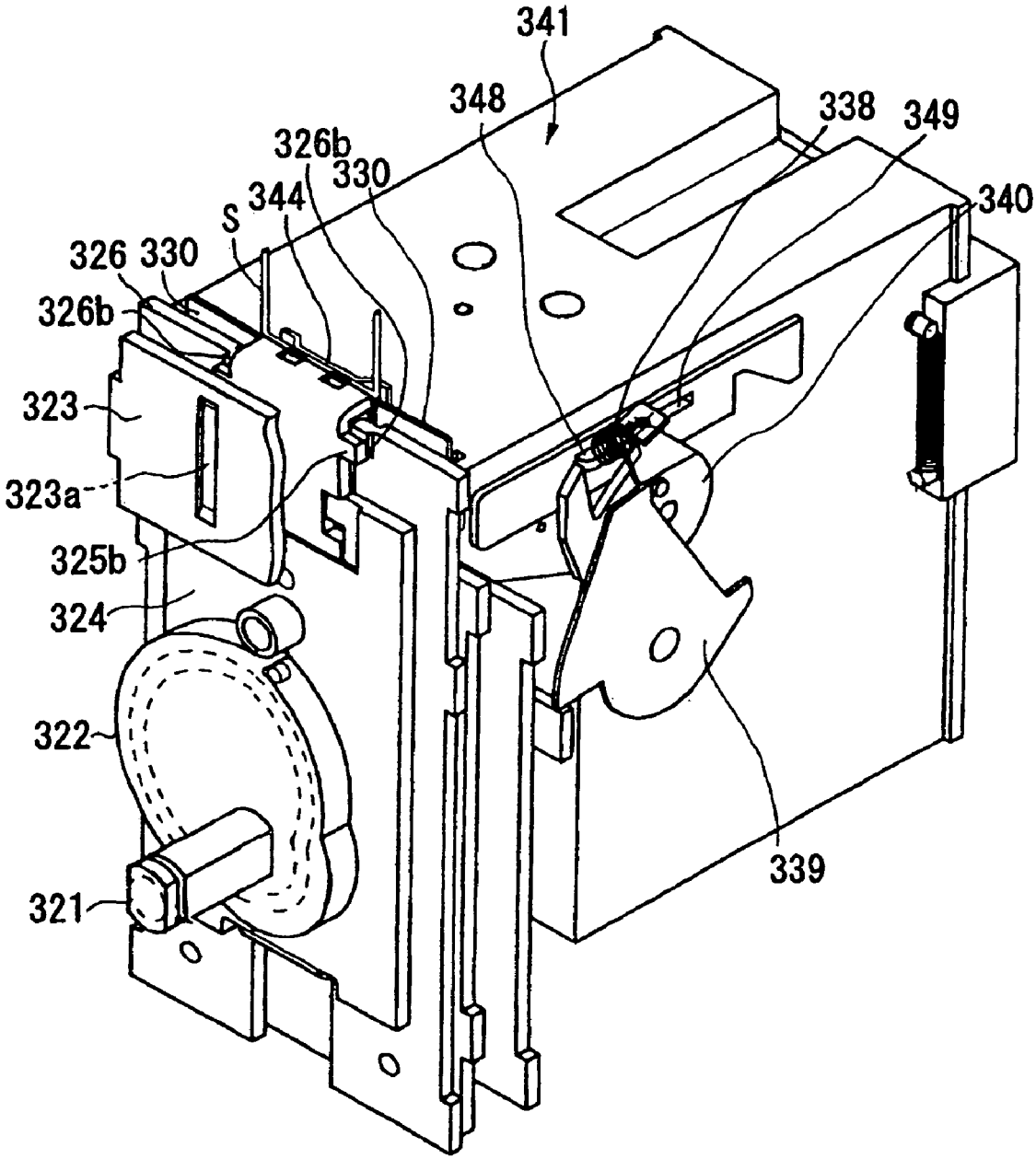
FIG. 13 is a perspective view showing an injecting step of the driver mechanism.

As shown by FIG. 13, immediately before finishing to strike the staple by the driver 329, the claw portion 325*b* of the anvil 325 is moved upward from the rib 323*a* at the rear face of the front guide plate 323 to release from being restricted to incline forward, the claw portion 325*b* rides over the projection 326*b* of the front face plate 326, the anvil 325 is inclined forwardly, the fold-to-bend portion 325*a* is escaped from the path of the driver 329, and the driver 329 completely strikes the staple. Further, the clincher of the clincher unit 303 is moved down and folds to bend left and right leg portions of the staple to inner sides to bind paper and therefore, all of the movable portions return to initial positions shown in FIG. 11 to finish operation of one cycle.

Next, a detailed description will be given of a fourth embodiment of the invention in reference to the drawings.

Figure 14:
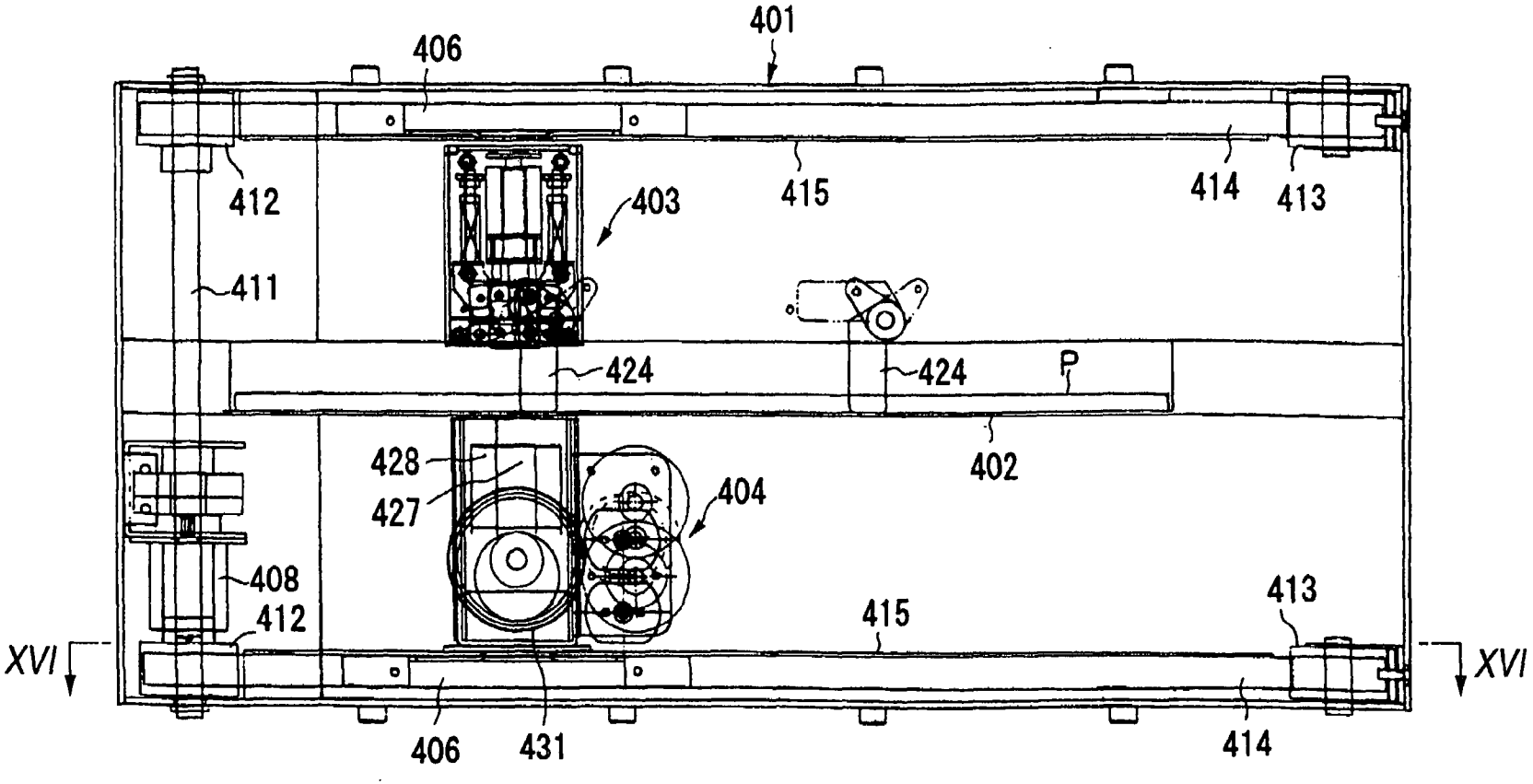
FIG. 14 is a front view of an electric stapler showing an embodiment of the invention.
Figure 15:
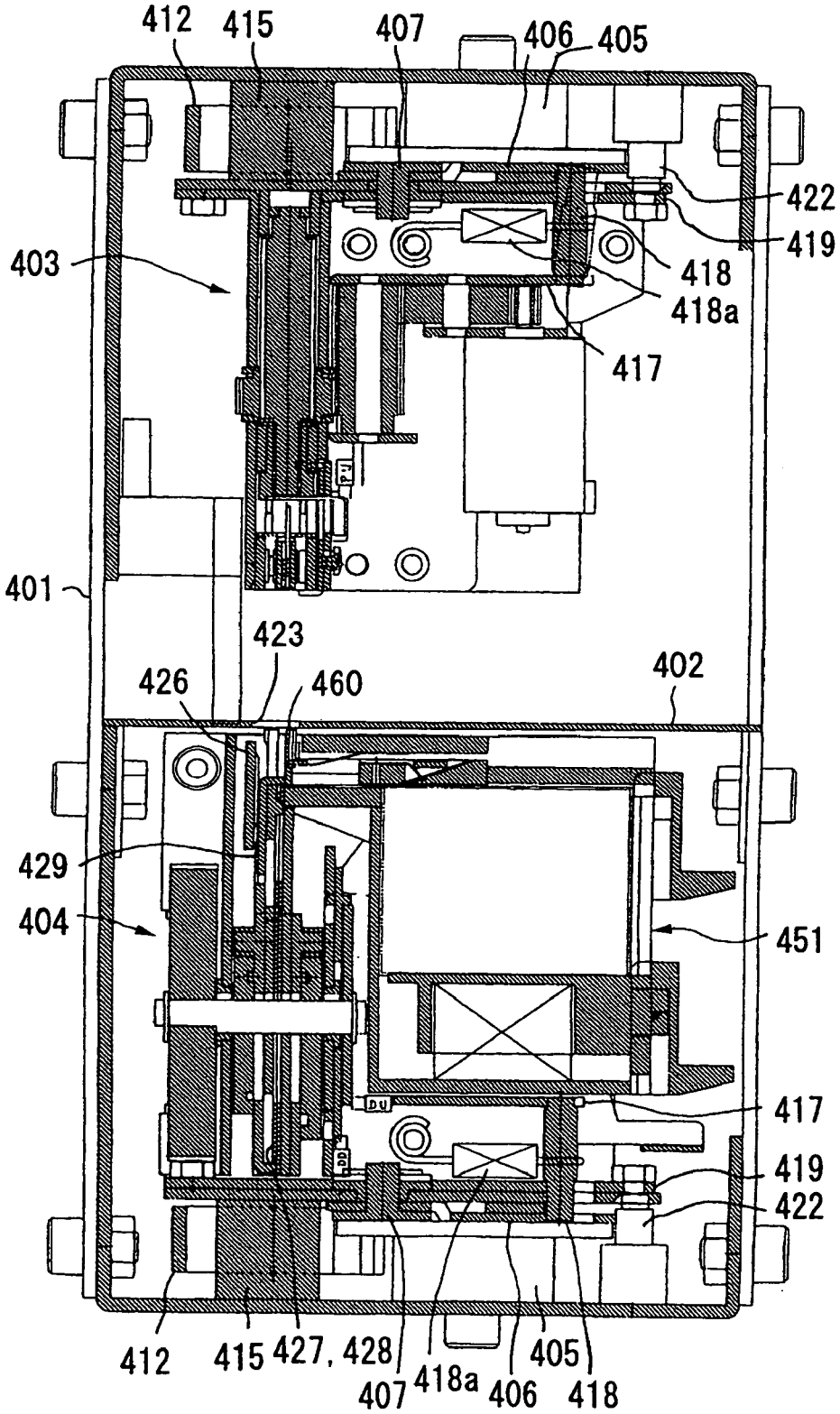
FIG. 15 is a side view of the electric stapler.
Figure 16:
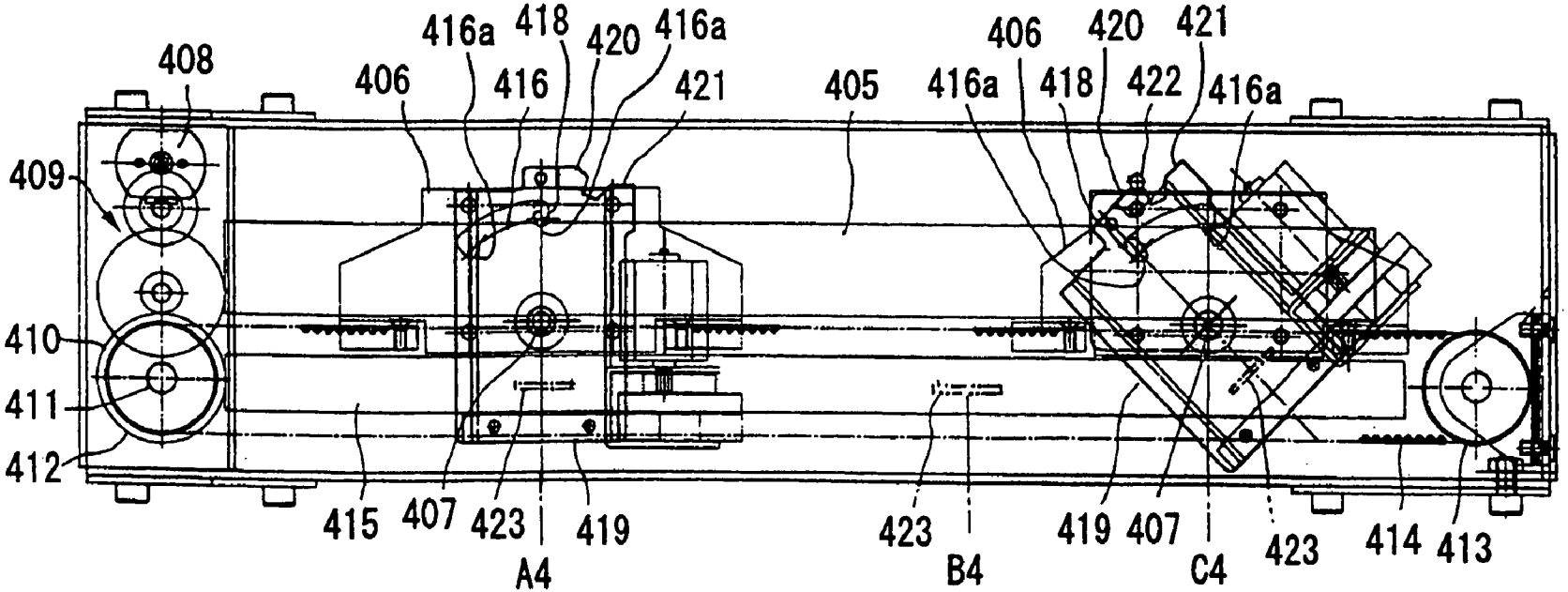
FIG. 16 is a view taken along a line XVI—XVI of FIG. 14.

FIG. 14 is a front view of an electric stapler, FIG. 15 is is a side view and FIG. 16 is a sectional view taken along a line XVI—XVI of FIG. 14 and FIG. 16 illustrates states of moving a clincher unit and the driver unit to an initial position (left) in the skewed binding position (right). In the drawings, numeral 401 designates the frame, numeral 402 designates the sheet table made to span a middle portion in an up and down direction of the frame 401, the clincher unit 403 is arranged on an upper side of the sheet table 402, the driver unit 404 is arranged on a lower side of the sheet table 402 and the clincher unit 403 and the driver unit 404 are respectively engaged with linear guides 405 provided at a ceiling face and an inner bottom face of the frame 401 and moved between an initial position of the left side and the skewed binding position on the right side.

Traveling mechanisms and rotating mechanisms of the clincher unit 403 and the driver unit 404 are constructed by the same constitution, the clincher unit 403 and the driver unit 404 are attached to shafts 407 provided at central portions of slide faces 406 engaged with the linear guides 405 and the clincher unit 403 and the driver unit 404 can be rotated in a horizontal direction.

As shown by FIG. 14 and FIG. 15, a motor 408 for moving the staple is arranged at a left end portion of the frame 401 and gear pulleys 412 are attached to two upper and lower end portions of a vertical drive shaft 411 attached with a gear 410 at a final stage of a reduction gear train 409. Both ends of a timing belt 414 hung around a gear pulley 412 on the upper and a driven gear pulley 413 arranged at an upper portion of a right end of the frame 401 stay to be attached to the slide base 406 supporting the clincher unit 403, both ends of a timing belt 414 hung around the gear pulley 412 on the lower side of the drive shaft 411 and a drive gear pulley 413 arranged at a lower portion of the right end of the frame 401 stay to be attached to the slide base 406 supporting the driver unit 404 to thereby constitute a stapler moving mechanism for traveling the clincher unit 403 and the driver unit 404 in synchronism with each other.

As shown by FIG. 15 and FIG. 16, slide ways 415 in parallel with the linear guides 405 are arranged at respective front sides of two upper and lower pieces of linear guides 405. The two pieces of slide ways 415 fixed to the ceiling face and the inner bottom face of the frame 401 are smooth sliding guide members, brought into contact with a rear face (upper side in FIG. 15) of a portion of the clincher unit 403 including a clincher and a rear face (lower side in FIG. 15) of a portion of the driver unit 404 including a driver and receive a reaction force in injecting a staple by moving up the driver and a reaction force in folding to bend the staple by moving down the clincher in an entire region of a range of moving the stapler.

Next, an explanation will be given of a stapler rotating mechanism. As shown by FIG. 16, the slide base 406 is provided with a guide groove 416 in a 45 degree circular arc shape constituting a radius center by a shaft 407 and catch portions 416*a* recessed in a direction of the radius center are formed at both end portions of the guide groove 416. As shown by FIG. 15, head portions of swing pins 418 attached to the brackets 417 at inside of frames of the clincher unit 403 and the driver unit 404 are engaged with the guide grooves 416 of the slide bases 406. The swing pins 418 are slidable by constituting a fulcra by attaching points thereof, maintained in erected attitudes by springs 418*a*, and operated as a click stop mechanism for fixing the clincher unit 403 and the driver unit 404 at 0 degree positions or 45 degree rotated positions. That is, when the clincher unit 403 and the driver unit 404 are at rotational angles other than the 0 degree positions or the 45 degree rotated positions, the swing pins 418 are inclined to be brought into elastic contact with inner peripheral faces of the guide grooves 416 and when the clincher unit 403 and the driver unit 404 are pivoted to the 0 degree positions or the 45 degree rotated positions, the swing pins 418 are engaged with the catch portions 416*a* at right ends or left ends of the guide grooves 416 by recovery force of the springs 418*a* to return to an erected attitude to thereby fix the clincher unit 403 and the driver unit 404.

Front edge portions (upper side in FIG. 16) of respective base plates 419 (plates in contact with the slide faces 406) of the clincher unit 403 and the driver unit 404 are formed with 0 degree claw portions 420 projected to the front side and 45 degree claw portions 421 projected to the front side in a right 45 degree direction and distances of the 0 degree claw portions 420 and the 45 degree claw portions 421 from the shafts 407 are made to be substantially equal to each other. As shown by FIG. 15 and FIG. 16, stopper pins 422 for rotating the clincher unit 403 and the driver unit 404 are fixed to the ceiling face and the inner bottom face of the frame 401. The stopper pins 422 are disposed at vicinities of right ends of ranges of traveling the clincher unit 403 and the driver unit 404 and provided at positions at which the stopper pins 422 are brought into contact with side faces of the above-described 0 degree claw portions 420 when the clincher unit 403 and the driver unit 404 are traveled to the right side.

The electric stapler carries out back binding of binding two locations of a side of paper or skewed binding of striking a staple to a corner portion of paper by an angle of 45 degrees by being controlled by a control portion of a copier. When one copy set of paper P is fed from a copying mechanism portion to the sheet table 402, in the case of a back binding mode, a staple is struck at an A4 position at a left end shown in FIG. 16 and the clincher unit 403 and the driver unit 404 are moved to a B4 position on the right side by a stapler moving mechanism to strike a staple. The sheet table 402 is formed with a hole 423 having a dimension capable of passing a forming plate and a driver of the driver unit 404 and a staple guide of a staple cartridge, mentioned later, at three positions of A4, B4 and C4 at a right end. Further, numeral 424 shown in FIG. 14 designates a stopper for aligning paper which is escaped from a path of paper by being rotated to an upper side by 90 degrees after a binding processing and a paper P is discharged.

In the case of setting skewed binding, the clincher unit 403 and the driver unit 404 are moved to the C4 position at the right end. At this occasion, immediately before reaching the C4 positions, the 0 degree claw portions 420 of the base plates impinge on the stopper pins 422 of the frame 401, the clincher unit 403 and the driver unit 404 are rotated to the left by being pressed by the stopper pins 422 by further moving the slide bases 406 further to the right and when the clincher unit 403 and the driver unit 404 are rotated by 45 degrees, the swing pins 418 of the clincher unit 403 and the driver unit 404 are engaged with the left end catch portions 416*a* of the guide grooves 416 of the slide bases 406 to fix to the 45 degree rotated positions.

After striking a staple to paper, when the clincher unit 403 and the driver unit 404 start traveling to the left by driving to rotate the stapler moving mechanism reversely, the 45 degree claw portions 421 disposed at the 0 degree rotated positions impinge on the stopper pins 422 and the clincher unit 403 and the driver unit 404 are rotated to the right and when the 45 degrees claw portions 421 respectively return to the 0 degree rotated positions, the swing pins 418 are engaged with the right end catch portions 416*a* of the guide grooves 416 of the slide bases 406 to fix to the 0 degree rotated positions and at the same time, the 45 degree claw portions 421 are detached from the stopper pins 422 and the clincher unit 403 and the driver unit 404 travel further to the left to return to the A4 position.

Figure 17:
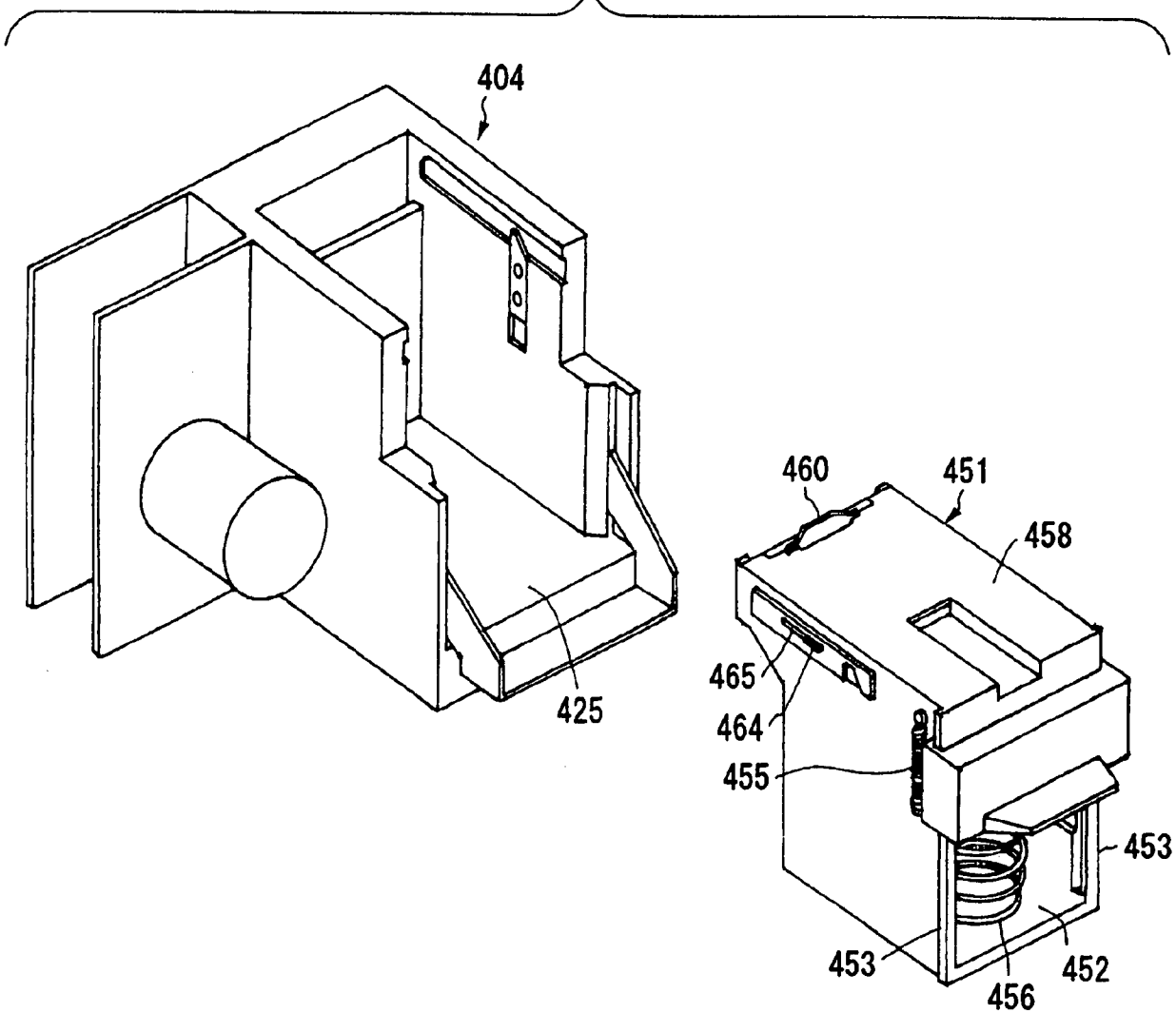
FIG. 17 is a perspective view of a staple cartridge and an electric stapler.
Figure 18:
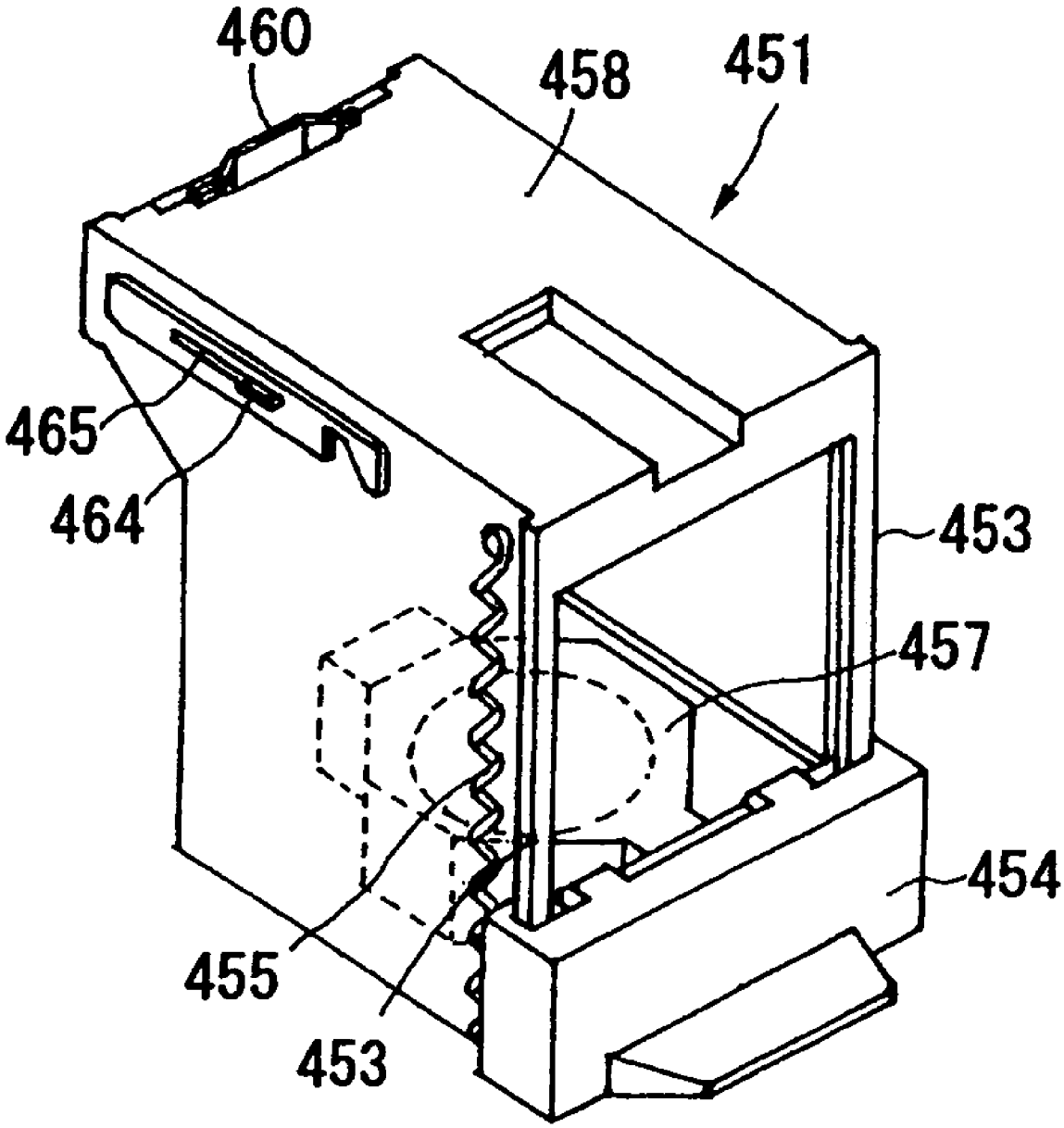
FIG. 18 is a perspective view showing the staple cartridge in a state of opening a slide door.

FIG. 17 shows the driver unit 404 and the staple cartridge 451, the staple cartridge 451 mounted to a cartridge containing is portion 425 of the driver unit 404 is formed with an opening portion 452 at a rear face thereof and a slide door 454 is engaged with the guide rail portions 453 in a vertical direction formed at rear ends of two left and right side faces thereof. The slide door 454 is pulled up to an upper side by a tension coil spring 455 made to hang upper portions of the two left and right side faces of the staple cartridge 451 and the slide door 454. Further, a pressure plate, mentioned later, is included at inside of the staple cartridge and the pressure plate is pushed up to the upper side by a compression coil spring 456 installed at an inner bottom face thereof. The slide door 454 is formed with a groove (not illustrated) at a lower end portion of a center of a front face (face on an inner side of the cartridge), a rear end portion of the pressure plate is projected to a position of the groove and when the slide door 454 is pushed down to a lower side as shown by FIG. 18, the rear end portion of the pressure plate 457 is engaged with the groove and also the pressure plate 357 is moved down simultaneously as shown by the drawing.

Figure 19:
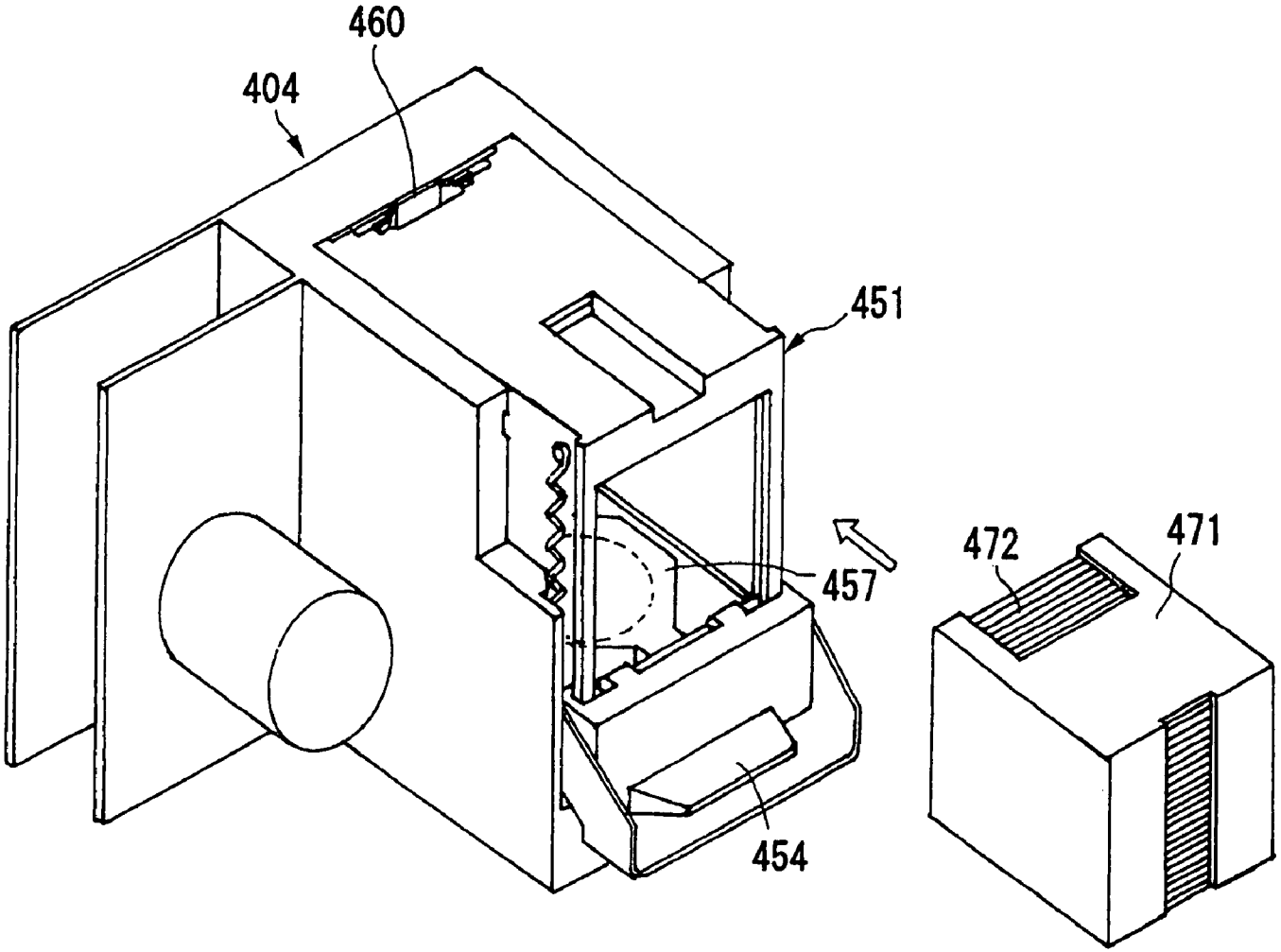
FIG. 19 is a perspective view of a state of mounting the staple cartridge to a driver unit.
Figure 20:
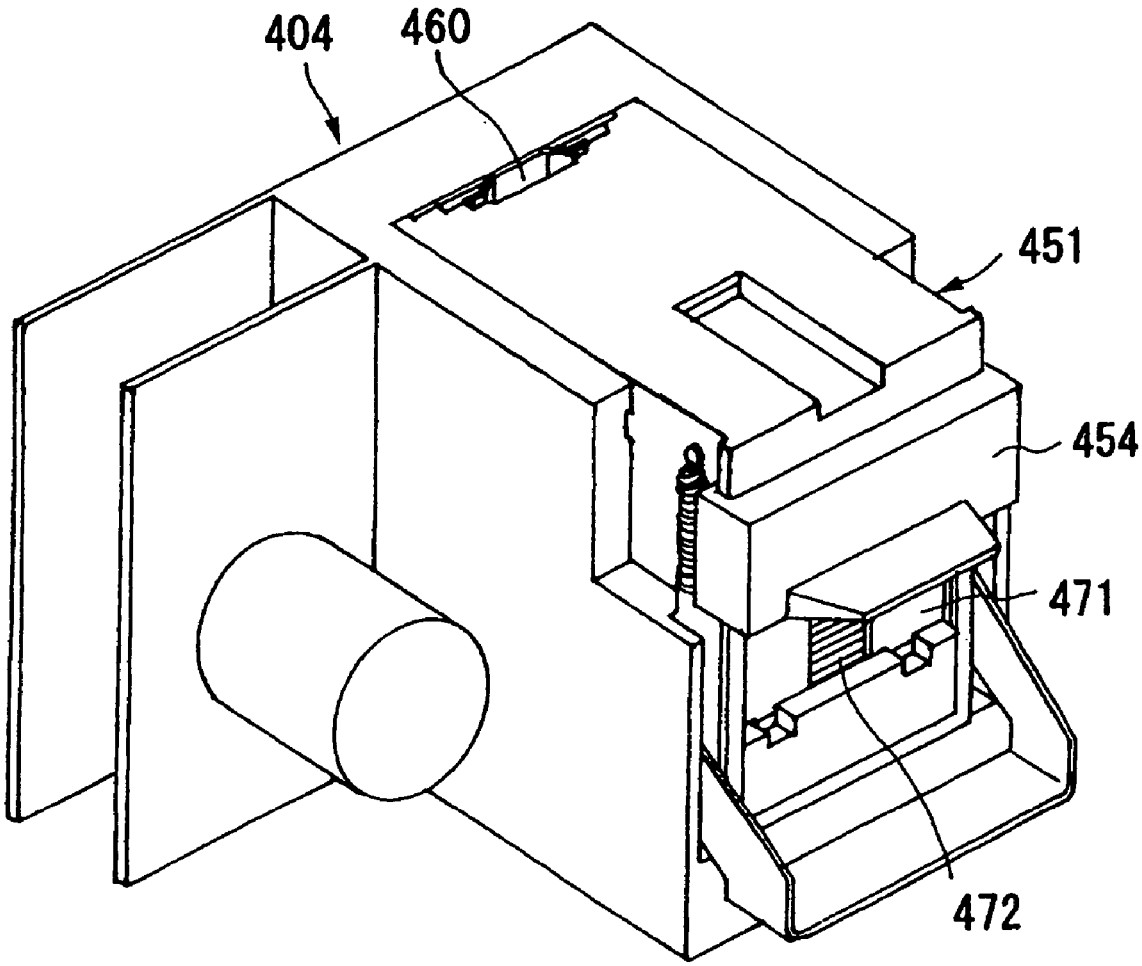
FIG. 20 is a perspective view showing a state of charging a staple to the staple cartridge.

FIG. 19 shows a state of charging a staple pack 471 made of paper for refilling to the staple cartridge 403 and a predetermined number of sheets of staple sheets 472 are laminated to contain in the staple pack 471. The staple pack 471 is formed with windows at a lower face and an upper face of a front portion and a rear face and as shown by FIG. 20, after the staple pack 471 is inserted thereto, when the slide door 454 is released from being pushed down, the above-described pressure plate 457 is brought into the window at the lower face to press the staple sheet 472 to an upper side and a feed claw disposed at inside of the staple cartridge 451 is brought into contact with the upper face of front portion of the staple sheet 472. The slide door 454 is moved up to the initial position by being pulled by the tension coil spring 455 and a rear face of the staple pack 471 is covered.

Figure 21:
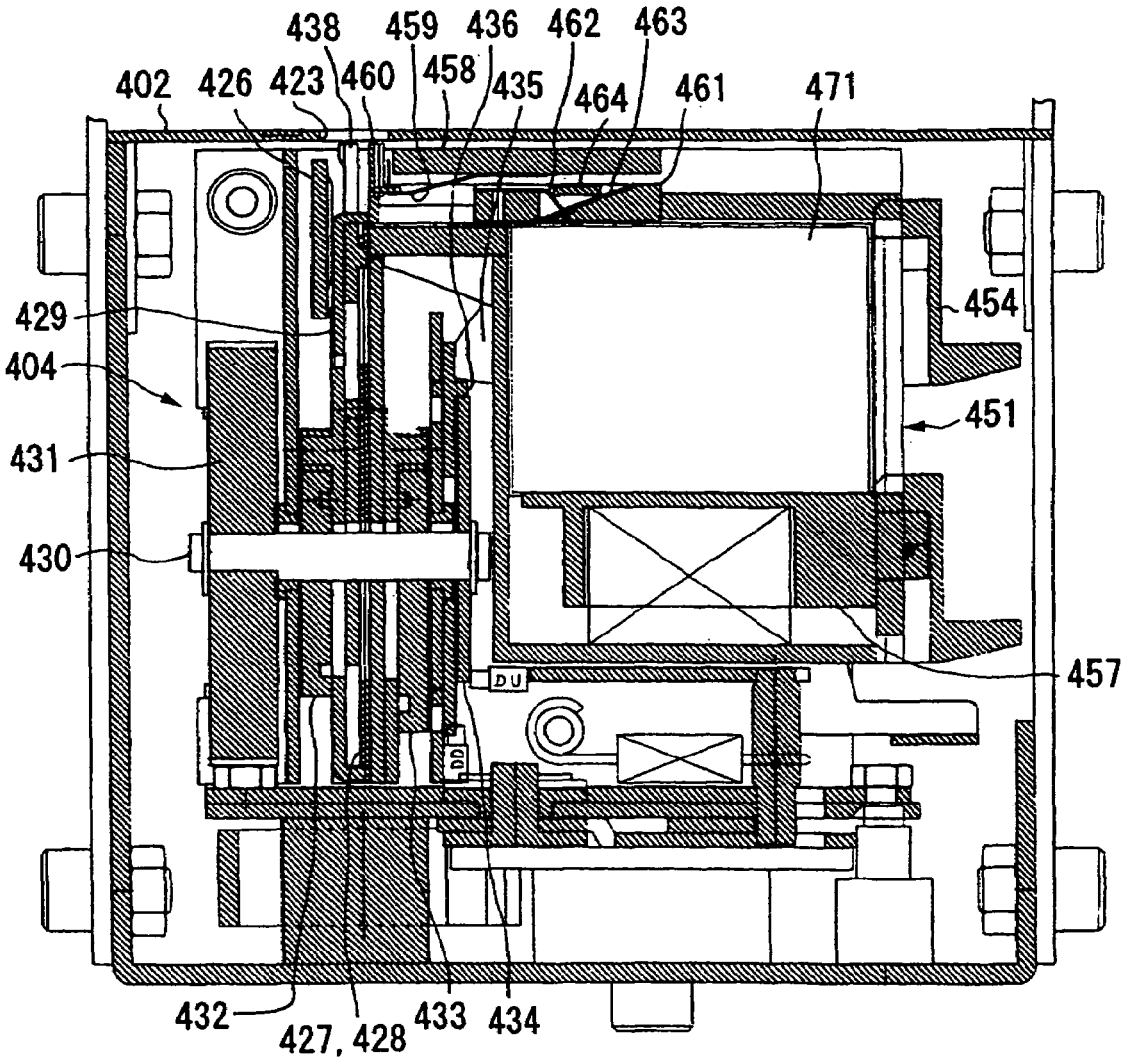
FIG. 21 is a side sectional view of the driver unit and the staple cartridge.
Figure 22:
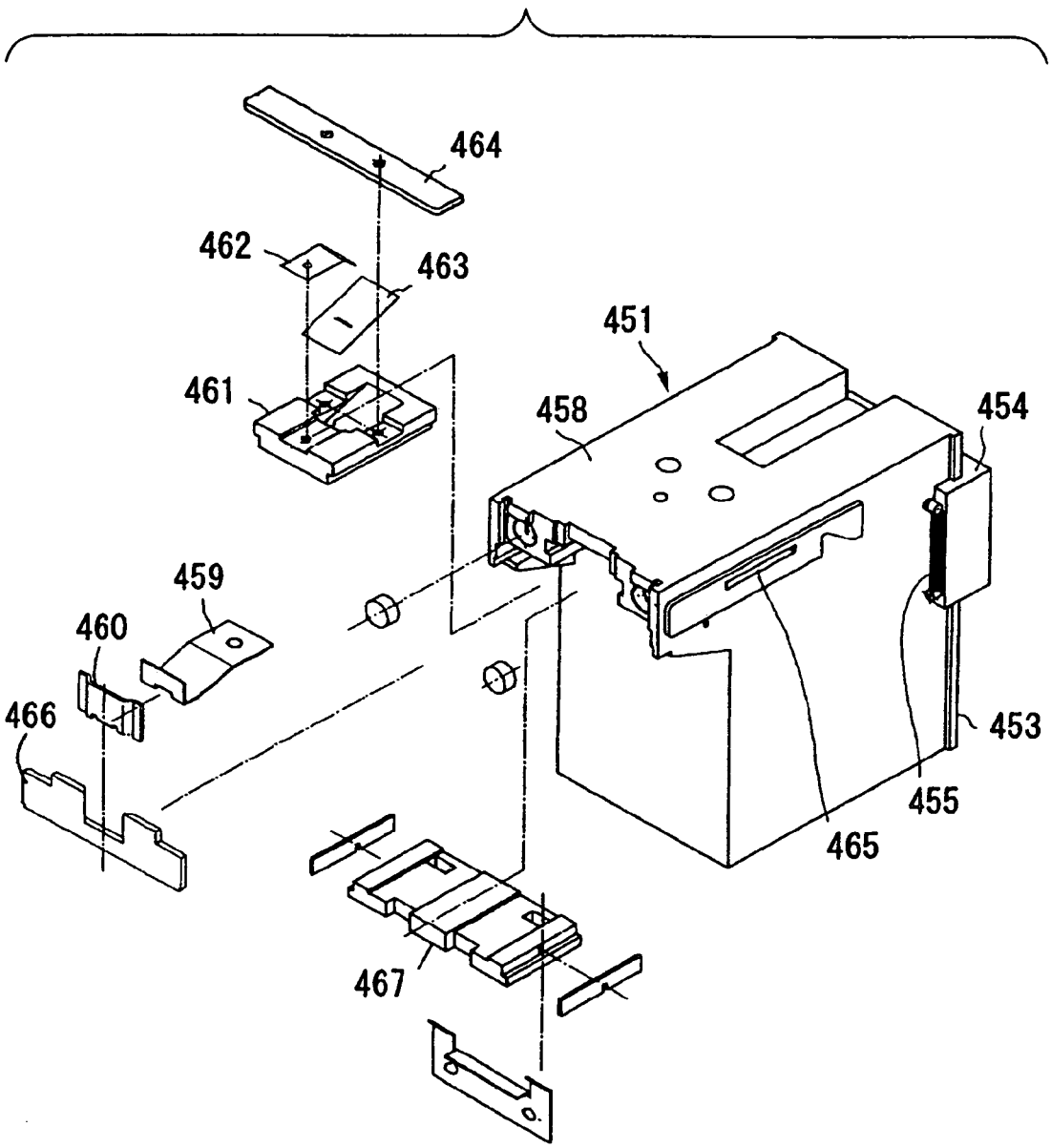
FIG. 22 is a side sectional view of the driver unit and the staple cartridge.

As shown by FIG. 21, FIG. 22, a lower face of a ceiling plate portion 458 of the staple cartridge 451 is attached with a leaf spring 459 by being directed to a skewed front lower direction and a front end of the leaf spring 459 is attached with a staple guide 460. An upper end of the staple guide 460 is disposed at a height substantially equal to that of an upper face of the staple cartridge 451 and in a state of mounting the staple cartridge 451 to the driver unit 404, the staple guide 460 is opposed to a front guide plate 426 at inside of the driver unit 404 shown in FIG. 21 and a staple, the driver 427 in a thin plate shape, forming plates 428 arranged at two left and right sides of the driver and an anvil 429 pass a path between the guide plate 426 and the staple guide 460.

A slider 461 slidable in a front and rear direction is provided below the ceiling plate portion 458 of the staple cartridge 451, a leaf spring 462 is attached to a front portion of the slider 461 by being directed in a skewed rear lower direction and the feed claw 463 is attached to a front end portion of the leaf spring 462. A front portion of the leaf spring 459 attached with the staple guide 460 is moved down from an upper face of the slider 461 in an initial state, and when the slider 461 is moved forward, the slider 461 impinges on a lower face of the leaf spring 459 to push up the leaf spring 459 and the staple guide 460 to an upper side. The slider 461 is attached with the arm 464 in the transverse direction and two left and right end portions of the arm 464 are projected to outer sides by passing grooves 465 of the staple cartridge 425. Further, numeral 466 shown in FIG. 22 designates a front cover and numeral 467 designates a staple guide table.

Figure 23:
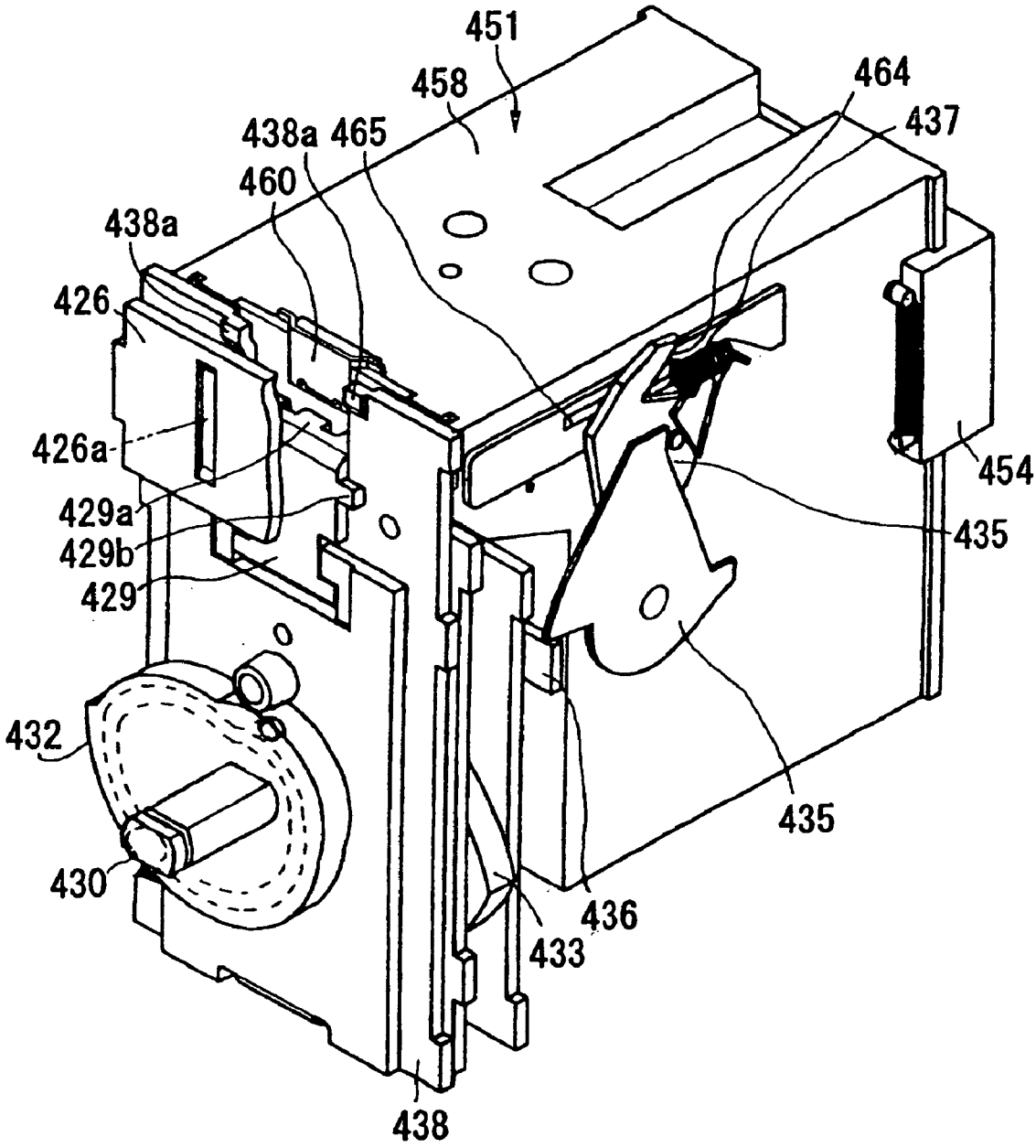
FIG. 23 is a perspective view of an initial state of a driver mechanism.

As shown by FIG. 21, a shaft 430 of a drive mechanism portion of the driver unit 404 is attached with a cam mechanism of a gear 431, a driver cam 432, a forming cam 433, a staple feed cam 434 and the like and the driver cam 432 and the forming cam 433 respectively drive to move up and down the driver 427 and the forming plate 428. A pair of link levers 435, 435 for driving to reciprocate the slider 460 of the staple cartridge 451 are arranged at two left and right side walls of the driver unit 404 and as shown by FIG. 23, a front end of the link lever 435 is brought into contact with a staple feed cam follower 436 and therefore, the cam follower 436 is driven to move up and down by the link lever 435.

In one cycle of stapling operation, the driver cam 432, the forming cam 433 and the staple feed cam 434 are set with operational timings such that first, the staple feed cam follower 436 is moved down to feed the staple, next, the forming plate 438 is driven to move up to form a linear staple and successively, an anvil 429 and the driver 427 are moved up integrally.

Figure 24:
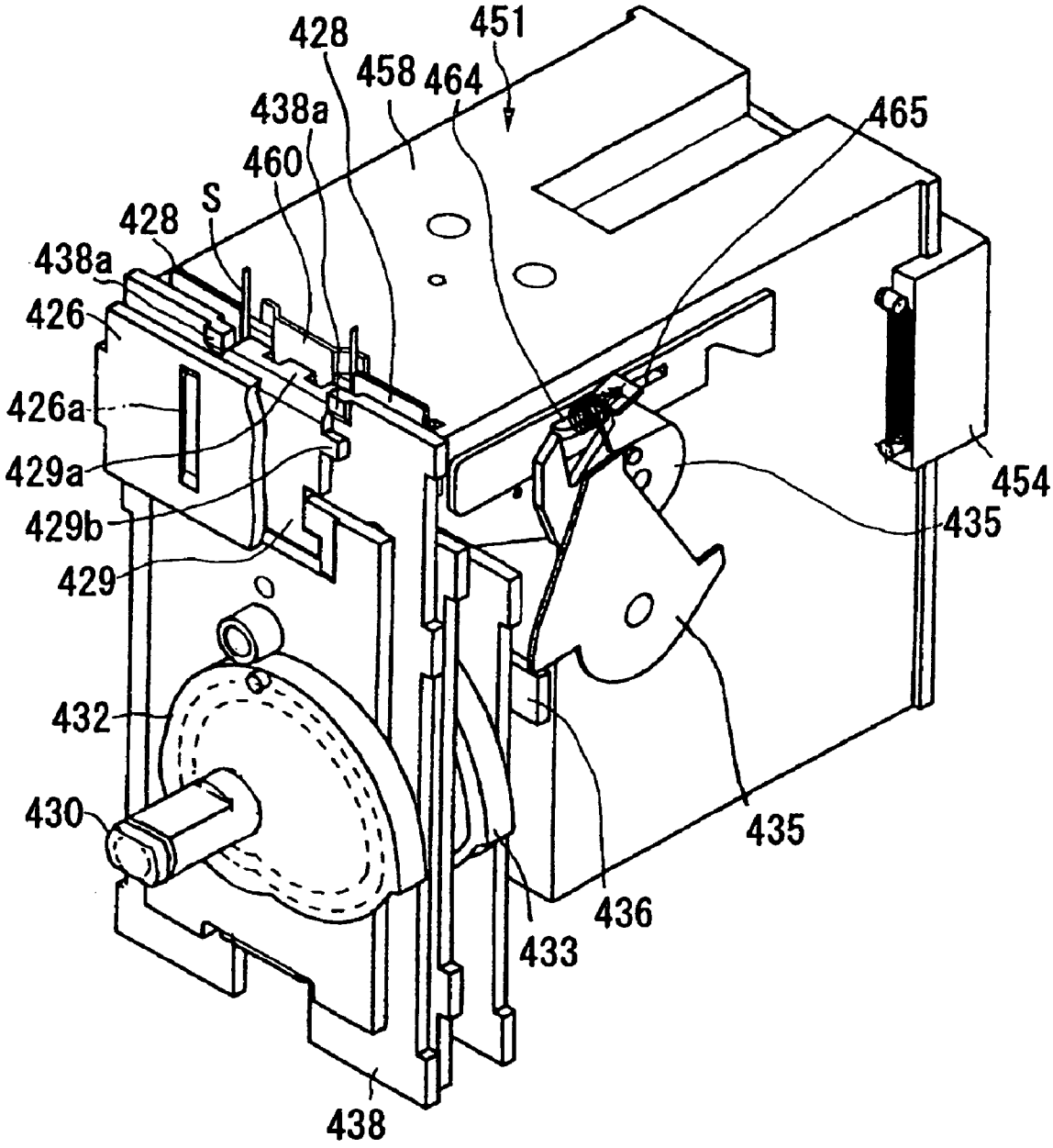
FIG. 24 is a perspective view showing a forming step of the driver mechanism.

When the driver unit 404 is started, as shown by FIG. 24, first, the staple feed cam follower 436 is moved down, and the staple feed link lever 435 urged by a tension coil spring 437 is rotated in the counterclockwise direction of the drawing. Thereby, the arm 464 and the slider 461 of the staple cartridge 451 are moved forwardly, the staple sheet is fed out to the front side by the feed claw 463, the slider 461 impinges on the lower face of the leaf spring 459 shown in FIG. 21 to push up the staple guide 460 to the upper side and the staple guide 460 is made to advance to the hole 423 of the sheet table 402 shown in FIG. 16. Simultaneously therewith, the clincher unit 403 shown in FIG. 14 is moved down to pinch paper on the sheet table 402 along with the driver unit 404. Successively, as shown by FIG. 24, the forming plate 428 is moved up to form a linear staple S in a gate-like shape. At this occasion, left and right claw portions 429*b* of the anvil 429 are brought into contact with ribs 423*a* at rear face of the front guide plate 423 to maintain in an erected state to support a middle portion of the staple S by a fold-to-bend portion 425*a*.

Figure 25:
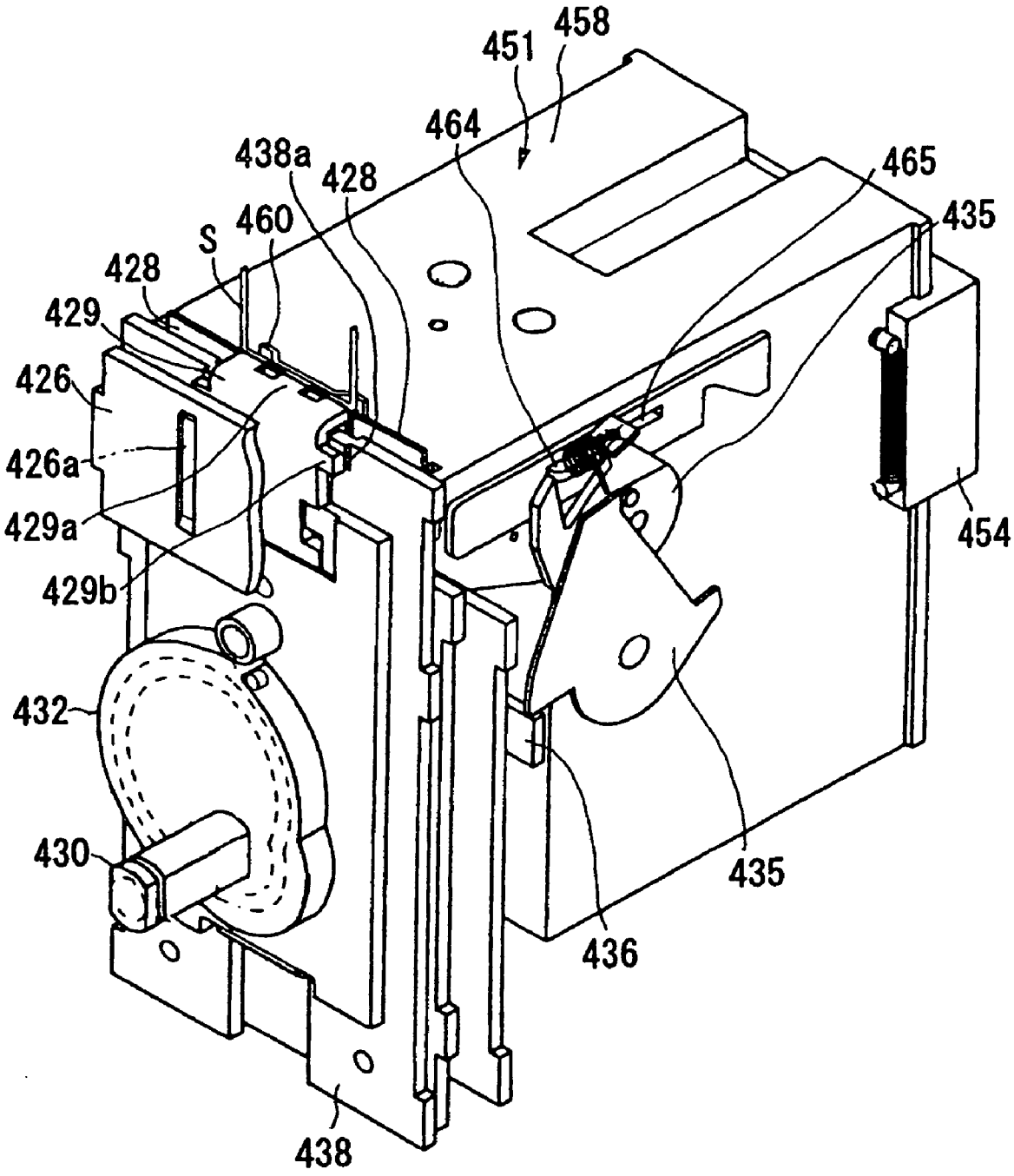
FIG. 25 is a perspective view showing an injecting step of the driver mechanism.

Further, after finishing to form the staple S, as shown by FIG. 25, the driver 427 and the anvil 429 are moved up, the claw portion 429*b* of the anvil 429 is moved upward from the rib 426*a* at the rear face of the front guide plate 426 to release from being restricted to be inclined forward, the claw portion 425*b* rides over a projection 438*a* at an upper portion of a front face of the vertical frame 438, the fold-to-bend portion 429*a* is escaped from the path of the driver 427 by inclining the anvil 429 forwardly and the driver 427 completely strikes the staple.

Further, after the clincher of the clincher unit 403 is moved down to bind paper by holding to bend left and right leg portions of the staple S to the inner sides, the anvil 429, the forming plate 428 and the driver 427 are moved down, the link lever 435 moves the slider 461 of the staple cartridge 451 to the initial position, thereby, the leaf spring 459 and the staple guide 460 are moved down and the staple guide 460 is moved back from the hole 423 of the sheet table 402 the lower side and returns to the initial position shown in FIG. 21 and FIG. 23.

Although when the electric stapler of the background art in which the position of the staple guide in an up and down direction is constant and the staple guide is not moved down from inside of a hole, it is necessary to enable to move the electric stapler by forming a long hole connecting three locations of stapling positions of A4, B4, C4 at the sheet table, according to the invention, the hole 423 having a necessary dimension may be formed at each stapling position of the sheet table 402 to thereby resolve a concern of catching paper fed from the copying mechanism portion to the sheet table 402 by the long hole.

Although an explanation has been given of the embodiment provided with the staple guide of a lifting type at the staple cartridge as described above, the embodiment is not limited thereto but may be constructed by a constitution of providing the staple guide of the lifting type to the driver unit.

Figure 26:
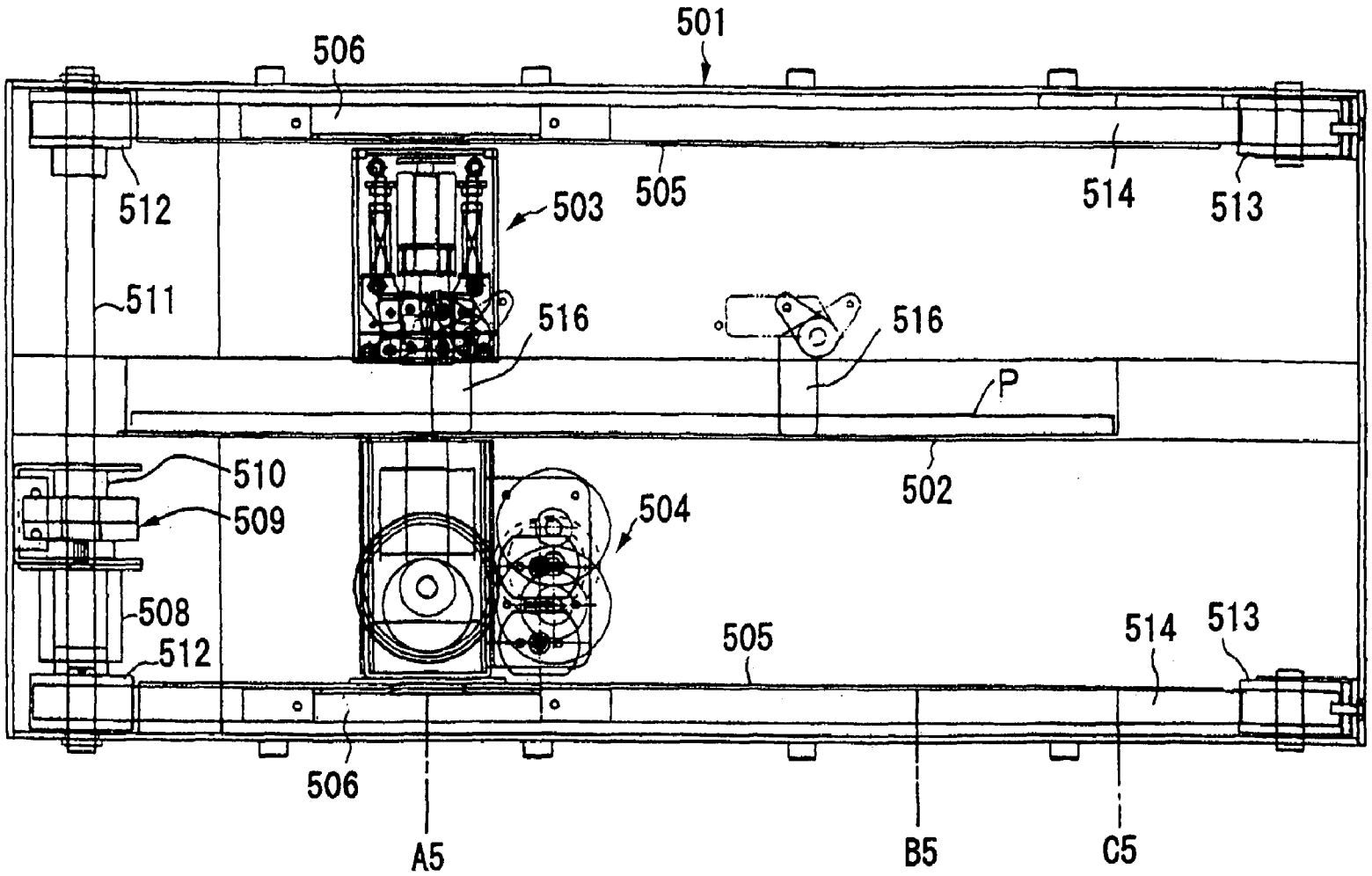
FIG. 26 is a front view of an electric stapler showing an embodiment of the invention.
Figure 27:
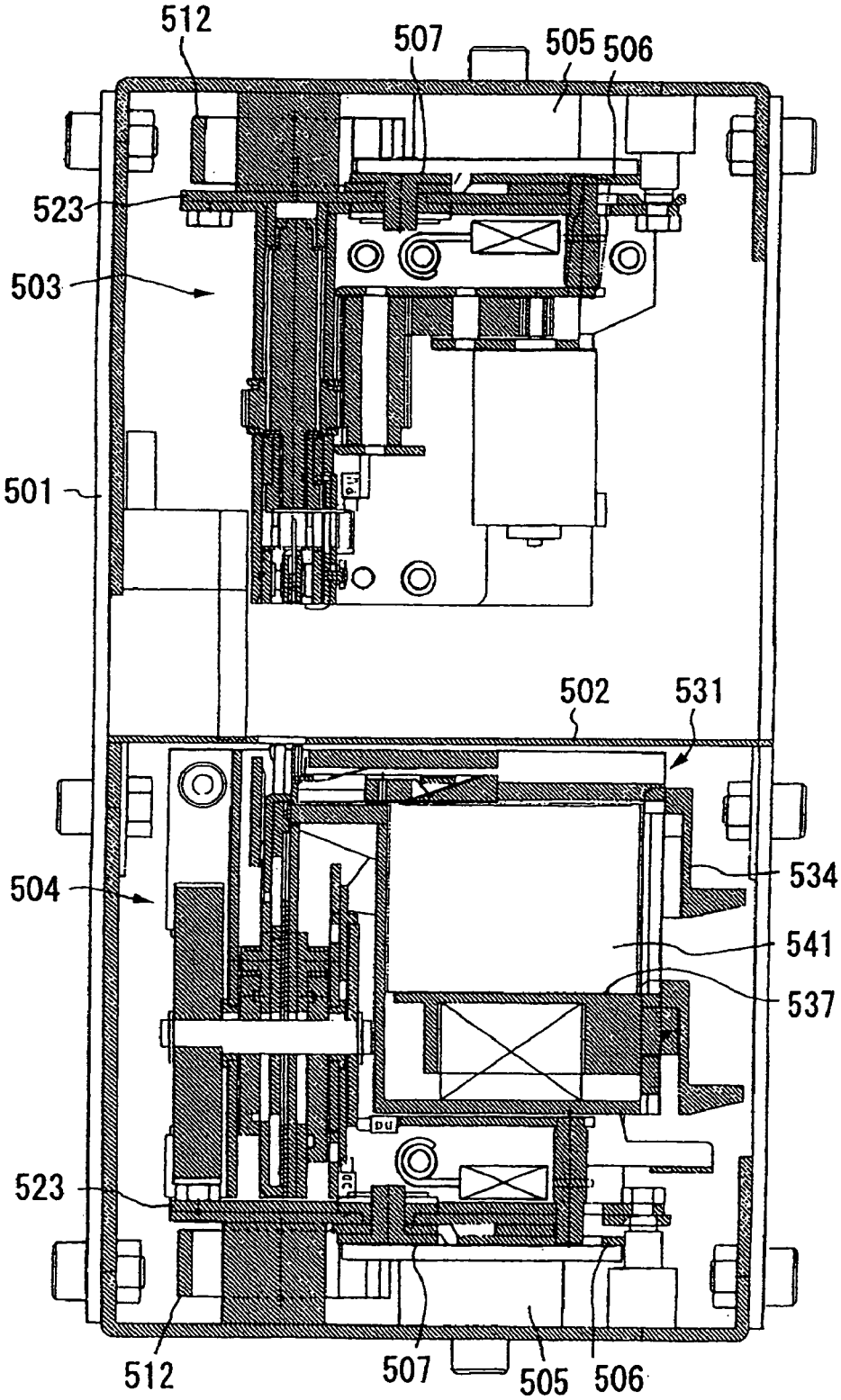
FIG. 27 is a side view of the electric stapler.

Next, a detailed description will be given of a fifth embodiment of the invention in reference to drawings. In FIG. 26 and FIG. 27, numeral 501 designates the frame, numeral 502 designates the sheet table made to span a middle portion in an up and down direction of the frame 501, the clincher unit 503 is arranged on an upper side of the sheet table 502, the driver unit 504 is arranged on a lower side of the sheet table 502 and the clincher unit 503 and the driver unit 504 are respectively traveled integrally to the right along linear guides 505 provided at a ceiling face and a bottom face of the frame 501. Traveling mechanisms and rotating mechanisms of the clincher unit 503 and the driver unit 504 are constructed by the same constitution, the clincher unit 503 and the driver unit 504 are attached to the shafts provided at central portions of the side bases 506 engaged with the linear guides 505 and the clincher unit 503 and the driver unit 504 can be rotated in a horizontal direction.

As shown by FIG. 26, the motor 508 for moving the stapler is arranged at a left end portion of the frame 501 for driving a vertical drive shaft 511 attached with a gear 510 at a final stage via a reduction gear 509. The vertical drive shape 511 is attached with the gear pulleys 512 at upper and lower end portions thereof, both ends of a timing belt 514 hung around the gear pulley 512 on the upper side and a driven gear pulley 513 arranged at an upper portion of a right end of the frame 501 stay to be attached to the slide base 506 supporting the clincher unit 503. Further, both ends of a timing belt 514 hung around the gear pulley 512 at a lower portion of the vertical drive shaft 511 and a driven gear pulley 513 arranged at a lower portion of the right end of the frame 501 stay to be attached to the side base 506 supporting the driver unit 504 to thereby constitute a stapler moving mechanism for traveling the clincher unit 503 and the driver unit 504 in synchronism with each other.

Figure 28:
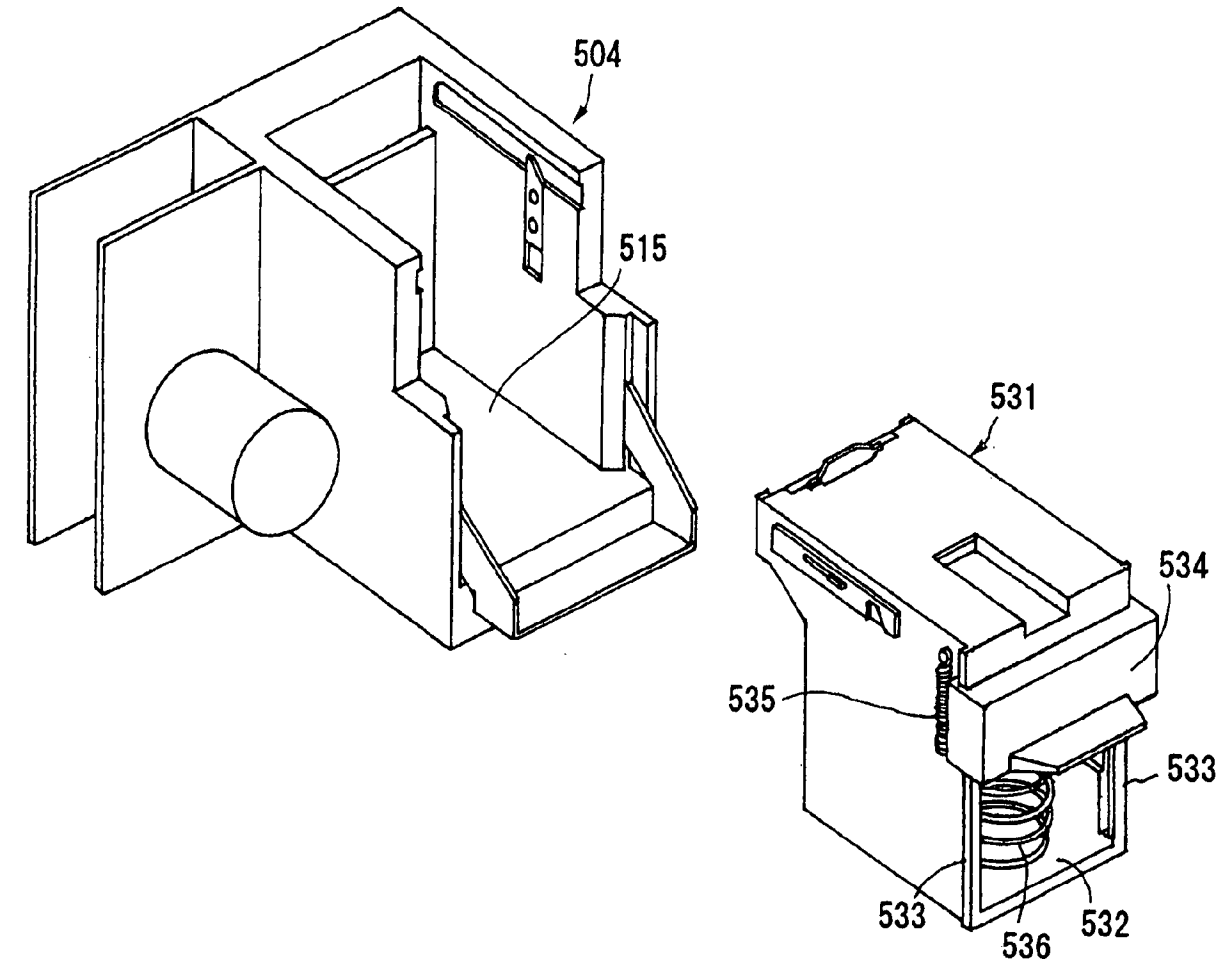
FIG. 28 is a perspective view of a driver unit and a staple cartridge.
Figure 29:
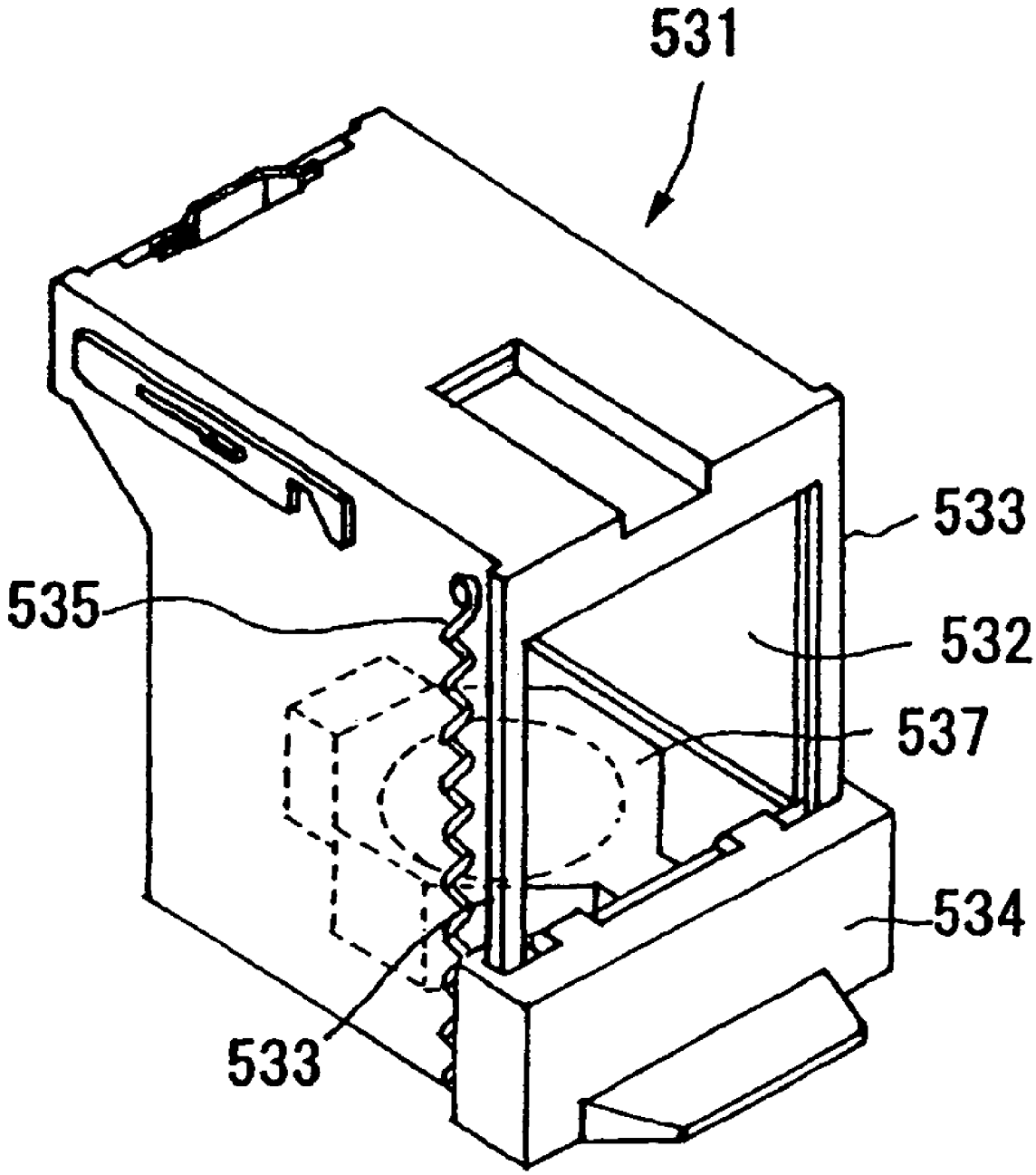
FIG. 29 is a perspective view showing the staple cartridge in a state of opening a slide door.

FIG. 28 is a perspective view of a rear face side of the driver unit 504, and the cartridge containing portion 515 is formed such that an upper face and a rear face thereof are opened and the staple cartridge 531 is charged from the rear face side to the cartridge containing portion 515. The staple cartridge 531 is formed with the opening portion 532 and the slide door 534 is engaged with guide rail portions 533 in a vertical direction formed at rear ends of two left and right side faces. The slide door 534 is pulled up to the upper side by a tension coil spring 535 made to span upper portions of the two left and right side faces of the staple cartridge 531 and the slide door 534. Further, a pressure plate, mentioned later, is included at inside of the staple cartridge 531 and the pressure plate is pushed to the upper side by a compression spring 536 installed at an inner bottom face thereof. The slide door 534 is formed with a groove (not illustrated) at a lower end portion of a center of a front face (face on an inner side of the cartridge), a rear end portion of the pressure plate is projected to a position of the groove, and when the slide door 534 is pushed down to the lower side as shown by FIG. 29, the rear end portion of the pressure plate 537 is engaged with the groove and also the pressure plate 537 is moved down simultaneously as shown by the drawing.

Figure 30:
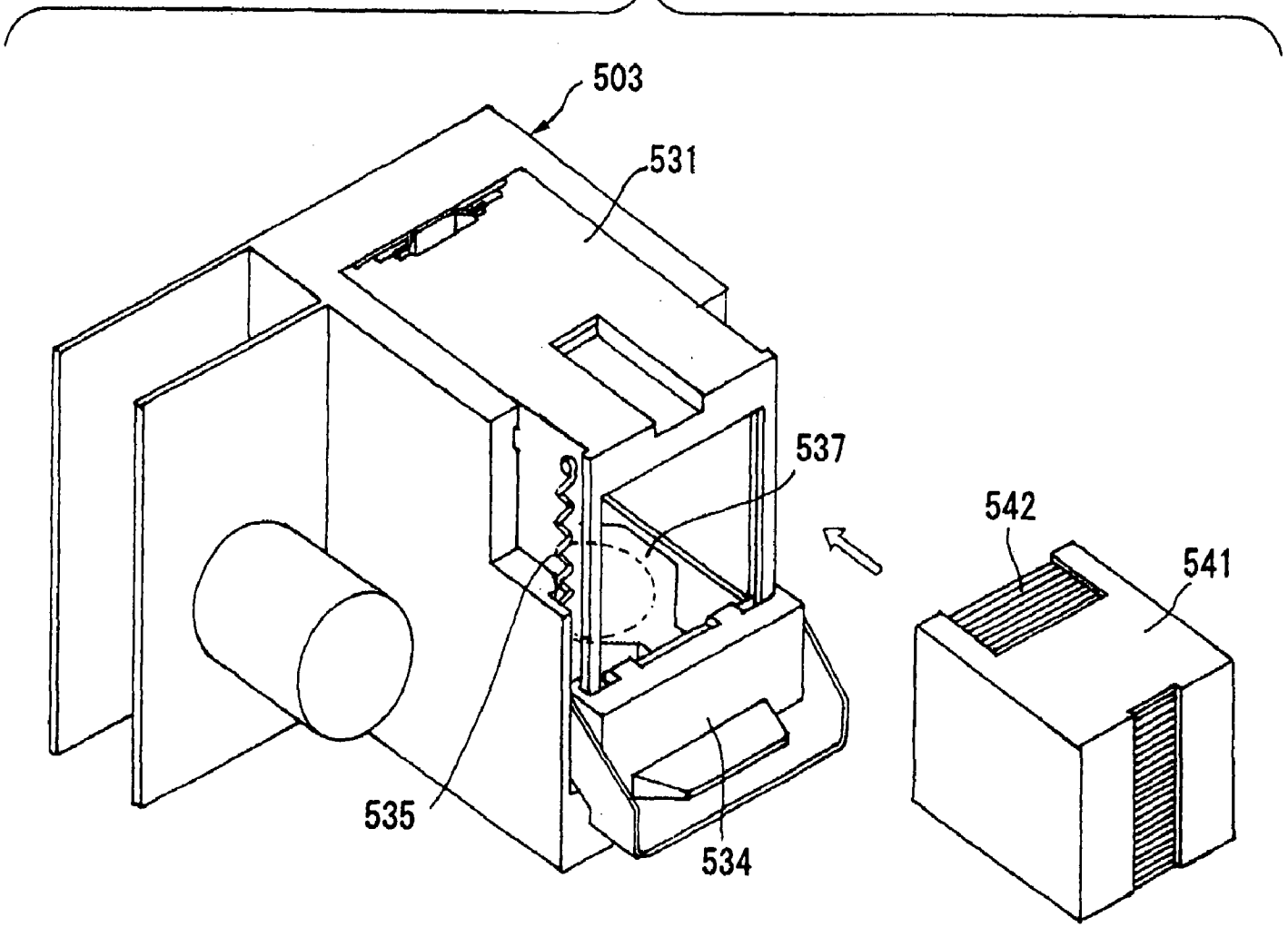
FIG. 30 is a perspective view of a state of charging the staple cartridge to the driver unit.

FIG. 30 shows a state of mounting the staple cartridge 531 to the driver unit 504 and numeral 541 designates the staple pack made of paper for refilling and a predetermined number of sheets of the staple sheets 542 are laminated to contain in the staple pack 541. In the drawing, the staple pack 541 is formed with windows at a lower face, a front portion of an upper face and a rear face, the pressure plate 537 is brought into contact with a lower face of the staple sheet 542 by being brought into the window of the lower face and a feed claw disposed at inside of the staple cartridge 531 is brought into contact with a front portion of an upper face of the staple sheet 542.

Figure 31:
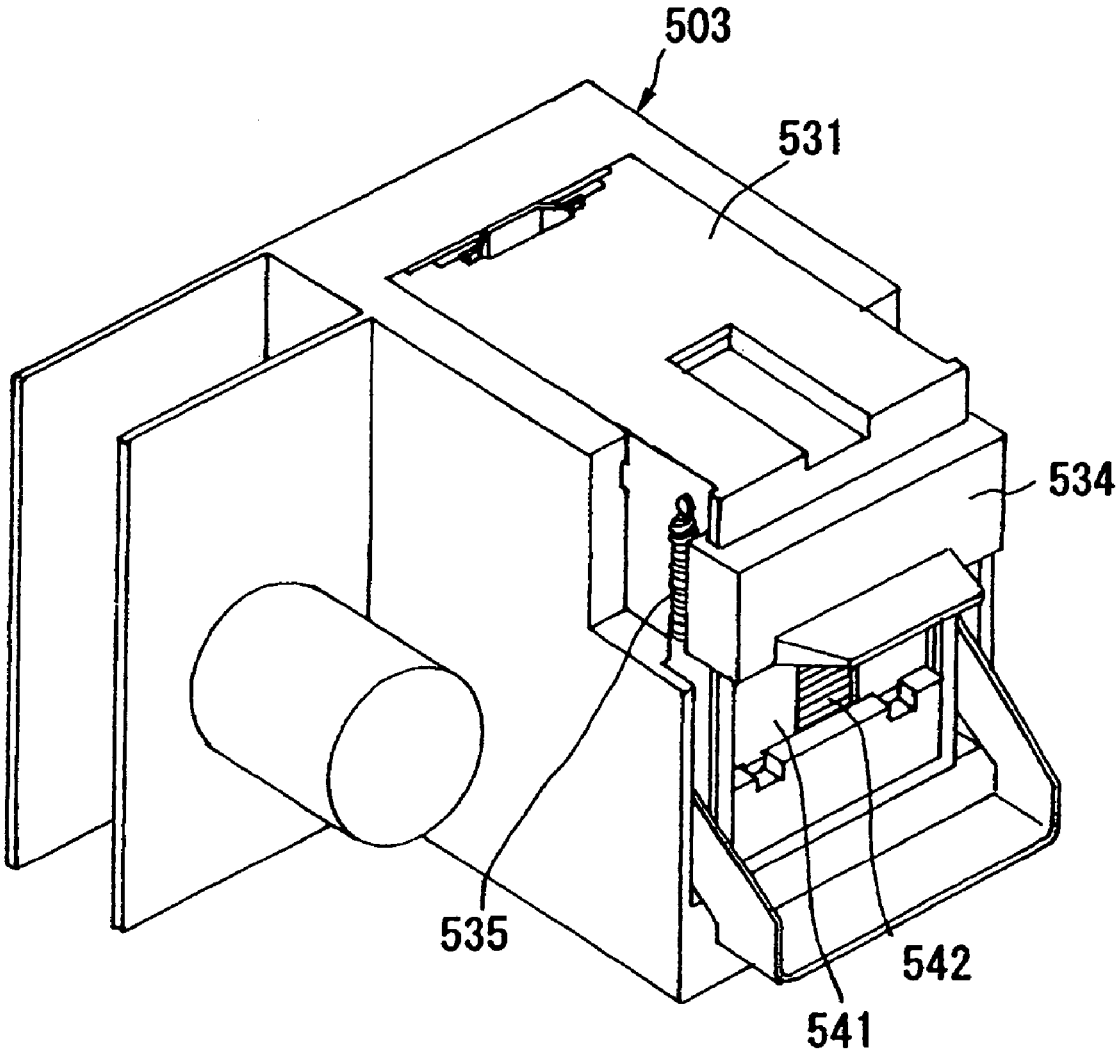
FIG. 31 is a perspective view showing a state of charging a staple to the staple cartridge.

In charging the staple pack 541 to the staple cartridge 531, as shown by FIG. 30, the slide door 534 and the pressure plate 537 are pushed down to the lower side, and the staple pack 541 is inserted into the staple cartridge 531 from the rear side of the staple cartridge 531. After inserting the staple pack, when the slide door 534 is released from being pushed down, as shown by FIG. 31, the slide door 534 is moved up to the initial position by being pulled by the tension coil spring and the rear face of the staple pack 541 is covered. The pressure plate 537 is bought into elastic contact with the lower face of the staple sheet 542 at inside of the staple tack 541 to press to the ceiling face at inside of the staple cartridge 531 and the pressure plate 537 is moved up in accordance with a reduction in a number of sheets of the staple sheets 542. When the staples have been used up, the empty staple pack is drawn out by pushing down the slide door 534 and the new staple pack is charted thereto.

FIG. 32 through FIG. 35 are explanatory views of a horizontal rotating mechanism of the electric stapler and in the drawings, a lower end of the linear guide 505 is a front cover side end portion disposed on a rear side of a front cover of a copier, an upper end (not illustrated) thereof is a rear face side end portion and when the front cover is opened, the front cover side end portion disposed on this side is exposed. A right side of the front cover side end portion of the linear guide 505 is arranged with the first stopper pin 521 and the second stopper pin 522 in parallel with the linear guide 505.

Numeral 523 designates the turn table type base plates of the driver unit 504 and the clincher unit 503 which are attached to the slide bases 506 shown in FIG. 26 to be able to rotate horizontally by the shafts 507 and formed with the 0 degree claw portions 524 projected to a front side (right side of the drawing) and the 45 degree claw portions 525 projected to the front side in the skewed right direction. Respective right corner portions of the 0 degree claw portions 524 and the 45 degree claw portions 525 are cut by 45 degrees, the third claw portions 526 are formed on further right sides of the 45 degree claw portions 525 and radii of 45 degree cut faces 524*a* of the 0 degree claw portions 524 and the third claw portions 526 centering on the shaft 507 are the same as each other. Further, although illustration is omitted, in order to fix the driver unit 504 and the clincher unit 503 to 0 degree rotated positions, the turn table type base plates 523 and the slide bases 506 are provided with a click stop mechanism by springs and spring receiving holes or grooves or the like.

Next, an explanation will be given of operation of the electric stapler. The electric stapler is controlled by a control portion of the copier to carry out back binding of binding two locations of a side of paper or skewed binding of striking a staple to a corner portion of a paper by an angle of 45 degrees. When one copy set of paper P is fed from a copying mechanism portion to the sheet table 502, in the case of a back binding mode, a staple is struck at an A5 position shown in FIG. 26 and the clincher unit 503 and the driver unit 504 are moved to a B5 position in parallel with each other by the stapler moving mechanism to strike a staple. Further, numeral 516 shown in FIG. 26 designates a stopper for aligning paper which is escaped from a path of paper by being rotated to an upper side by 90 degrees after a binding processing and paper P is discharged.

Figure 32:
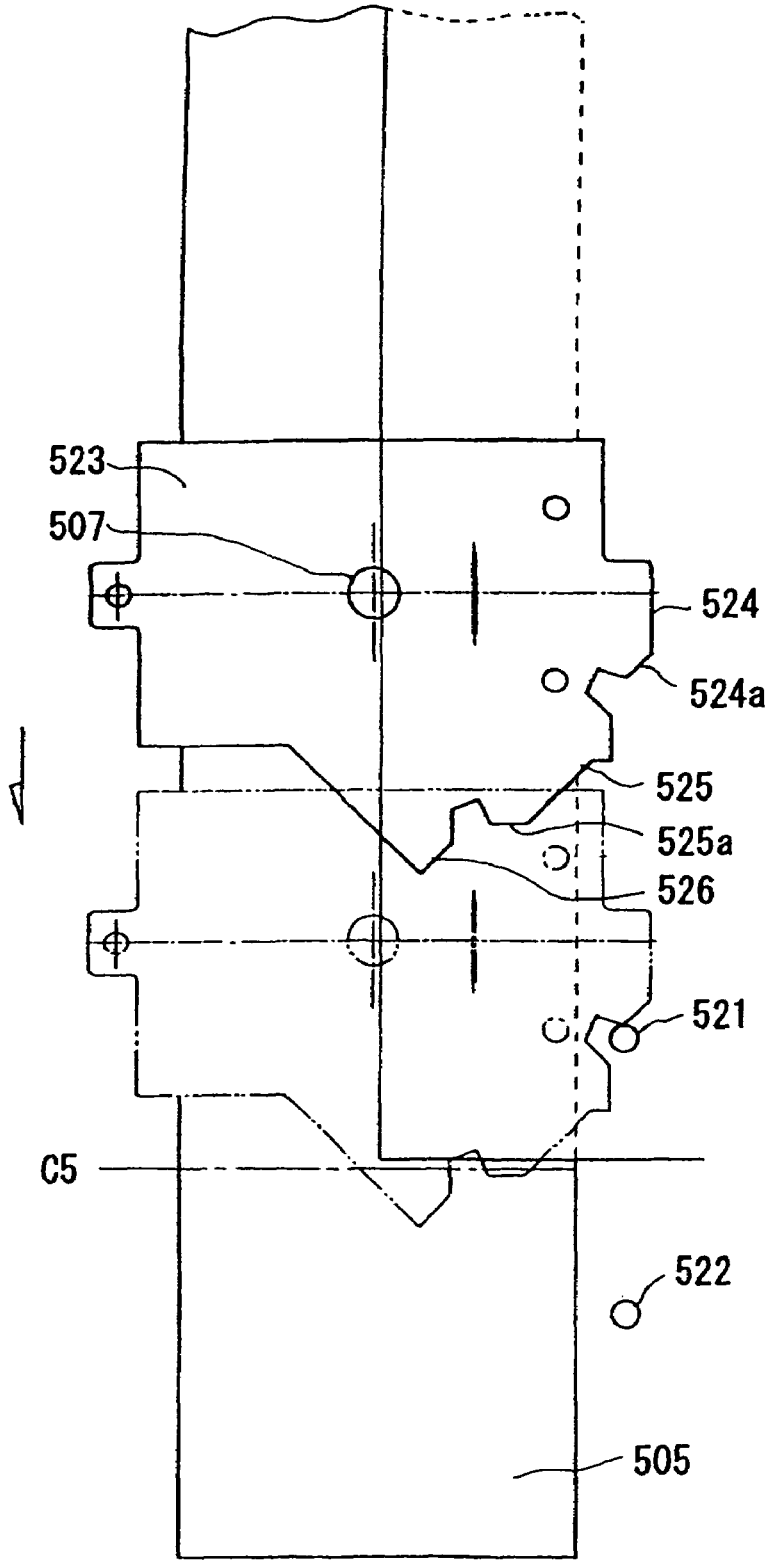
FIG. 32 is an explanatory view showing operation of a horizontal rotating mechanism of an electric stapler.
Figure 33:
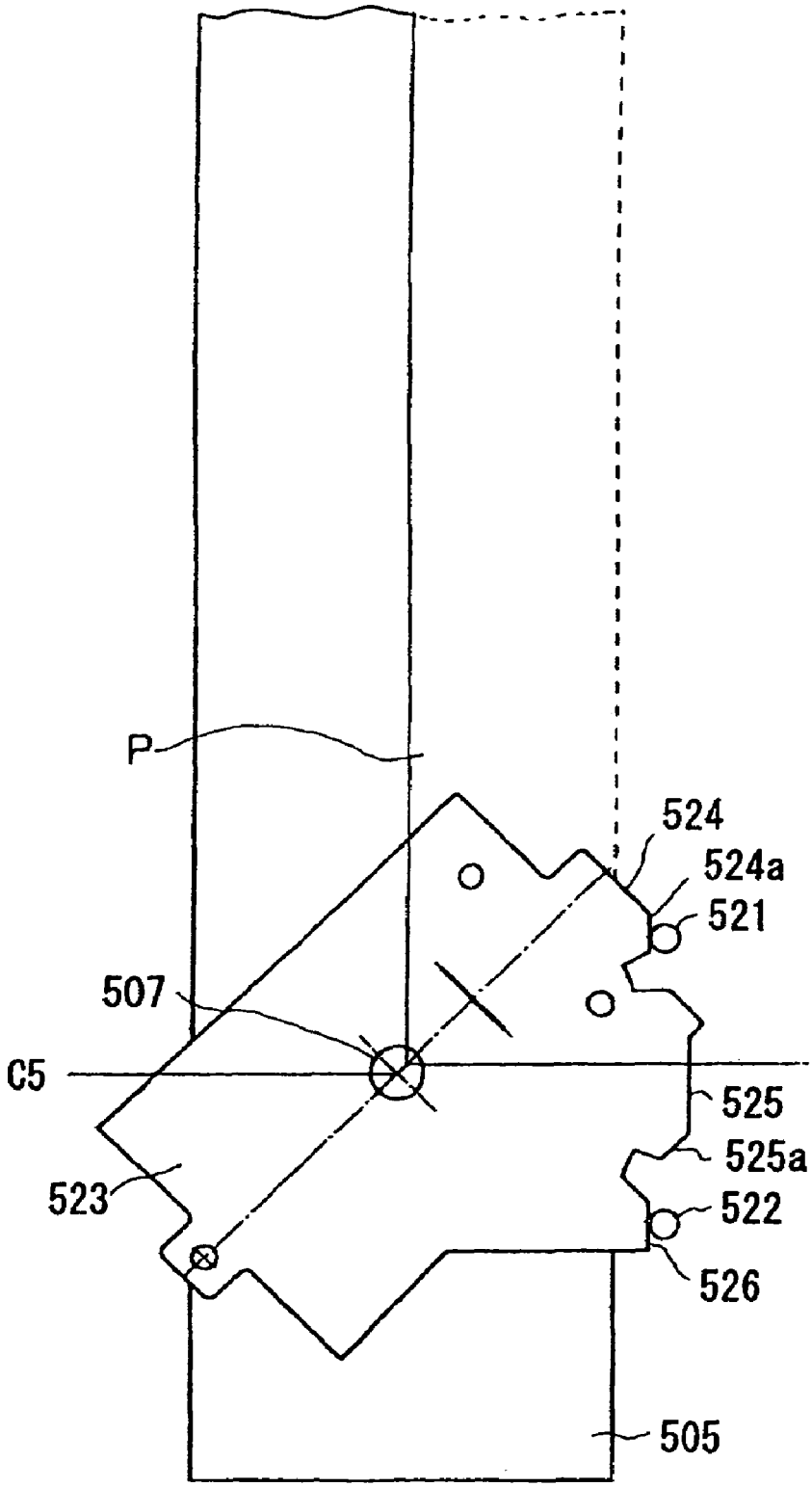
FIG. 33 is an explanatory view showing the operation of the horizontal rotating mechanism of the electric stapler.

When skewed binding is set, the clincher unit 504 and the driver unit 504 are moved to a C5 position immediately before a right end thereof. At this occasion, as shown by FIG. 32, immediately before reaching the C5 position, the 45 degree space 524*a* of the 0 degree claw portion 524 of the base plate 523 impinges on the first stopper pin 521, the base plate 523 is rotated in the counterclockwise direction by being pressed by the stopper pin 521 by moving the side base 506 further to the right and is stopped at the C5 position by being rotated by 45 degrees as shown by FIG. 33. At this occasion, the first stopper pin 521 is brought into contact with the 45 degree cut face 524*a* of the 0 degree claw portion 524 of the base plate 523, the second stopper pin 522 is brought into contact with a front face of the third claw portion 526, the clincher unit 503 and the driver unit 504 are fixed at the 45 degree rotated positions and paper is bound by striking a staple to the corner portion of paper P by the angle of 45 degrees.

After the staple is struck to paper, when the clincher unit 503 and the driver unit 504 starts traveling to the left (upper side in the drawing) by driving to rotate the stapler moving mechanism reversely, the first stopper pins 521 impinge on the left side faces of the 45 degree claw portions 524 disposed at 0 degree positions to rotate the base plates 523 in the clockwise direction to respectively return to the 0 degree rotated positions and at the same time, the first stopper pins 521 are detached from the 45 degree claw portions 525 and the clincher unit 503 and the driver unit 504 are traveled further to the right to return to the A5 position.

Figure 34:
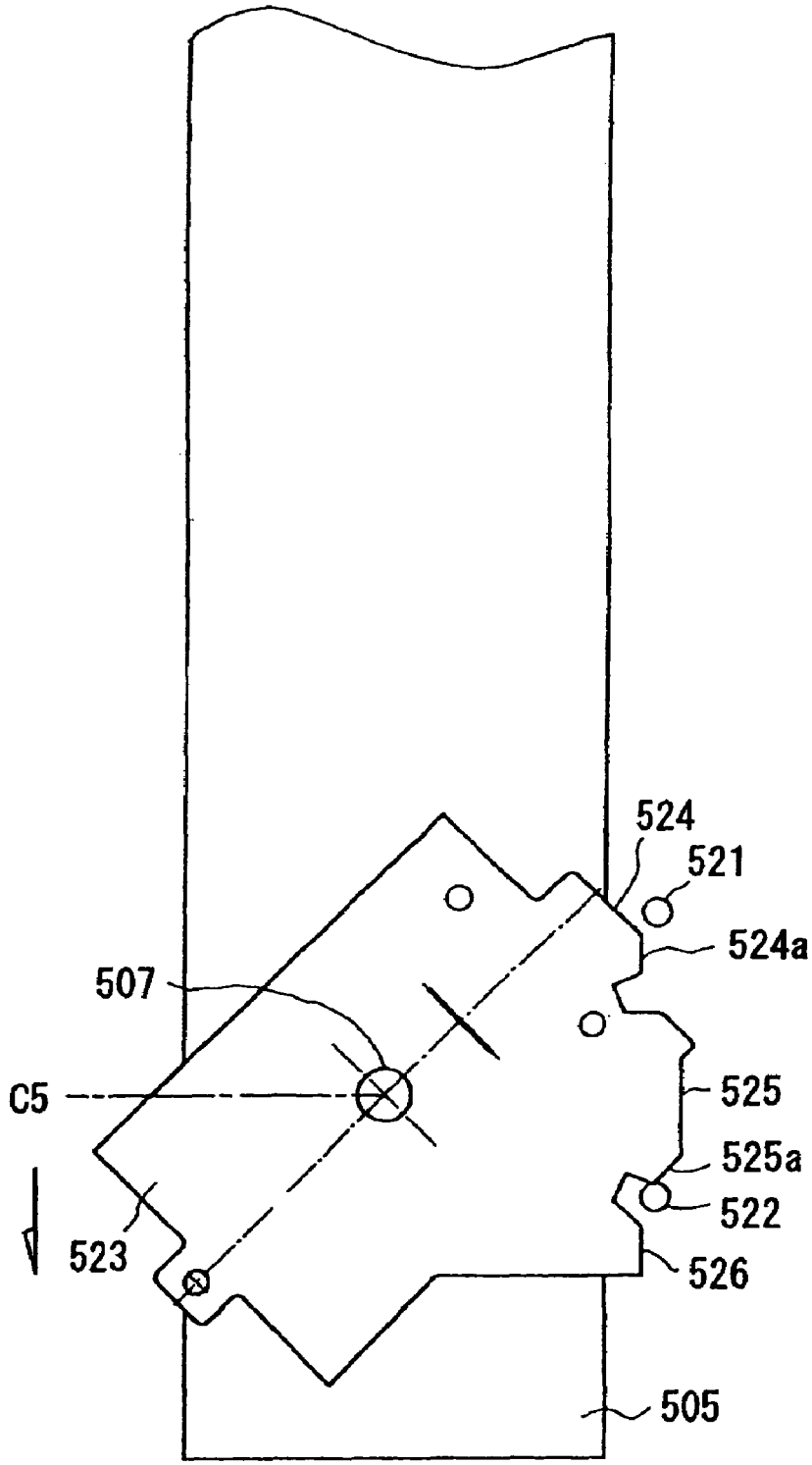
FIG. 34 is an explanatory view showing the operation of the horizontal rotating mechanism of the electric stapler.
Figure 35:
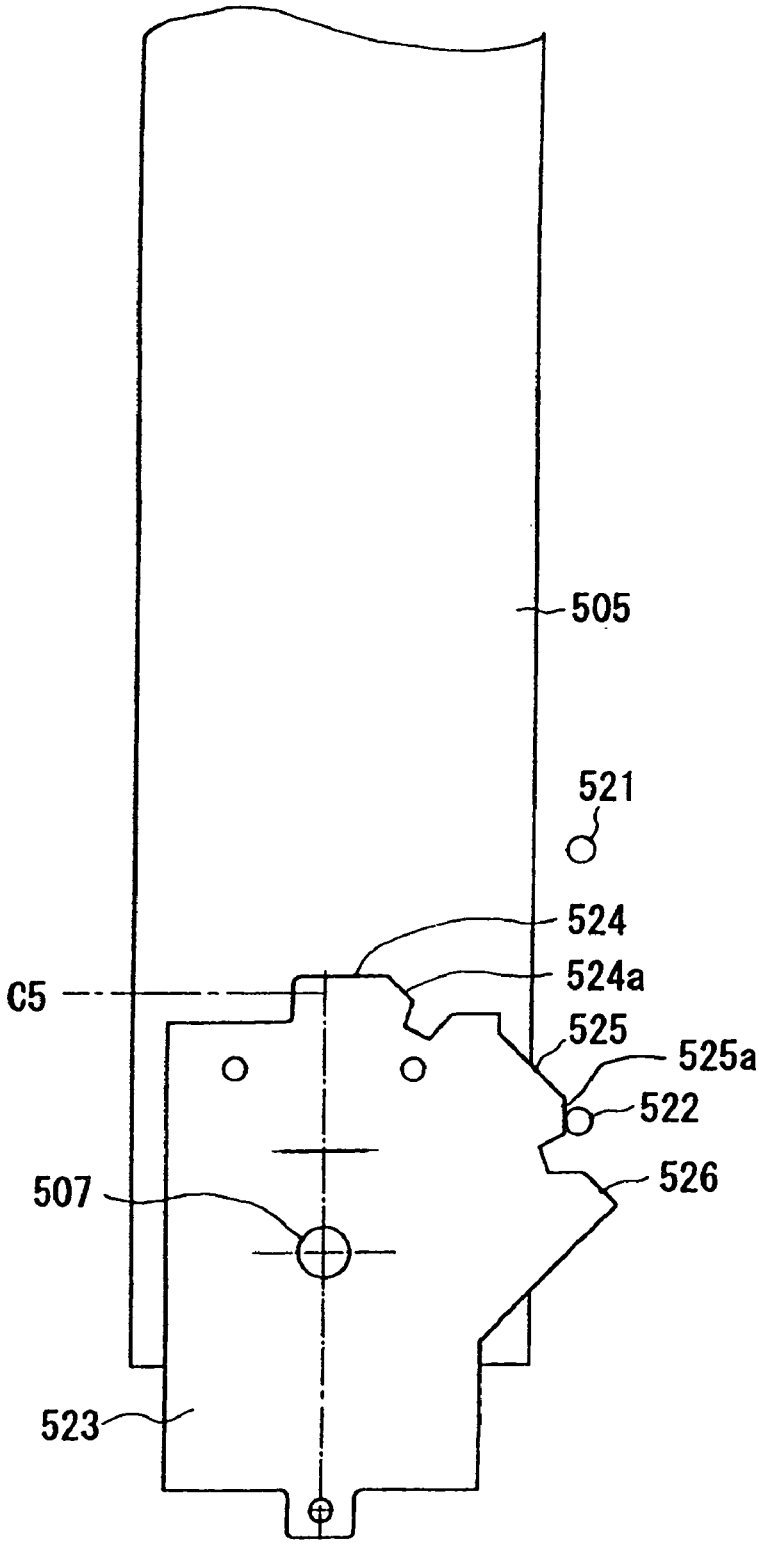
FIG. 35 is an explanatory view showing the operation of the horizontal rotating mechanism of the electric stapler.

In the case of replenishing the staple to the driver unit 504, the case of interchanging the staple cartridge, or the case of removing the staple cartridge by clogging, when the control portion of the electric stapler is inputted with carriage return instruction, the clincher unit 503 and the driver unit 504 are moved to a stationary position at the right end by the stapler moving mechanism. At this occasion, first, the base plate is rotated by 45 degrees by the first stopper pin 521 at the C5 position as shown by FIG. 33 and by traveling further to the right (lower side of the drawing), as shown by FIG. 34, the 45 degree claw portion 525 impinges on the second stopper pin 522 and the base plate 523 is rotated in the counterclockwise direction and when the base plate 523 is rotated from the 0 degree position by 90 degrees, the second stopper pin 522 is brought into contact with the 45 degree cut face 525*a* of the 45 degree claw portion 525 and the stapler moving mechanism is stopped. That is, a cartridge charging port at a rear face of the driver unit 504 is stopped in an attitude of being directed to the front face side (lower side of the drawing) of the copier and therefore, when the front cover of the copier is opened, the staple cartridge can be attached or detached and the staple pack can be charged to the staple cartridge as it is.

When the front cover of the copier is closed after finishing operation of interchanging or attaching or detaching the staple cartridge, the control portion controls the stapler moving mechanism to start to travel the clincher unit 503 and the driver unit 504 reversely to the initial positions, first, the third claw portion 526 impinges on the second stopper pin 522 and the base plate 523 is rotated from the 90 degree rotated position to the 45 degree rotated position, successively, as described above, the 45 degree claw portion 525 impinges on the first stopper 521, and the base plate 523 is rotated from the 45 degree rotated position to the 0 degree rotated position which is the initial position and is traveled further to the left to return to the A5 position.

Further, although an explanation has been given here of the embodiment in which the rotating mechanisms of the driver unit 504 and the clincher unit 503 are constructed by the same constitution, according to the electric stapler of the style of separating the driver unit and the clincher unit upwardly and downwardly, it is not necessarily needed to rotate the clincher unit by 90 degrees but the moving mechanism of the clincher unit may only be provided with a 45 degree rotated function by the first stopper pin 521 without providing the second stopper pin 522. Further, when the skewed binding function is not needed, there may be constructed a constitution in which the clincher unit is provided with a rotating mechanism and only the driver unit is provided with the 90 degree rotating mechanism.

Figure 36:
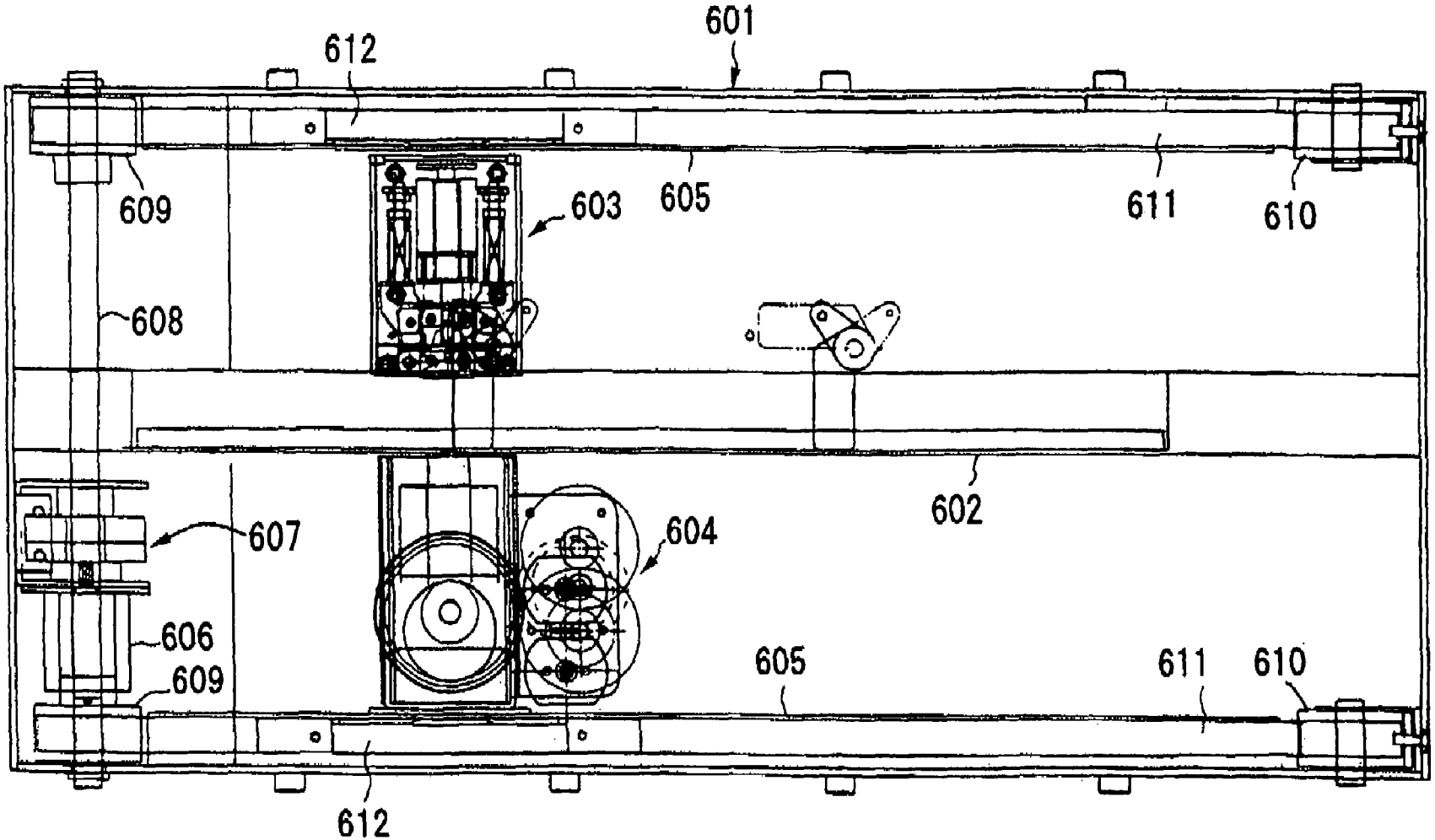
FIG. 36 is a front view of an electric stapler.
Figure 37:
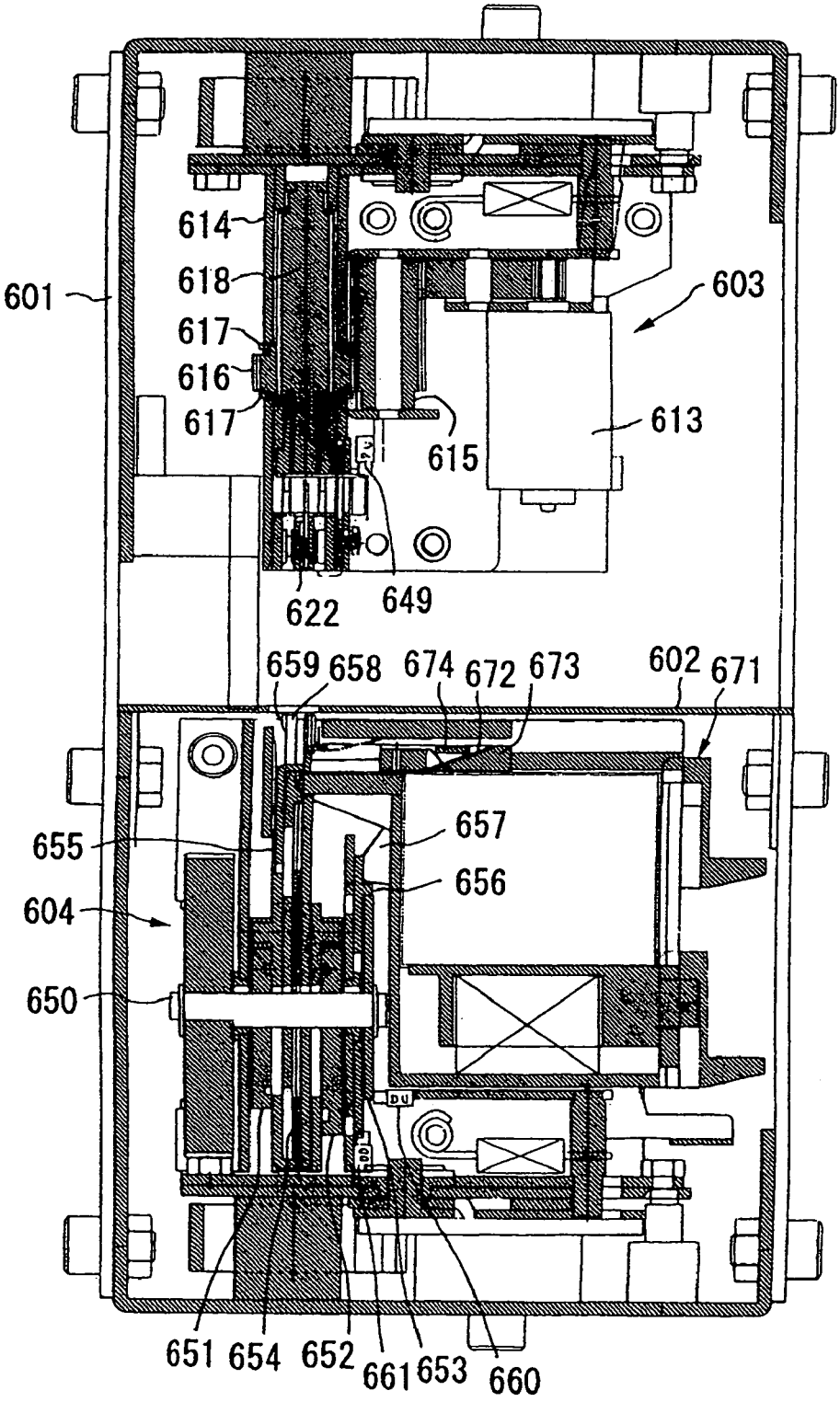
FIG. 37 is a side sectional view of the electric stapler.
Figure 38:
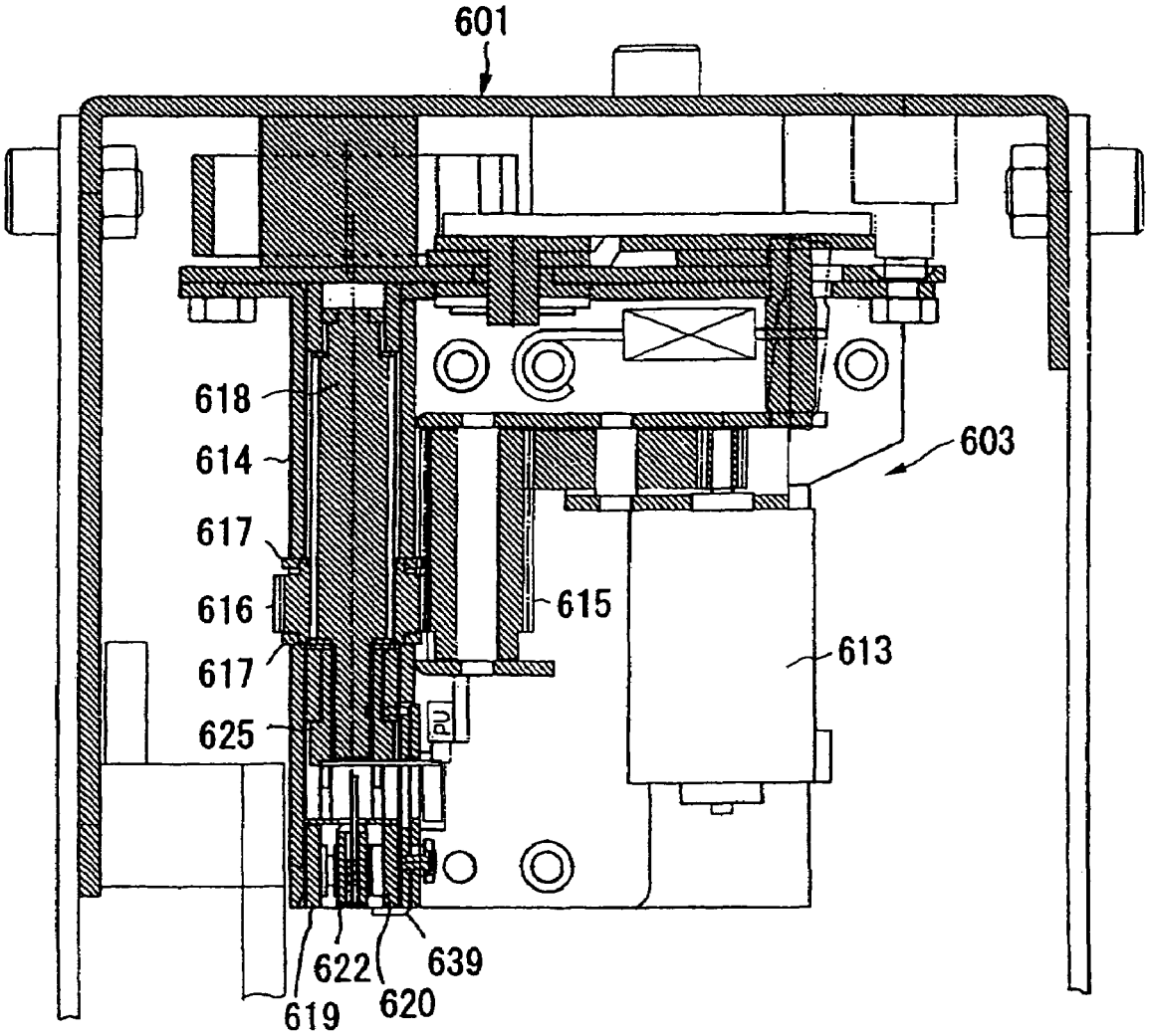
FIG. 38 is a side sectional view of a clincher portion.

Next, a detailed description will be given of a sixth embodiment of the invention in reference to the drawings. FIG. 36 is a front view of an electric stapler, FIG. 37 is a side sectional view and FIG. 38 is a view enlarging an upper half portion of FIG. 37. In FIG. 36, numeral 601 designates the frame, numeral 602 designates the sheet table made to span a middle portion in an up and down direction of the frame 601, the clincher portion 603 is arranged on an upper side of the sheet table 602, the driver portion 604 is arranged on a lower side of the sheet table 602 and the clincher portion 603 and the driver portion 604 are respectively engaged with linear guides 605 provided at a ceiling face and an inner bottom face of the frame 601.

A motor 606 for moving the stapler is arranged at a left end portion of the frame 601 for driving a vertical drive shaft 608 via a reduction gear 607. Gear pulleys 609 are attached to two upper and lower end portions of the vertical drive shaft 608, both ends of a timing belt 611 hung around the gear pulley 609 on the upper side and a driven gear pulley 610 arranged on the upper portion of a right end of the frame 601 stay to be attached to a slide base 612 supporting the clincher unit 603. Similarly, both ends of a timing belt 611 hung around the gear pulley 609 on the lower side of the vertical drive shaft 608 and a driven gear pulley 610 arranged at a lower portion of the right end of the frame 601 stay to be attached to a slide base 612 for supporting the driver portion 604 to thereby constitute a stapler moving mechanism for traveling the clincher portion 603 and the driver portion 604 in synchronism with each other.

Next, an explanation will be given of a constitution of the clincher portion 603. As shown by FIG. 38, the clincher drive motor 613 is arranged upwardly at a rear portion of the clincher frame 614 to drive to rotate a gear 616 at a final stage via the middle gear 615. The gear 616 in a spur gear shape is supported by the gear holder 617 fixed to the clincher frame 614 at two upper and lower faces thereof and the screw shaft 618 is screwed to a screw hole formed at a center.

Figure 39:
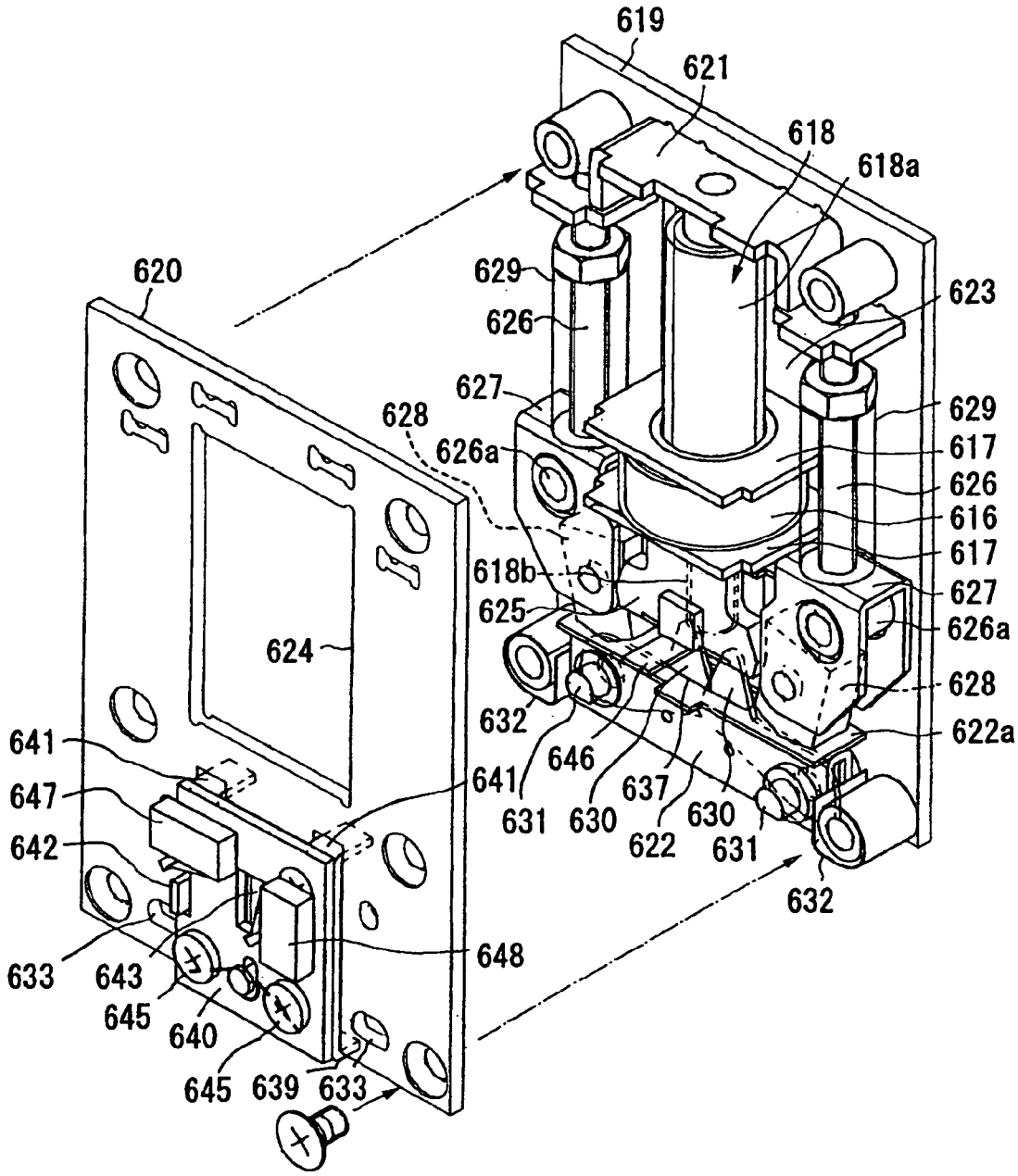
FIG. 39 is a disassembled perspective view of a clinch mechanism portion.

FIG. 39 is a disassembled view viewing a lifting type clinch mechanism portion of the clincher portion 603 from a rear side (right side in FIG. 38), a cabinet of the clinch mechanism portion is constituted by the front and rear cover frames 619, 620 and the upper support frame 621, and the clincher unit 622 is included at the lower portion of the cabinet. Upper half portions of the front and rear covers are formed with square holes 623, 624 which are long vertically and a gear 616 is brought in mesh with the middle gear 615 via the square hole of the rear face side cover frame 620 and when the gear 616 is rotated in the counterclockwise direction by being viewed from an upper side, in FIG. 39, the clinch mechanism portion except the gear 616 and the gear holder 617 is moved down and contrary thereto, when the gear 616 is rotated in the clockwise direction, the clinch mechanism portion is moved up.

The screw shaft 618 is a stepped male screw comprising a large diameter screw portion 618*a* on the upper side and a small diameter screw portion 618*b* on the lower side and the small diameter screw portion 618*b* is screwed to a screw hole formed at the clincher pressure 625. Fixed screw shafts 626 are vertically arranged on the left and on the right of the center screw shaft 618, the stopper holder 627 is attached to a horizontal shaft portion 626*a* attached to a lower end portion of the fixed screw shaft 626 to direct in a front and rear direction and the stopper holder 627 is attached with the stopper plate 628 pivotably in a left and right direction. The stopper holder 627 is attached slidably to the horizontal shaft portion 626*a* of the fixed screw shaft 626 and is pushed down to the lower side by a compression coil spring 629 mounted to the fixed screw shaft 626.

A lower face of the stopper plate 628 is constituted by a shape of a mountain and is brought into contact with a support plate 622*a* mounted on an upper face of the clincher unit 622. In an initial state in which the clincher pusher 625 is moved up, there is brought about a state in which the clincher pusher 625 is brought into contact with upper side faces of the left and right stopper plates 628 to push to widen to outer sides and lower portions of the two stopper plates 628 are pivoted to inner sides to be proximate to each other. Although a detailed explanation of operation will be described later, when the clincher pusher 625 is moved down, the clincher pusher 625 is brought into contact with an inner side face of the lower portion of the stopper plate 628 to push to widen the left and right stopper plates 628 to outer sides, the stopper holder 627 is moved up by compressing the compression coil spring 629 by being pressed by the stopper plate 628 and at the same time, the stopper plate 628 presses the support plate 628*a* and the clincher unit 622 to the lower side. The support plate 622*a* and the clincher unit 622 are brought into face contact with each other and the pressed clincher unit 622 is firmly fixed without being shifted in a front and rear direction.

When the clincher pusher 625 is moved up to an initial position and released of a widening pressure to the stopper plate 628, the stopper holder 627 is moved down by a spring force of the compression coil spring 629, thereby, the lower portions of the left and right stopper plates 628 are closed to return to the initial position.

The left and right clinchers 630 at inside of the clincher unit 622 are urged in an upper direction by the leaf springs 632 arranged respectively on outer sides of the support shafts 631 and by pushing down the left and right clinchers 630 by moving down the clincher pusher 635, the clinchers 630 fold to bend leg portions of the staple to be flat. Further, when the clincher pusher 625 is moved up, the front end portions of the clinchers 630 are moved up to return to the initial position by the spring force of the leaf springs 632.

The clincher unit 622 are supported by inserting the left and right support shafts 631 into holes 633 of the cover frames 619, 620, a diameter of the support shaft 631 is smaller than the inner diameter of the hole 633, further, a width in a front and rear direction of the clincher unit 622 is narrower than an inner interval of the cover frames 619, 620 and therefore, left and right portions of the clincher unit 622 can finely be moved in the front and rear direction by themselves.

Figure 40:
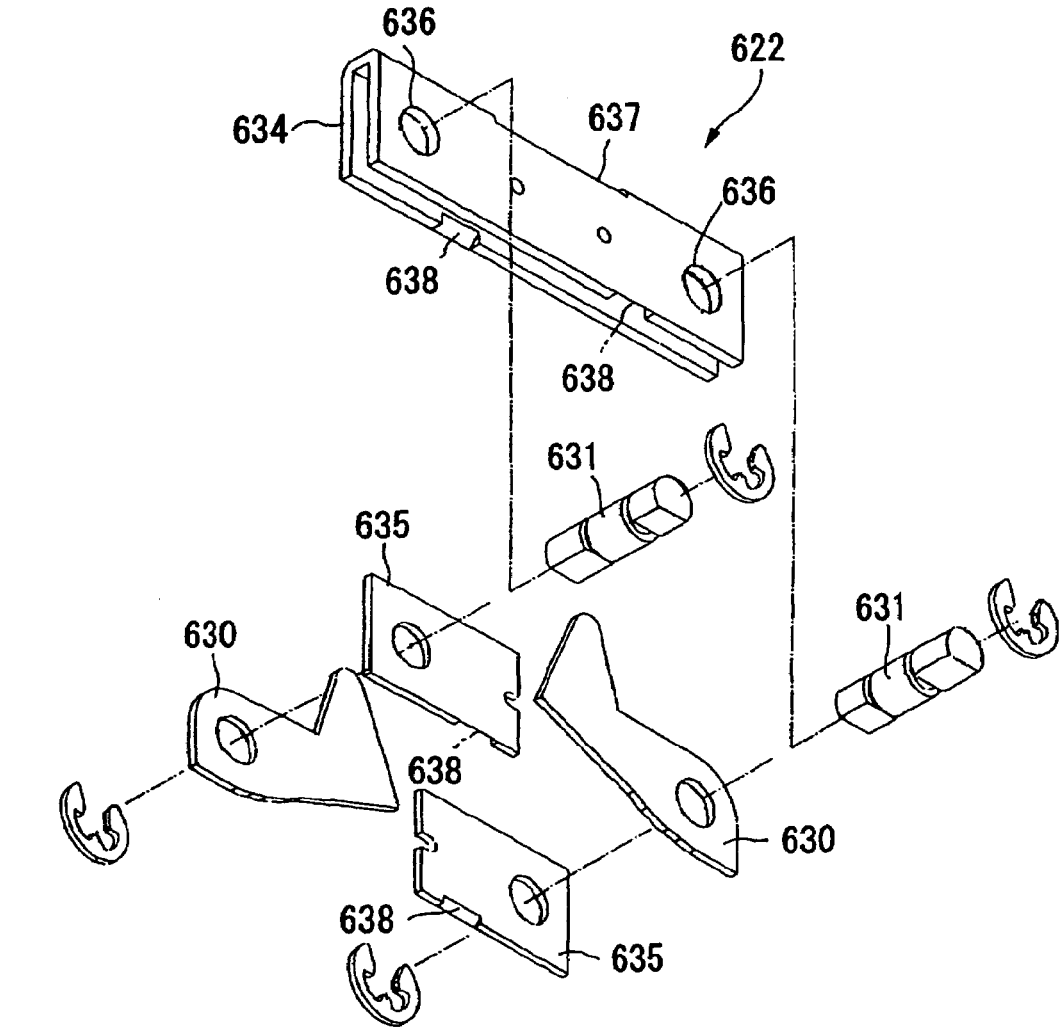
FIG. 40 is a view of assembling a clincher unit.

FIG. 40 shows a constitution of the clincher unit 622, numeral 634 designates a clincher holder in a groove-like shape pressed in a U-like shape and numeral 635 designates the spacer in a square shape. The pair of the left and right clinchers 630 and the spacers 635 are attached to the support shafts 631 inserted into a pair of left and right holes 636 of the clincher holder 634. A front end portion of the clincher 630 is formed with a projected portion in a shape of a mountain projected to the upper side, the projected portion is projected to the upper side by passing the hole 637 formed at a ceiling portion of a center of the clincher holder 634 and is opposed to the clincher pusher 625, mentioned later. The clincher 630 and the spacer 635 are alternately laminated inversely to the right and to the left and are integrated in a state in which a front face of a front end portion of one clincher and a rear face of a front end portion of other clincher are brought into contact with each other.

Figure 41:
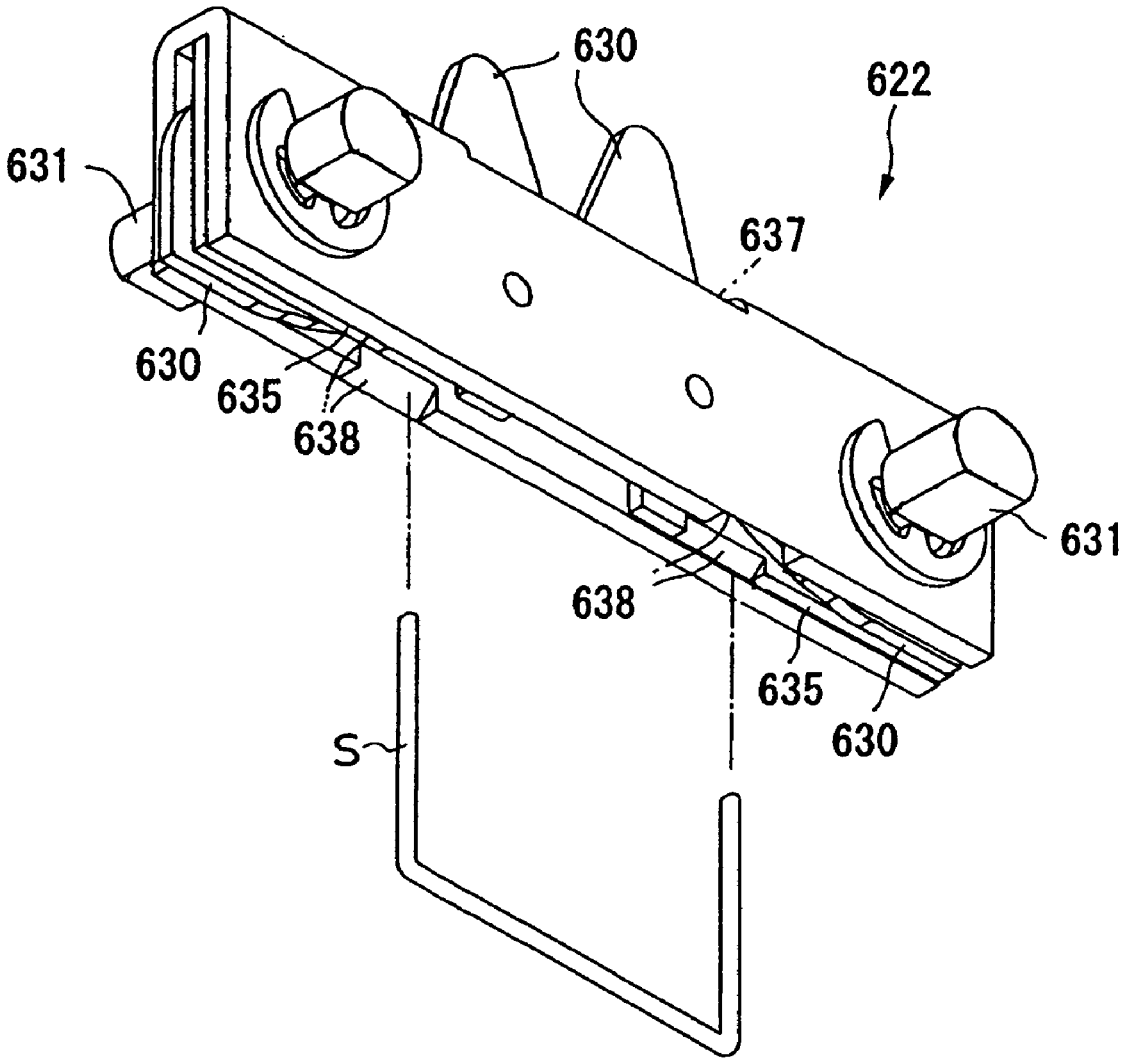
FIG. 41 is a perspective view of the clincher unit.

Lower ends of the clincher holder 634 and the spacer 635 are formed with the guide faces 638 inclined to rise from a front edge portion or a rear edge portion to inside of the clincher holder 634 and as shown by FIG. 41, the guide faces 638 are arranged in correspondence with position of penetrating the leg portion to the staple S. As described above, the clincher unit 622 can finely moved in the front and rear direction at inside of the front and rear cover frames 619, 620 and therefore, even when a position of the leg portion of the staple S is more or less shifted in the front and rear direction, by striking a front end of the leg portion to the guide face 638, the clincher unit 622 is moved frontward or rearward, the front end of the leg portion of the staple S is made to advance between the clincher holder 634 and the spacer 635 and accurately brought into contact with the lower face of the clincher 630. In this way, the clincher unit 622 is provided with an automatic aligning mechanism, thereby, a concern of a failure in clinching by shifting a position of striking the staple is resolved. Further, since the two leg portions of the staple S are held between the clincher holders 634 and the spacers 635 respectively until finishing to clinch the staple S and the two leg portions are separated by the spacers 635, the two leg portions are clinched in parallel and there is not a concern of overlapping and intersecting the two leg portions.

Figure 42:
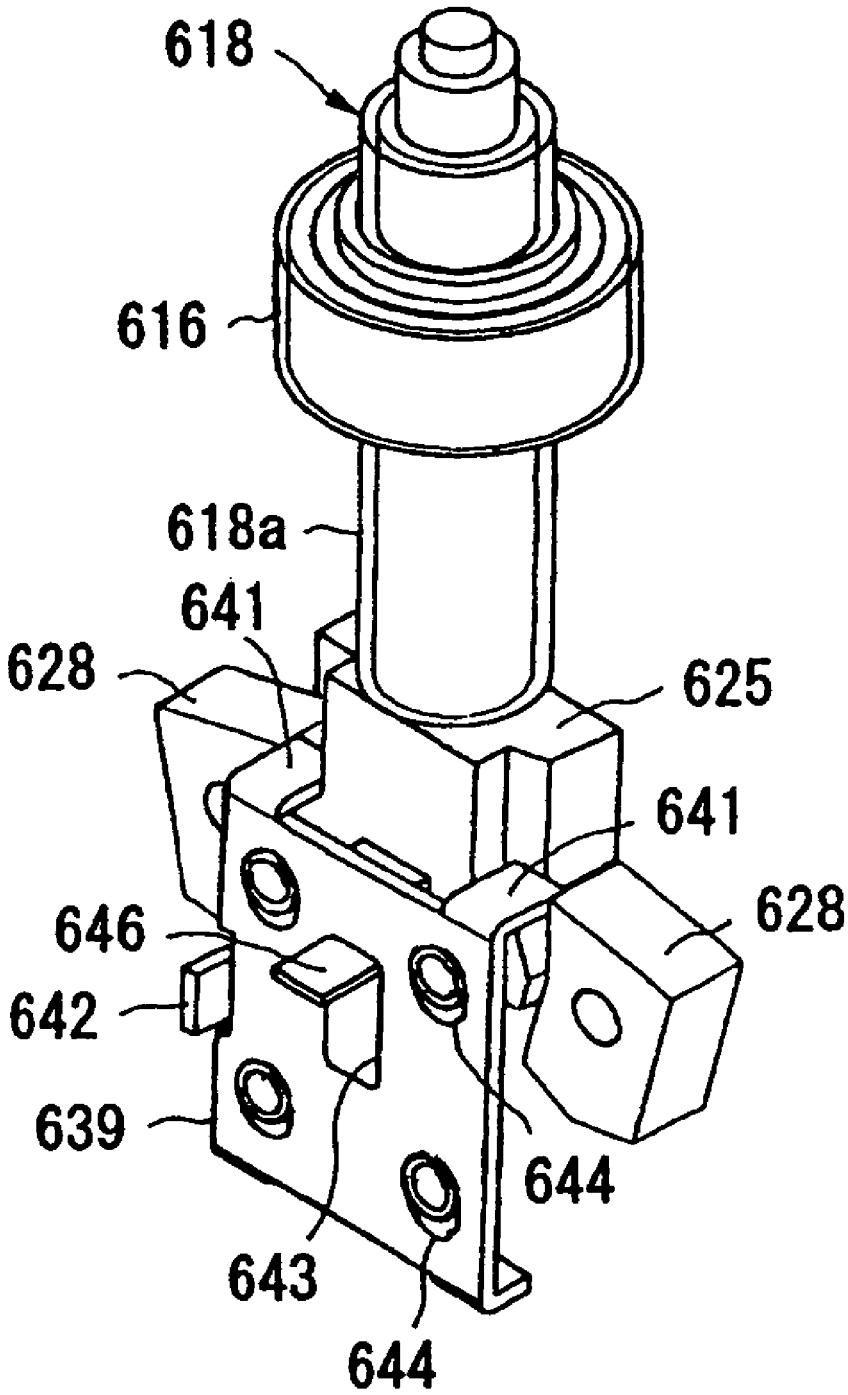
FIG. 42 is a perspective view of a screw shaft and a clincher pusher.

As shown by FIG. 39, the lower portion of the cover frame 620 on the rear face side is attached with the slider 639 and the slider cover 640 for detecting grounding of the clinch mechanism portion. As shown by FIG. 42, the slider 639 is provided with claws 641, 642 at an upper portion and a left side of face thereof and formed with a long hole 643 which is long in an up and down direction at the center of a vertical face thereof and guide holes 644 at four locations in the up and down direction and in the left and right direction, as shown by FIG. 39, the upper end claw 641 is inserted into the hole of the cover frame 620 on the rear face side, the slider cover attaching screw 645 is passed through a guide hole 644 of the slider 639 to fasten to the cover frame 620 on the rear face side, thereby, the slider cover 640 is fixed and the slider 639 is held in a state of being slidable in the up and down direction. Further, when the slider 639 is moved down to dispose at the initial position, as shown by FIG. 42, the upper end claw 641 of the slider 639 is brought between the clincher pusher 625 and the stopper plate 628 and under the state, the clincher pusher 625 cannot be moved down to expand to open the lower portion of the stopper plate 628 and the clincher pusher 625 is brought into the state of being unable to move down. Further, the claw 646 extended from the lower end of the clincher pusher 625 to the rear portion (this side of the drawing) is projected to the rear side by passing the slider 639 and the long hole 643 of the slider cover 640.

As shown by FIG. 39, the grounding sensor 647 for detecting grounding of the clincher unit 622 is provided at a left upper portion of the slider cover 640 and the clinch sensor 648 for detecting finishing of clinching is attached to a side of the long hole 643. When the clinch mechanism portion is moved down, the slider 639 is grounded and the slider 639 is moved up relative to the cover frame 619, 620, the claw 642 at the left side face of the slider 649 presses an actuator of the grounding sensor 647 to input a grounding detecting signal to a control circuit (not illustrated). In the clinching operation thereafter, when the clincher pusher 625 is moved down to finish clinching, the claw 646 of the clincher pusher 625 presses an actuator of the clinch sensor 648 to input a clinching finishing signal to the control circuit. Further, when the clinch mechanism portion is moved up to return to the initial position, an initial position detecting sensor 649 fixed to the clincher frame 614 shown in FIG. 37 is pressed by the clinch mechanism portion to switch ON and the control circuit stops the clincher driver motor 613 by the ON signal.

Next, an explanation will be given of the driver portion 604. As shown by FIG. 37, according to the driver portion 604, a single piece of a shaft 650 driven by a driver drive motor (not illustrated) is attached with a driver cam 651 and a forming cam 652 and a staple field cam 653, forming plates (arranged on two left and right sides (front and rear sides to paper face) of a driver 654 although not illustrated in the drawing) and an anvil 655 is driven to move up and down, the driver 654 in a thin plate shape is driven to move up and down by the driver cam 651, and the staple feed cam 653 pivots a link lever 657 via a staple feed cam follower 656. The slider 673 attached with a feed claw 672 is included at an upper portion of the staple cartridge 671, the link lever 657 of the driver portion 604 is engaged with an arm 674 attached to the slider 674 and extended in a left and right direction to drive to reciprocate the arm 674 and the slider 673 in a front and rear direction, and a staple sheet at inside of the staple cartridge 671 is fed to a front side (left side in the drawing) by the feed claw 672.

Operational timings of the driver cam 651 and the forming cam 652 and the staple feed cam 653 in one cycle are set such that first, the staple feed cam follower 656 is moved down from an elevated position which is the initial position, the feed claw 672 of the staple cartridge 671 is moved forward to feed a staple, next, the forming plate is moved up to form a linear staple and successively the driver 654 and the anvil 655 are moved up integrally. In moving up the anvil 655, immediately before an upper dead center, the anvil 655 rides over a projection 659 of an anvil guide 658 to escape to the front side from a path of the driver 654 and the driver 654 is further moved up to finish striking the staple.

An injection detecting sensor 660 and an initial position detecting sensor 661 respectively in shapes of microswitches are arranged below the staple feed cam 653 and the staple feed cam follower 656. The injection detecting sensor 660 below the staple feed cam 653 detects that the driver 654 reaches the upper dead center via the staple feed cam 653. The initial position detecting sensor 661 below the staple feed cam follower 656 detects that the driver 654 reaches a lower dead center (initial position) by bringing back the staple feed cam follower 656 to the upper dead center (initial position).

Figure 43:
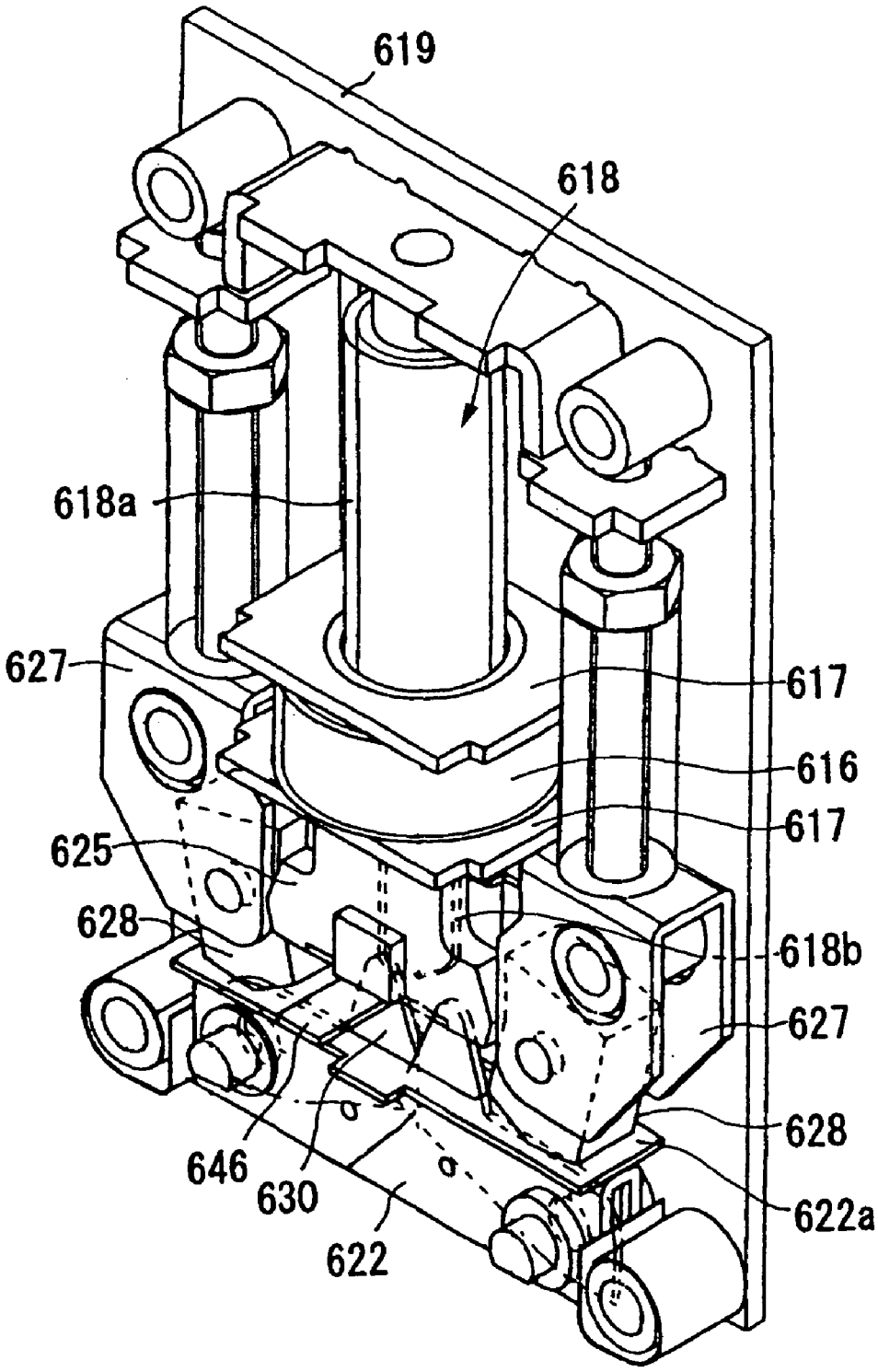
FIG. 43 is a perspective view showing an initial state of the clinch mechanism portion.
Figure 44:
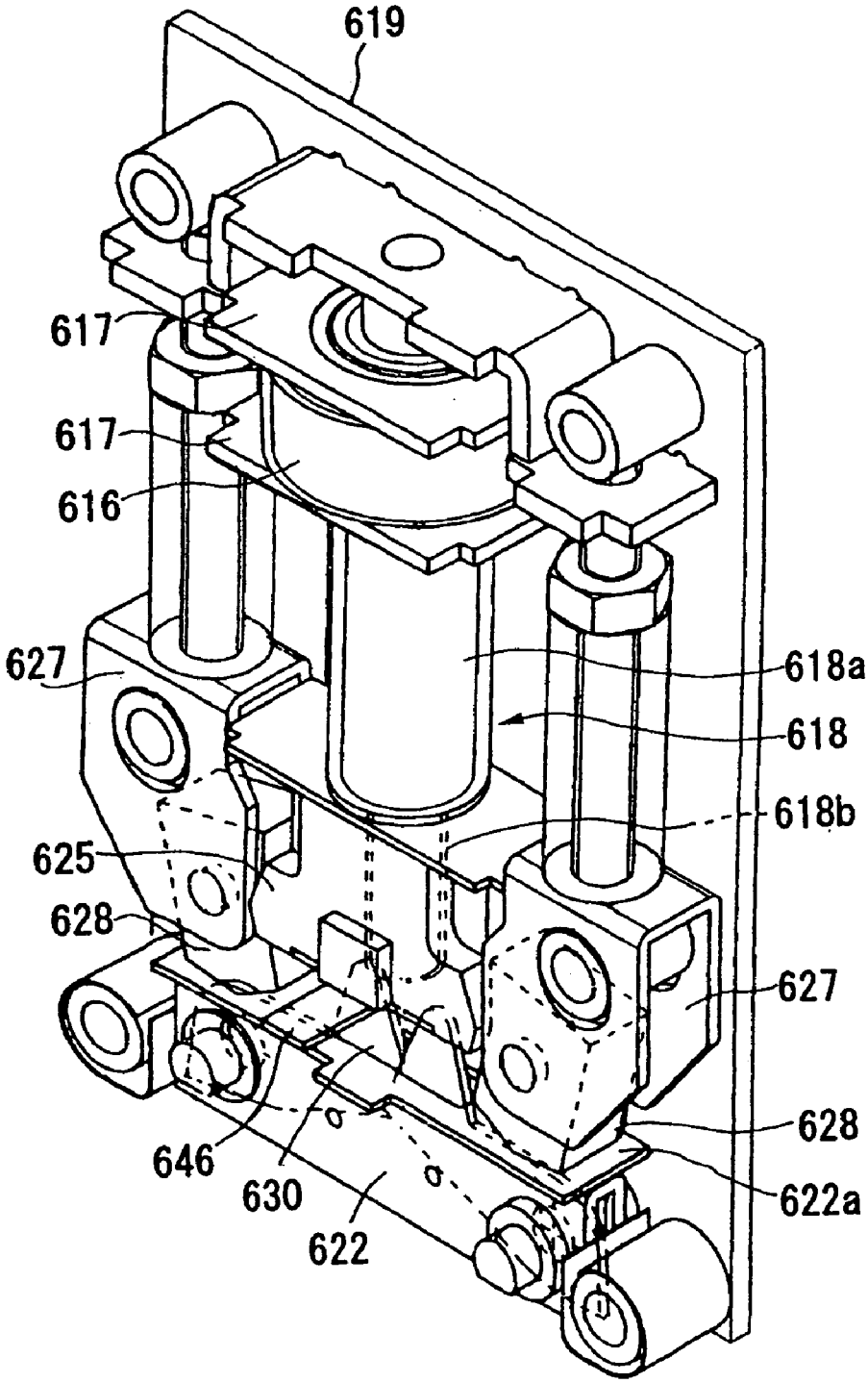
FIG. 44 is a perspective view showing a state of holding paper of the clinch mechanism portion.

Next, an explanation will be given of steps of operating the clincher portion 603 in reference to FIG. 43 through FIG. 47(*b*). FIG. 43 and FIG. 46(*a*) show an initial state, and when a start signal is inputted to the electric stapler from the state, the driver drive motor (not illustrated) and the clincher driver motor 613 are started. At the driver portion 604, the linear staple sheet of the staple cartridge 671 is fed to the front side by the staple feed cam 653 shown in FIG. 37 and the forming plate starts rising to form a front staple in the gate-like shape by being slightly retarded from the staple feeding operation. In the clincher portion 603, the clincher drive motor 613 is rotated to drive to rotate regularly the gear 616 shown in FIG. 43 and FIG. 46(*a*) in the counter-clockwise direction in view from the upper side to move down the total of the clinch mechanism portion. Further, when the slider 639 is grounded on a surface of paper P on the sheet table and is moved up relative to the clinch mechanism portion, the claw 642 at the left side face of the slider 639 shown in FIG. 39 presses the actuator of the grounding sensor 647 to input the grounding detecting signal to the control circuit, the control circuit stops the clincher drive motor 613 and as shown by FIG. 44 and FIG. 46(*b*), the clincher portion stays to be stationary in a state of holding paper by the clincher unit 622.

Figure 47:
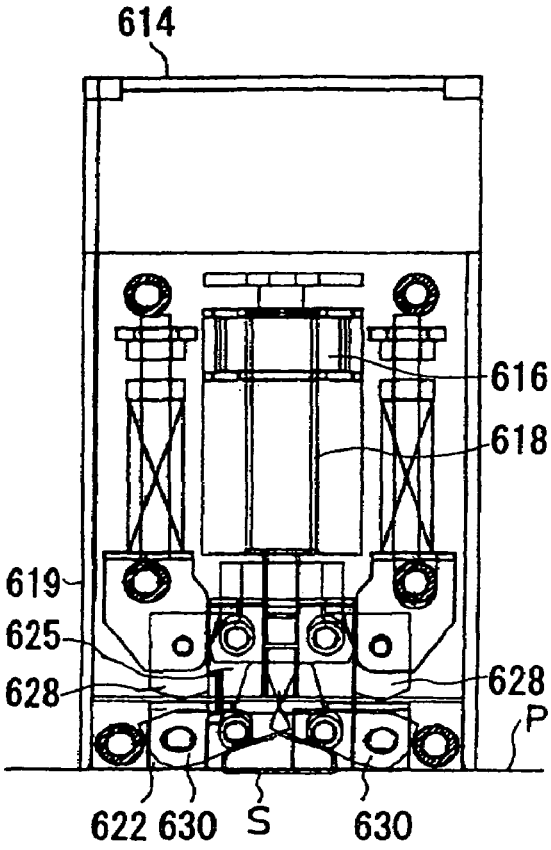
FIG. 47(*a*) and FIG. 47(*b*) show a step of operating the clinch mechanism portion, FIG. 47(*a*) is an explanatory view showing a state in striking a staple and FIG. 17(*b*) is a perspective view showing a state of finishing to clinch.
Figure 47:
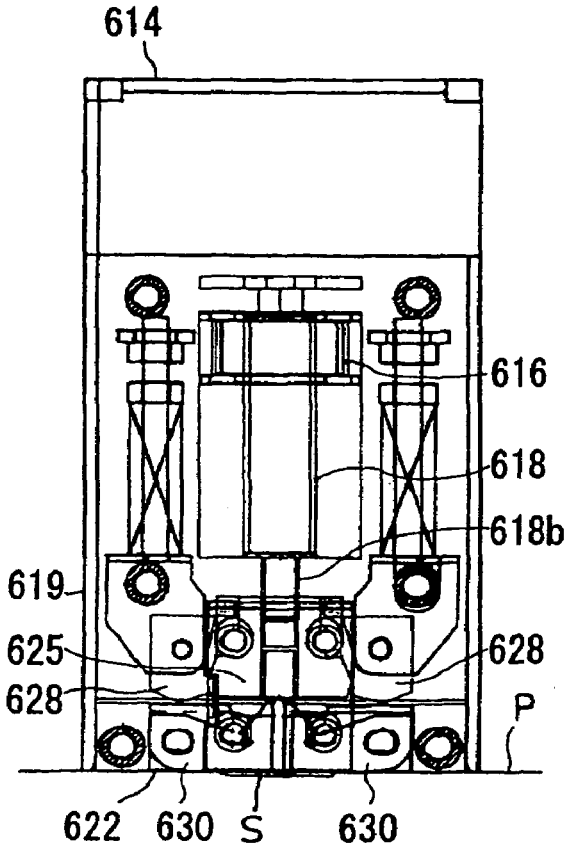

Successively, the staple is injected by the driver 654 of the driver portion 604 on the lower side and as shown by FIG. 47(*a*), the left and right leg portions of the staple penetrating paper P from the lower side impinge on the lower face of the clincher 630 to fold to bend to the inner sides. At a time point of finishing to strike the staple S to the driver 654, the output signal of the injection detecting sensor 660 of the driver portion 604 shown in FIG. 37 is inputted to the control circuit, the control circuit stops the driver driving motor and at the same time, drives to rotate regularly the gear 616 by starting the clincher drive motor 613.

At this occasion, the clinch mechanism portion cannot be moved down since the clinch mechanism portion is brought into contact with paper P on the sheet table, however, different from the initial state in which the claw 641 at the upper end of the slider 639 shown in FIG. 42 is brought between the clincher pusher 625 and the stopper plate 628, the slider 639 is moved up and the claw 641 comes out from between the clincher pusher 625 and the stopper plate 628, the clincher pusher 625 is released from being restricted to move down and therefore, rotation of the gear 616 and the screw shaft 618 is not restricted but is locked to rotate integrally. Thereby, the clincher pusher 625 brought in mesh with the small diameter portion 618*b* of the screw shaft 618 starts moving down by feed operation of the screw shaft 618 to push down the clincher 620 and fold to bend the two leg portions of the staple S to be flat.

Figure 45:
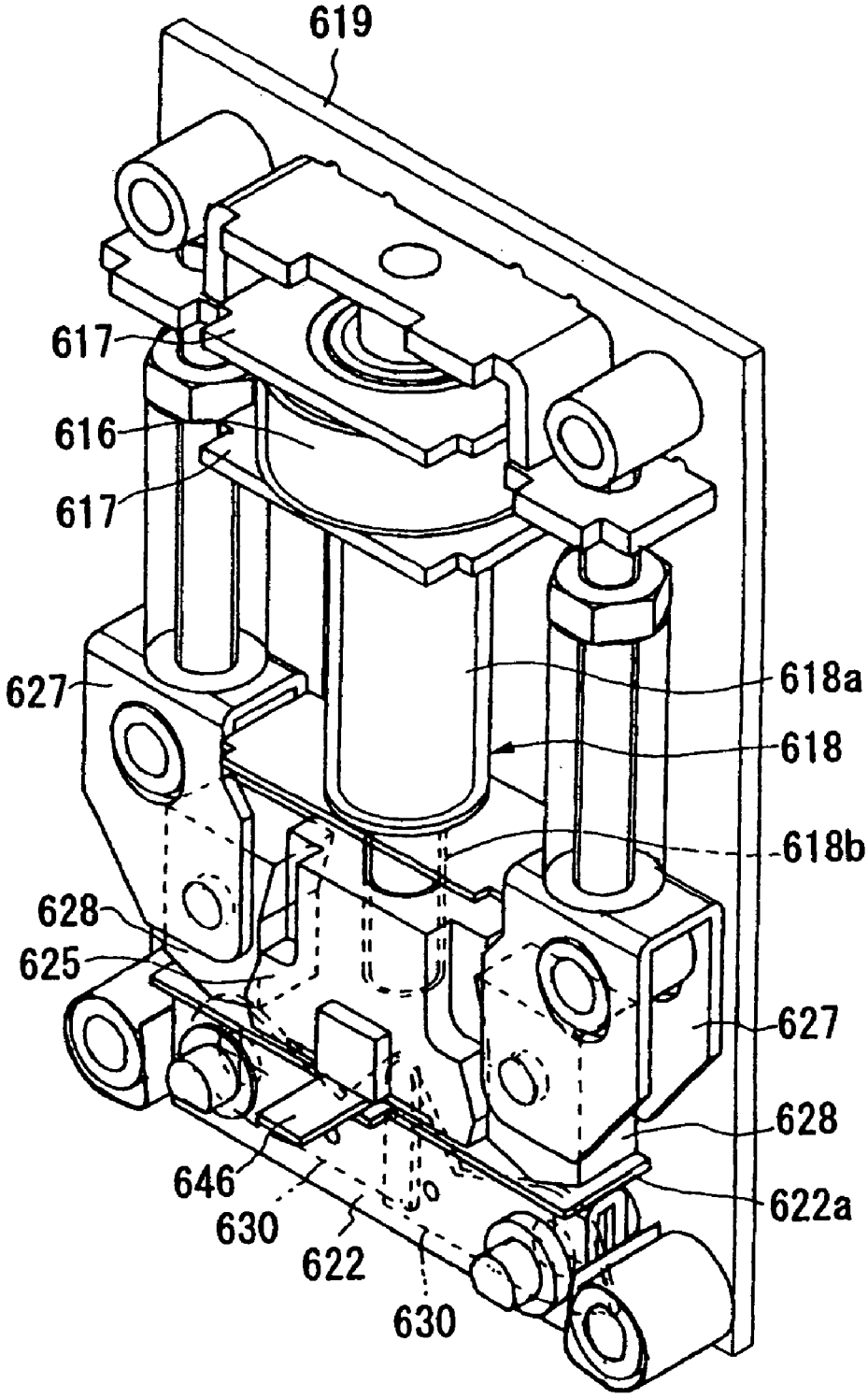
FIG. 45 is a perspective view showing a state of finishing to clinch of the clinch mechanism portion.
Figure 46:
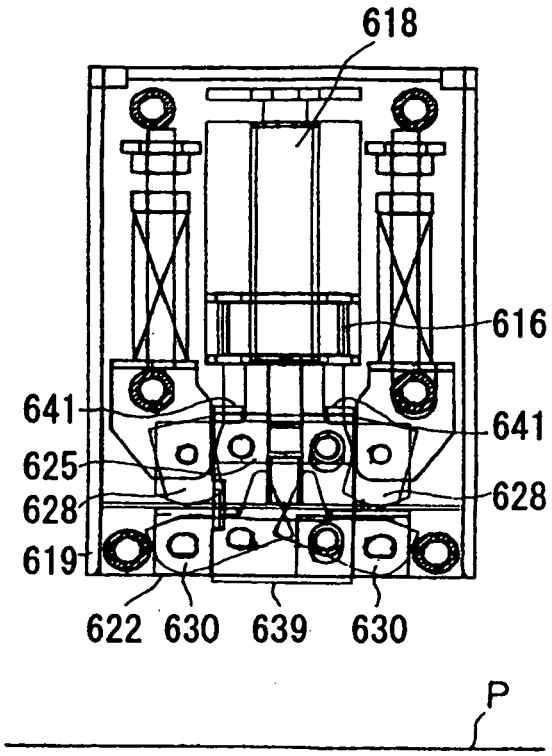
FIG. 46(*a*) and FIG. 46(*b*) show a step of operating the clinch mechanism portion, FIG. 46(*a*) is an explanatory view of an initial state and FIG. 46(*b*) is a perspective view showing the state of holding paper.
Figure 46:
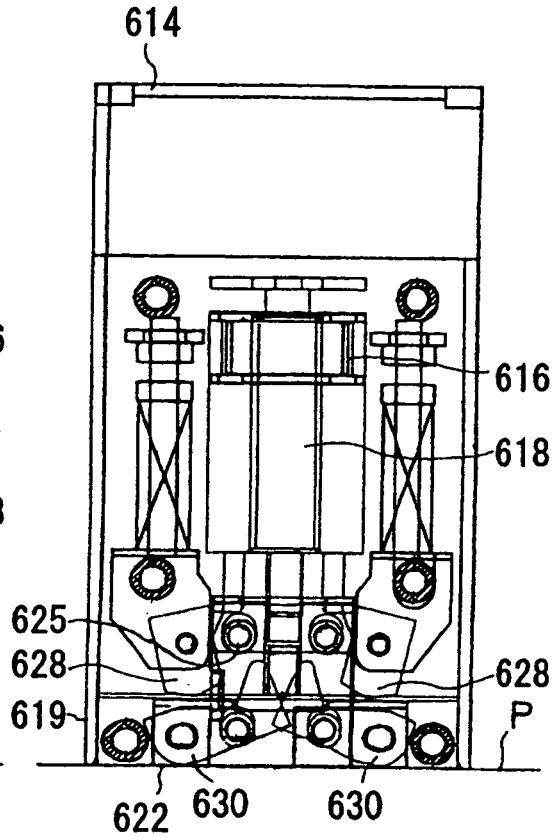

As shown by FIG. 45 and FIG. 47(*b*), when the clincher pusher 625 reaches a lower end portion to finish clinching, the claw 646 at the rear face of the clincher pusher 652 presses the actuator of the clincher sensor 648 shown in FIG. 39 to input the clinching finishing signal to the control circuit, thereby, the control circuit drives to rotate regularly the driver driving motor and drive to rotate the clincher driver motor 613 reversely. In the clincher portion 603, by reversely rotating the gear 616, the clincher pusher 625 is pulled up along the small diameter portion 618*b* of the screw shaft 618 and a total of the clinch mechanism portion is pulled up to reach the upper initial position, which is detected by the initial position sensor 649 of the clincher portion 603 shown in FIG. 37 to thereby stop the clincher driver motor 613. Further, in the driver portion 604, by returning the staple feed cam follower 656 to the upper dead center (initial position) by rotating the shaft 650 of the cam shown in FIG. 37 by one rotation from the initial position, an initial position recovery signal is outputted from the initial position detecting sensor 661 and the control circuit stops the driver drive motor to thereby finish operation of one cycle.

Figure 48:
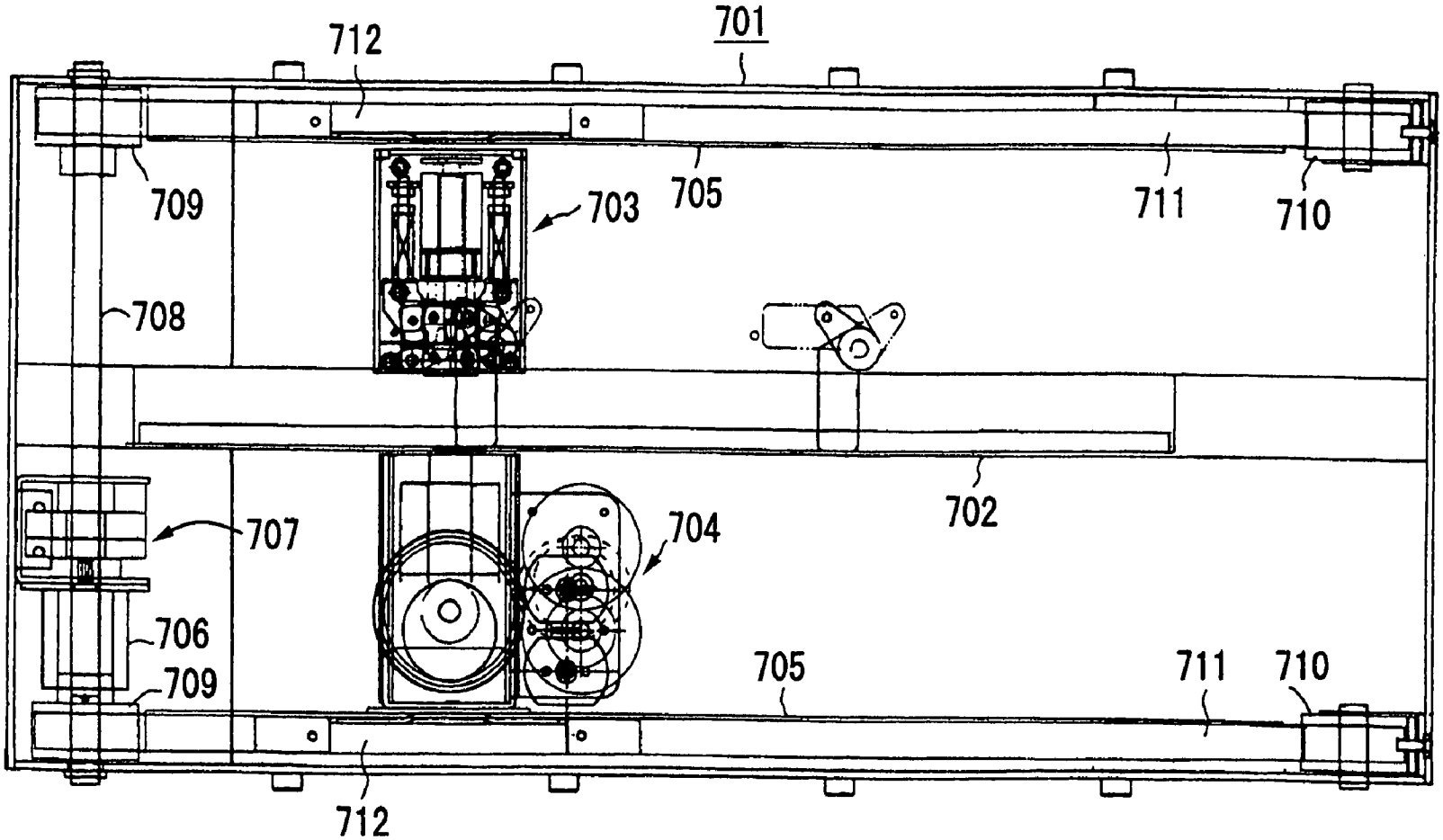
FIG. 48 is a front view of an electric stapler.
Figure 49:
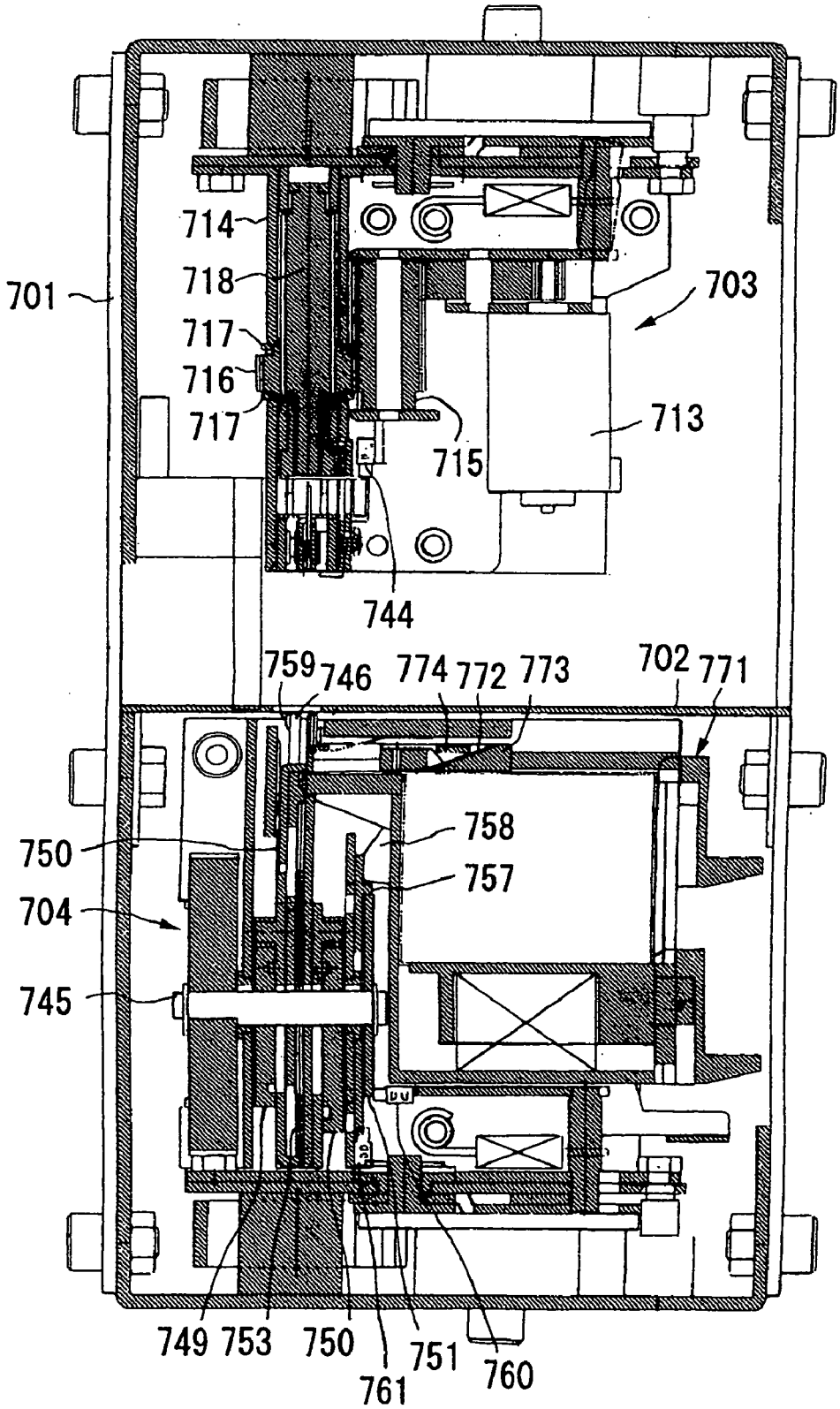
FIG. 49 is aside sectional view of the electric stapler.
Figure 50:
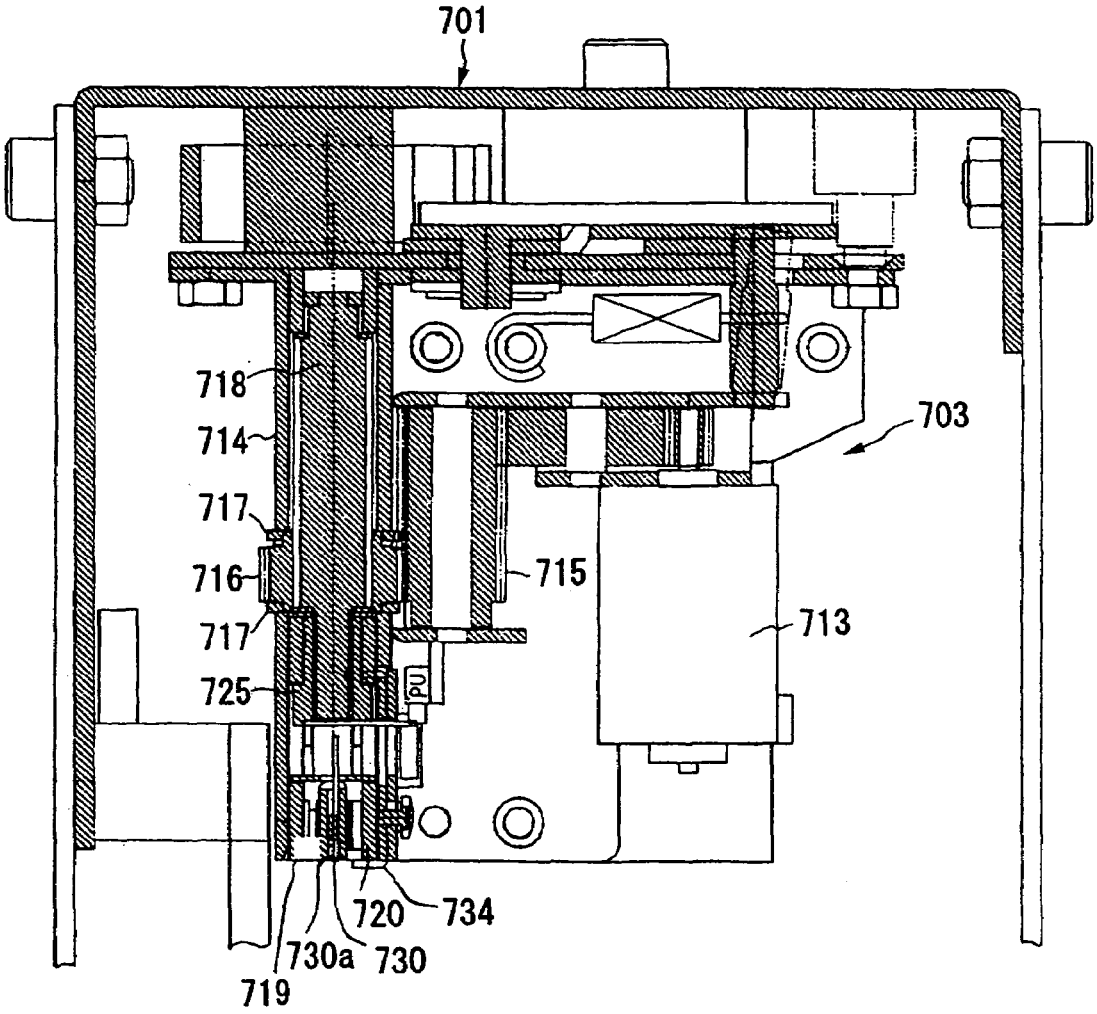
FIG. 50 is a side sectional view of a clincher unit.

Next, a detailed description will be given of a seventh embodiment of the invention in reference to the drawing. FIG. 48 is a front view of an electric stapler, FIG. 49 is a side sectional view, and FIG. 50 is a view enlarging an upper half portion of FIG. 49. In FIG. 48, numeral 701 designates the frame, numeral 702 designates the sheet table made to span a middle portion in an up and down direction of the frame 701, the clincher unit 703 is arranged on a upper side of the sheet table 702, the driver unit 704 is arranged on a lower side of the sheet table 702, and the clincher unit 703 and the driver unit 704 are respectively engaged with linear guides 705 provided at a ceiling face and an inner bottom face of the frame 701.

A left end portion of the 701 is arranged with a motor 706 for moving the stapler for driving a vertical drive shaft 708 via a reduction gear 707. Gear pulleys 709 are attached to two upper and lower end portions of the vertical drive shaft 708, both ends of a timing belt 711 hung around the gear pulley 709 on the upper side and a driven gear pulley 710 arranged at an upper portion of a right end of the frame 701 stay to be attached to a slide base 712 supporting the clincher unit 703. Similarly, both ends of a timing belt 711 hung around the gear pulley 709 on the lower side of the vertical drive shaft 708 and a driven gear pulley 710 arranged at a lower portion of the right end of the frame 701 stay to be attached to a slide base 712 supporting the driver unit 704 to thereby constitute a stapler moving mechanism for traveling the clincher unit 703 and the driver unit 704 in synchronism with each other.

Next, an explanation will be given of a constitution of the clincher unit 703 in reference to FIG. 50 through FIG. 52. As shown by FIG. 50, the clincher drive motor 713 is arranged upwardly at a rear portion of the clincher frame 714 for driving to rotate the gear 716 at a final stage via a middle gear 715. The gear 716 in a spur gear shape is supported at the gear holder 717 fixed to the clincher frame 714 at two upper and lower faces thereof and the screw shaft 718 is screwed to a screw hole formed at a center thereof.

Figure 51:
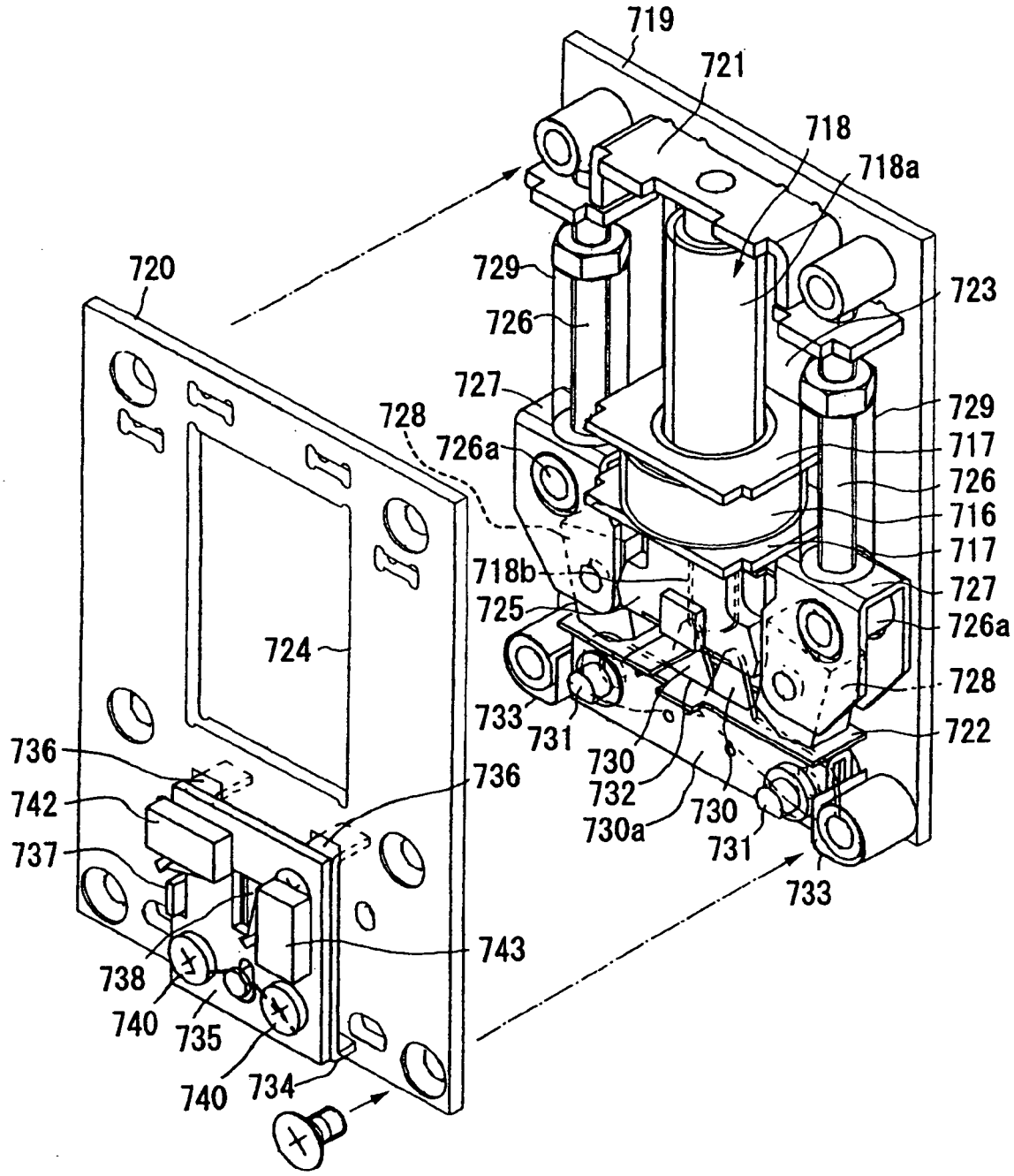
FIG. 51 is a disassembled perspective view of a clinch mechanism portion.

FIG. 51 is a disassembled view showing a lifting type clinch mechanism portion of the clincher unit from a rear side (right side of FIG. 50) and a cabinet of the clinch mechanism portion is constituted by the front and rear cover frames 719, 720 and an upper support frame 721. Numeral 722 designates the support plate integrated to the cover frames 719, 720 to be able to move in an up and down direction by a small amount. Vertically long square holes 723 and 724 are formed at upper half portions of the front and rear cover frames 719, 720, a gear 716 is brought in mesh with the middle gear 715 shown in FIG. 50 via the square hole 724 of the rear side cover frame 720, and when the gear 716 is rotated in the counterclockwise direction in view from an upper side, in FIG. 51, portions other than the gear 716 and the gear holder 717 in FIG. 51 are integrally moved down and contrary thereto, when the gear 716 is rotated in the clockwise direction, the portions are moved up.

The screw shaft 718 is a stepped male screw comprising a large diameter screw portion 718*a* at an upper portion thereof and a small diameter screw portion 718*b* at a lower portion thereof and a small diameter screw portion 718*b* is screwed to a screw hole formed at the clincher pusher 725. Fixed screw shafts 726 are vertically arranged on the left and on the right of the center screw shaft 718, a stopper holder 727 is attached to a horizontal shaft portion 726*a* attached to a lower end portion of the fixed screw shaft 726 in a front and rear direction, a stopper holder 727 is attached with the stopper plate 728 pivotably in a left and right direction. The stopper holder 727 is attached to the horizontal shaft portion 726*a* of the fixed screw shaft 726 slidably in an up and down direction and is pressed down to a lower side by a compression coil spring 729 mounted to the fixed screw shaft 726.

A lower face of the stopper plate 728 is constituted by a shape of a mountain and is brought into contact with the support plate 722. In an initial state in which the clincher pushers 725 are moved up, there is brought about the state in which the clincher pushers 725 impinge on upper side faces of the left and right stopper plates 728 to push to widen to outer sides and lower portions of the stopper plates 728 are pivoted to inner sides to be proximate to each other. Although a detailed explanation of operation will be described later, when the clincher pushers 725 are moved down, the clincher pushers 725 are brought into contact with the side faces on inner sides of the stopper plates 728 to push to widen the left and right stopper plates 728 to outer sides, the stopper holders 728 are moved up by compressing the compression coil springs 729 and at the same time, the stopper plates 728 press the support plates 722 and the clincher holders 730*a* to the lower side. The support plate 722*a* and the clincher holder 730*a* are brought into face contact with each other and the pressed clincher holder 730*a* is firmly fixed without being shifted in the front and rear direction.

The clincher holder 730*a* is integrated with the pair of left and right clinchers 730. The clinchers 730 are lever type members axially attached respectively to shafts 731 which are integrated in a state in which front end portions thereof are overlapped and intersected and projected portions formed at upper faces of the front end portions are projected to the upper side by passing holes 732 of the support plates 722. The left and right clinchers 730 are urged in an upper direction by leaf springs 733 respectively arranged on outer sides of the shafts 731, the clincher pushers 725 are moved down to press down the left and right clinchers 730 and leg portions of a staple is folded to bend to be flat by the clinchers 730. Further, when the clincher pushers 725 are moved up, the front end portions of the clinchers 730 are moved up to return to initial positions by spring force of the leaf springs 733.

A lower portion of the rear side cover frame 720 is attached with the slider 734 for detecting grounding of the clinch mechanism portion and the slider cover 735. As shown by FIG. 52, the slider 734 is provided with claws 736, 737 at an upper portion and a left side face thereof, a long hole 738 which is long in an up and down direction is formed at a center of a vertical face thereof, guide holes 739 are formed at four locations in the up and down direction and in the left and right direction, as shown by FIG. 51, the upper end claws 736 are inserted into holes of the rear side cover frame 720, the slider cover attaching screw 740 is fastened to the rear side cover frame 720 by passing the guide hole 739 of the slider 734, thereby, the slider cover 735 is fixed and the slider 734 is held in a state of being slidable in the up and down direction. Further, when the slider 734 is moved down to dispose at an initial position, as shown by FIG. 52, the upper end claw 736 of the slider 734 is brought between the clincher pusher 725 and the stopper plate 728, under the state, the clincher pusher 725 cannot expand to open the stopper plate 728 by moving down and the clincher pusher 725 is brought into a state of being unable to move down.

A claw 741 extended from a lower end of the clincher pusher 725 to a rear side (this side in the drawing) is projected to the rear side by passing the slider 734 and the long hole 738 of the slider cover 735. A left upper portion of the slider cover 735 is provided with the grounding sensor 742 for detecting grounding of the front and rear cover frames 719, 720 and a side of the long hole 738 is attached with the clinch sensor 743 for detecting finishing of clinching a staple. When the clinch mechanism portion is moved down and the slider 734 is grounded and is moved up relative to the clinch mechanism portion, a claw 737 of a left side face of the slider 734 presses an actuator of the grounding sensor 742 to input a grounding detecting signal to a control circuit (not illustrated). When clinching has been finished by moving down the clincher pusher 725 in clinching operation thereafter, the claw 741 of the clincher pusher 725 pushes an actuator of the clinch sensor 743 to input a clinch finish signal to the control circuit. Further, when the clinch mechanism portion is moved up to return to the initial position, the initial position detecting sensor 744 fixed to the clincher frame 714 shown in FIG. 49 is pressed by the claw 741 to switch to ON and the control circuit stops the clincher drive motor 713 by detecting the ON signal.

Figure 53:
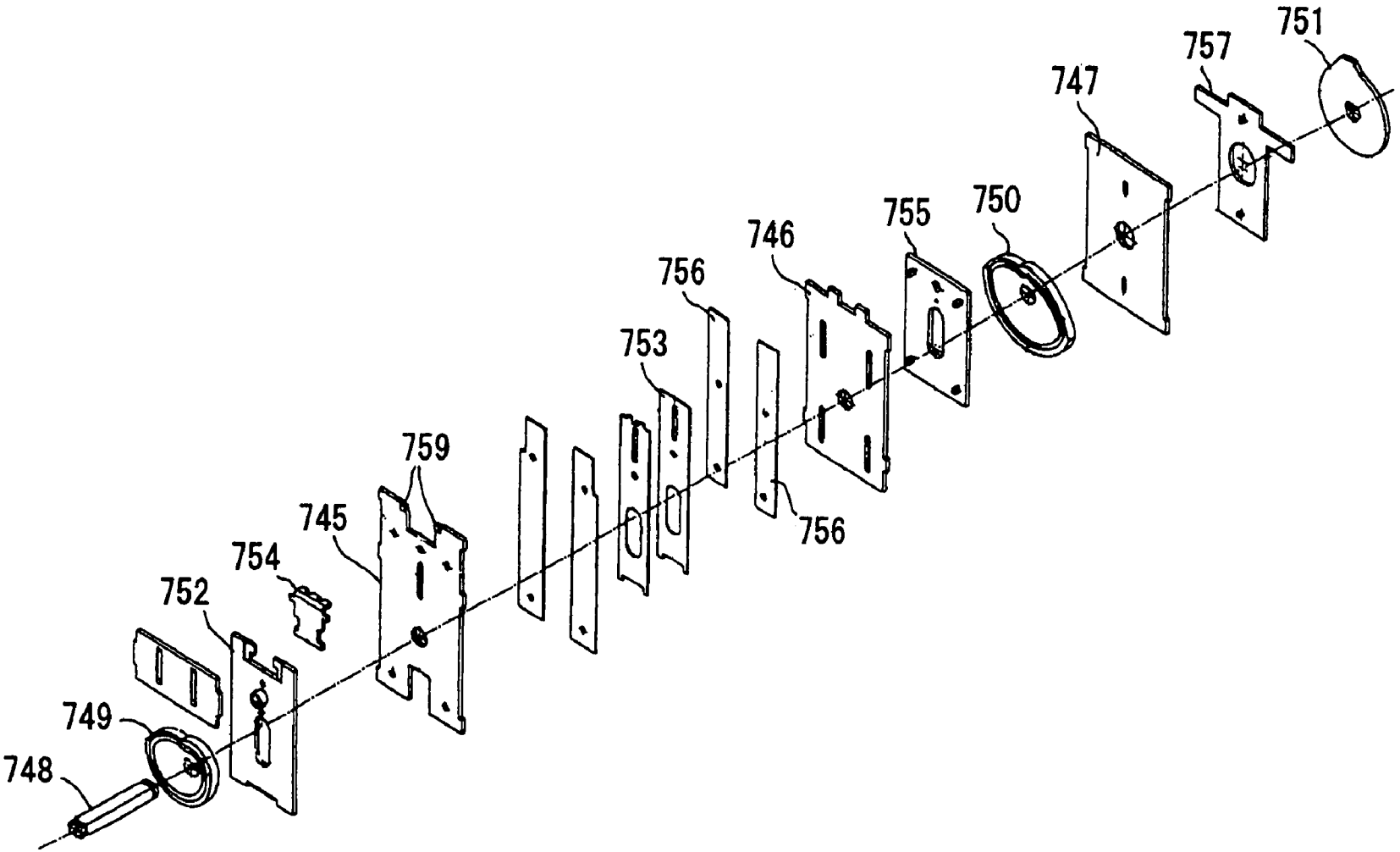
FIG. 53 is an assembled view showing a constitution of parts of a driver unit.

Next, an explanation will be given of a driver unit 74. FIG. 53 shows a constitution of parts of a driver mechanism portion, numerals 745, 746, 747 designate guide plates fixed to the frame of the driver unit 4, and numeral 748 designates a shaft driven by a driver drive motor (not illustrated). The shaft 748 is attached with a driver cam 749 and a forming cam 750 and a staple feed cam 751. The driver cam 749 drives to move up and down a driver 753 in a thin plate shape and an anvil 754 via the drive cam follower 752, the forming cam 750 drives to move up and down forming plates 756 (arranged on two left and right sides of the driver 749) via a forming cam follower 755, and the staple feed cam 751 pivot a link lever 758 shown in FIG. 54 via the staple cam follower 757.

Figure 54:
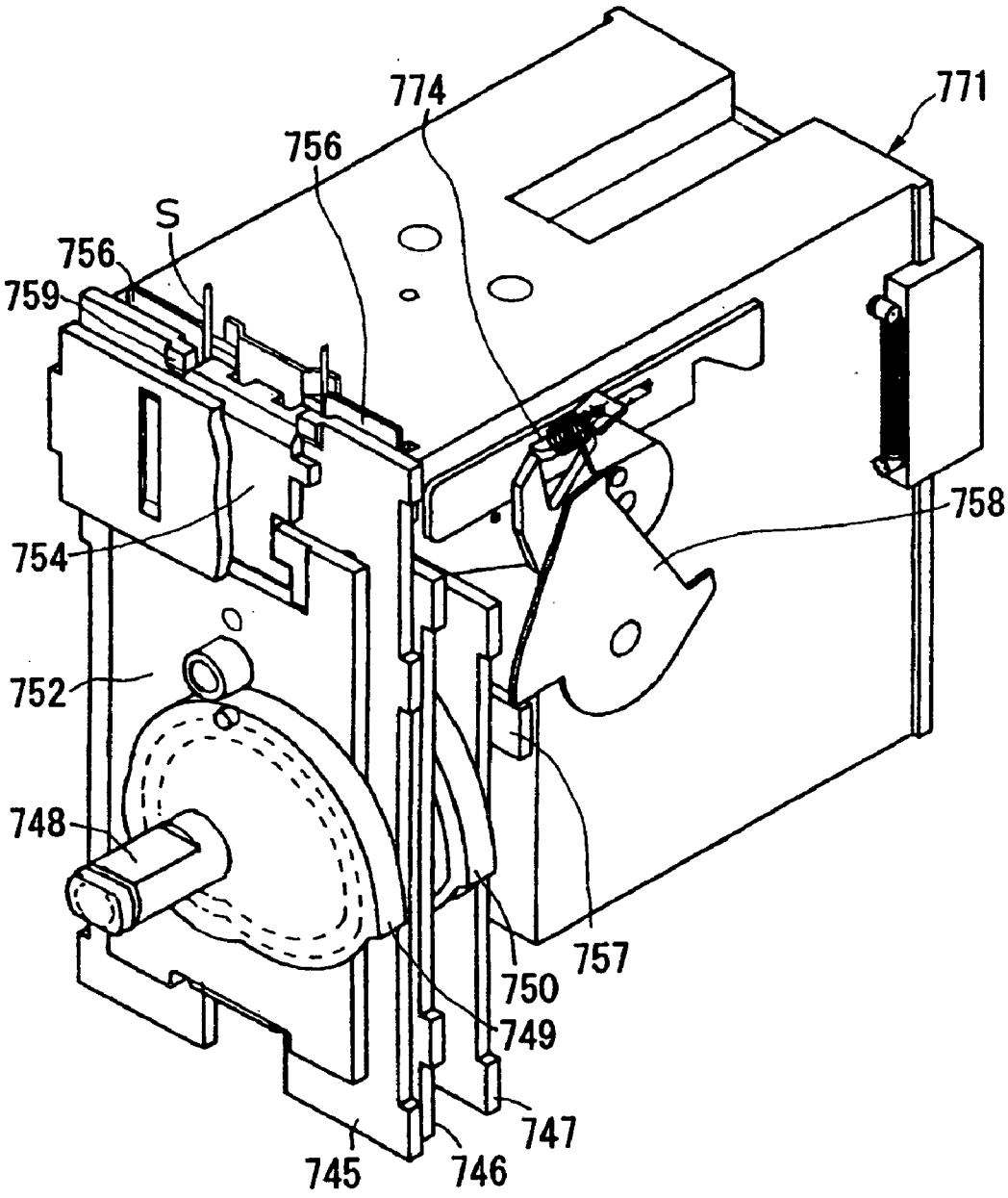
FIG. 54 is a perspective view showing the driver unit and the staple cartridge.

As shown by FIG. 54, an upper portion of the staple cartridge 771 includes a slider 773 attached with a feed claw 772, the link lever 758 of the driver unit 704 is engaged with an arm 774 attached to the slider 773 and extended in a left and right direction to drive to reciprocate the arm 774 and the slider 774 in the front and rear direction and a staple sheet at inside of the staple cartridge 771 is fed to a front side (left side in the drawing) by the feed claw 772.

Operational timings of one cycle of the driver cam 749 and the forming cam 750 and the staple feed cam 751 are set such that first, the link lever 758 is pivoted to the front side by moving down the staple feed cam follower 757 from an elevated position which is an initial position, thereby, the feed claw 772 of the staple cartridge 771 is moved forward to feed a staple. Next, the forming plates 756 are moved to form a linear staple in a channel-like shape, and successively, the anvil 754 and the driver 753 are integrally moved up and at this occasion, the anvil 754 rides over an upper projection of the guide plate 745 shown in FIG. 54 immediately before an upper dead center to escape to the front side from a path of the driver 753, and the driver 753 is further moved up to finish striking the staple.

As shown by FIG. 49, an injection detecting sensor 760 and an initial position detecting sensor 761 in shapes of microswitches are respectively arranged below the staple feed cam 751 and the staple feed cam follower 757. The injection detecting sensor 760 detects that the driver 753 reaches an upper dead center via the staple feed cam 751. The initial position detecting sensor 761 below the staple feed cam follower 757 detects that the driver 753 reaches a lower dead center (initial position) by returning the staple feed cam follower 757 to an upper dead center (initial position).

Figure 55:
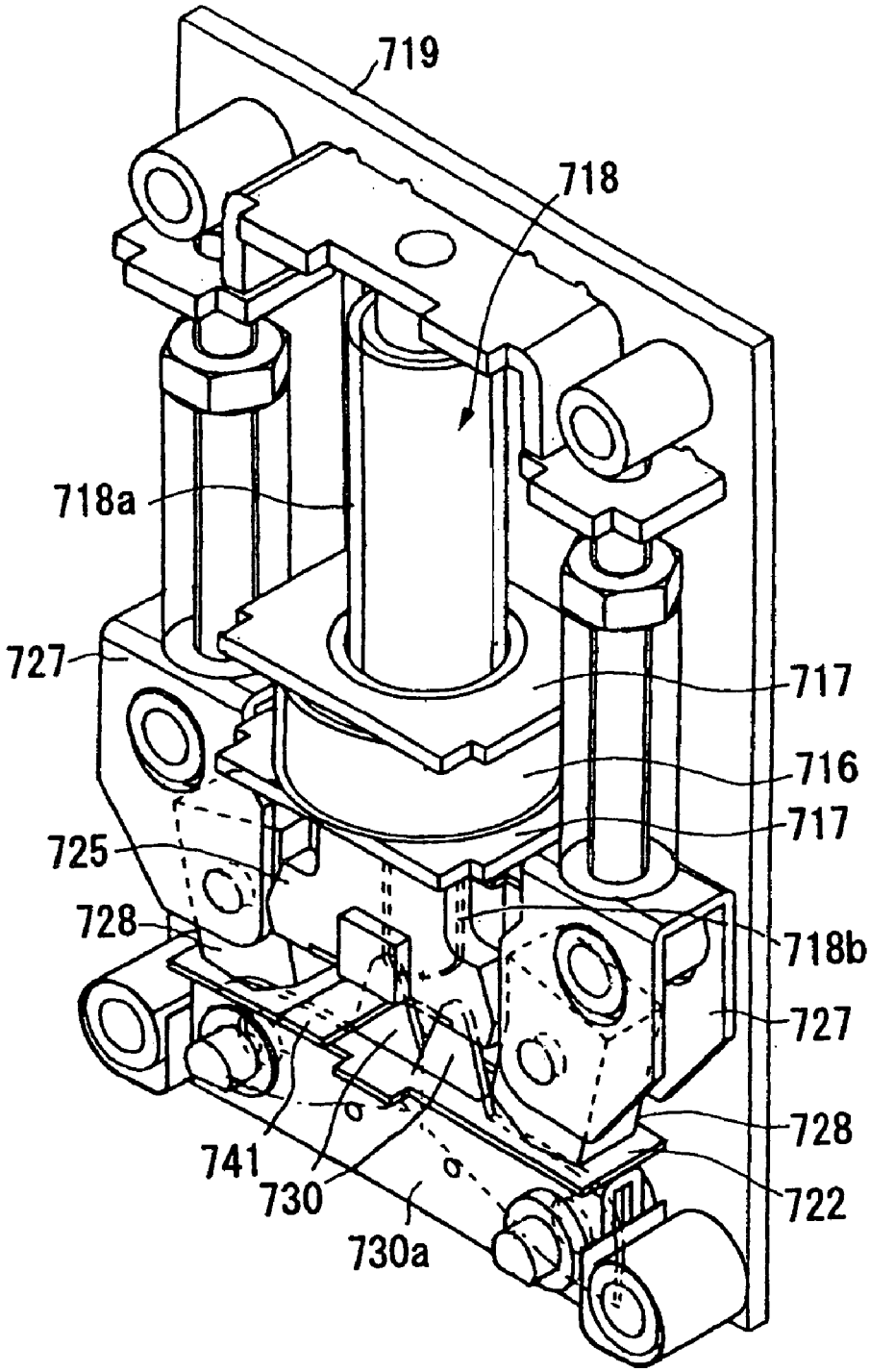
FIG. 55 is a perspective view showing an initial state of a clinch mechanism portion.
Figure 56:
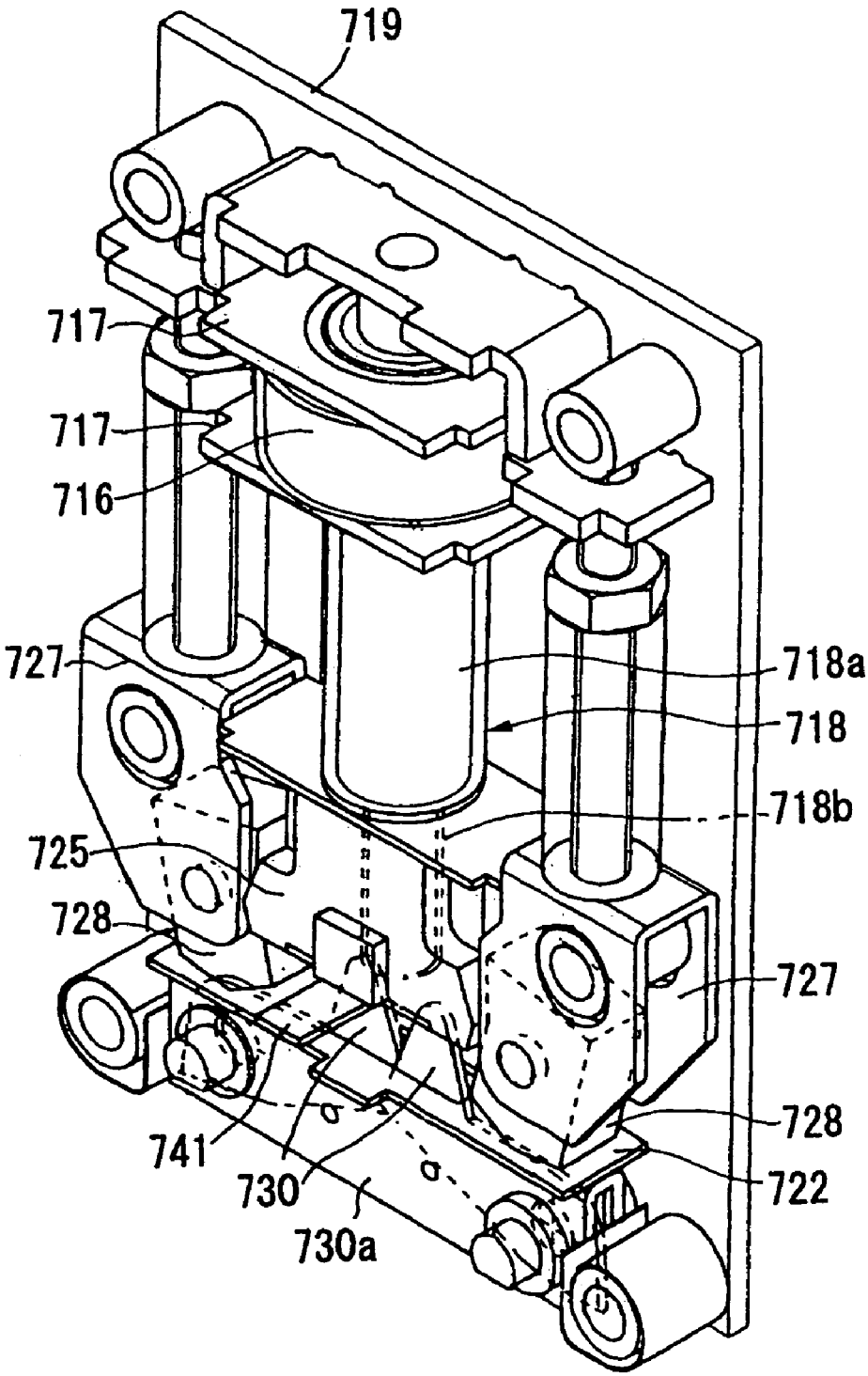
FIG. 56 is a perspective view showing a state of holding paper of the clinch mechanism portion.

Next, an explanation will be given of steps of operating the clincher unit 703 in reference to FIG. 55 through FIG. 58(*b*). FIG. 55 and FIG. 58(*a*) show an initial state and when a start signal is inputted to the electric stapler from the state, the driver drive motor (not illustrated) and the clincher drive motor 713 are started. In the driver unit 704, the linear staple sheet of the staple cartridge 771 is fed to the front side by the staple feed cam 751 shown in FIG. 53, the forming plates start rising by being retarded slightly from the staple feeding operation to form a front staple in a gate-like shape. In the clincher unit 703, the clincher drive motor 713 is rotated to drive to rotate regularly the gear 716 shown in FIG. 55 and FIG. 58(*a*) in the counterclockwise direction in view from the upper side to move down a total of the clinch mechanism portion. Further, when the slider 734 is grounded to a surface of paper P on the sheet table and is moved up relative to the clinch mechanism portion, the claw 737 at a left side face of the slider 734 shown in FIG. 51 presses the actuator of the grounding sensor 742 to input the grounding detecting signal to the control circuit, and the control circuit stops the clincher drive motor and becomes stationary in a state of pressing paper by the front and rear cover frames 719, 720 as shown by FIG. 76 and FIG. 58(*b*).

Figure 59:
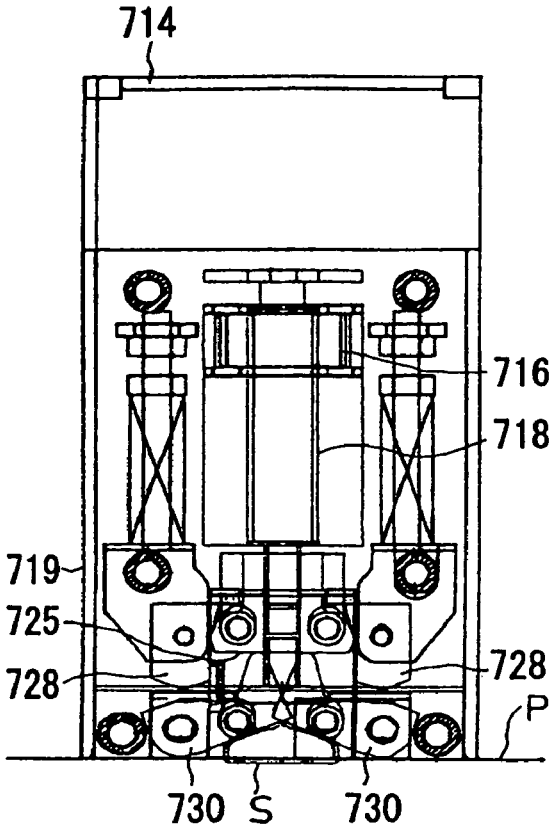
FIG. 59(*a*) and FIG. 59(*b*) show a step of operating the clinch mechanism portion, FIG. 59(*a*) is an explanatory view showing a state in striking a staple and FIG. 59(*b*) is a perspective view showing a state of finishing to clinch.
Figure 59:
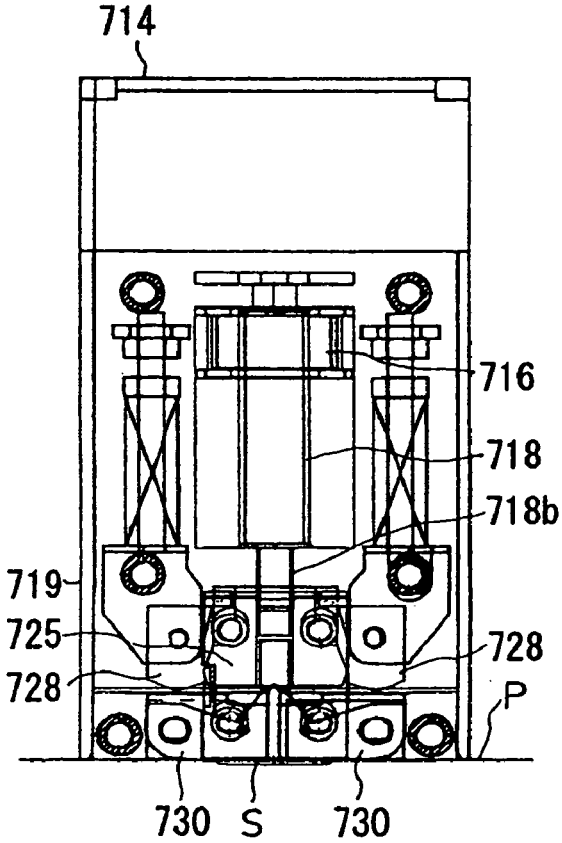

Successively, the staple is injected by the driver 753 of the driver unit 704 on the lower side and as shown by FIG. 59(*a*), left and right leg portions of the staple S penetrating paper P on the lower side impinge on the lower face of the clincher 730 to fold to bend to inner sides. At a time point of finishing to strike the staple S by the driver 753, an output signal of the injection detecting sensor 760 of the driver unit 704 is inputted to the control circuit, the control circuit stops the driver drive motor and simultaneously drives to rotate the clincher drive motor 713 reversely in a short period of time (several mSec) to alleviate a thrust pressure applied to the screw shaft 718 and the clincher pusher 725 from the staple S via the clincher 730 to make the screw shaft 718 rotatable and thereafter drives to rotate the gear 716 regularly.

Figure 52:
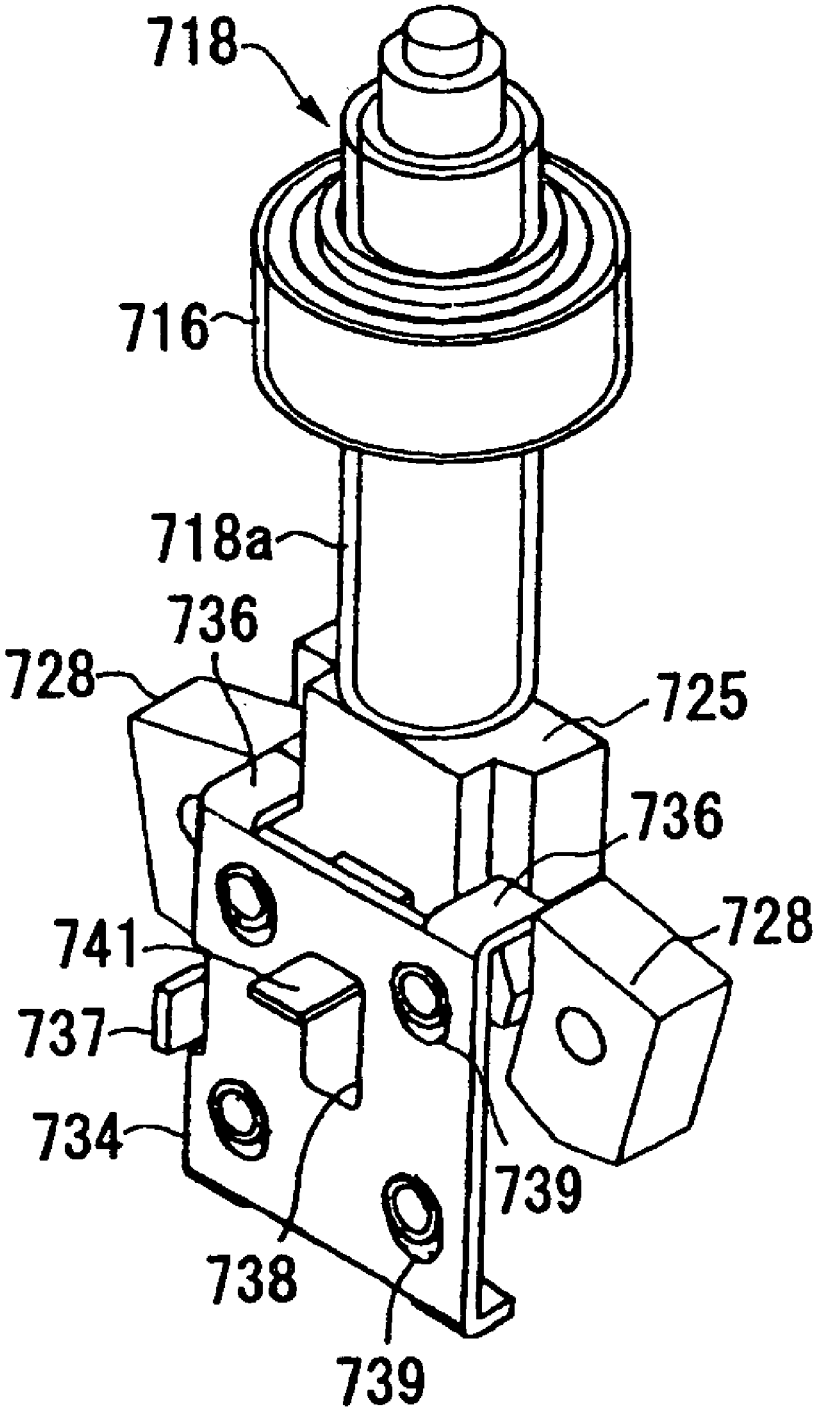
FIG. 52 is a perspective view of a screw shaft and a clincher pusher.

At this occasion, although the clinch mechanism portion cannot be moved down since the clincher mechanism portion is brought into contact with paper P on the sheet table, different from the initial state in which the upper end claw 736 of the slider 734 shown in FIG. 52 is brought between the clincher pusher 725 and the stopper plate 728, the slider 734 is moved up and the claw 736 comes out from between the clincher pusher 725 and the stopper plate 728 and the clincher pusher 725 is released from being restricted from moving down and therefore, a gear 716 and the screw shaft 718 are locked and rotated integrally without restricting rotation thereof. Thereby, the clincher pusher 725 brought in mesh with the small diameter portion 718*b* of the screw shaft 718 starts moving down by feed operation of the screw shaft 718 to press down the clincher 730 to fold to bend the two leg portions of the staple S to be flat.

Figure 57:
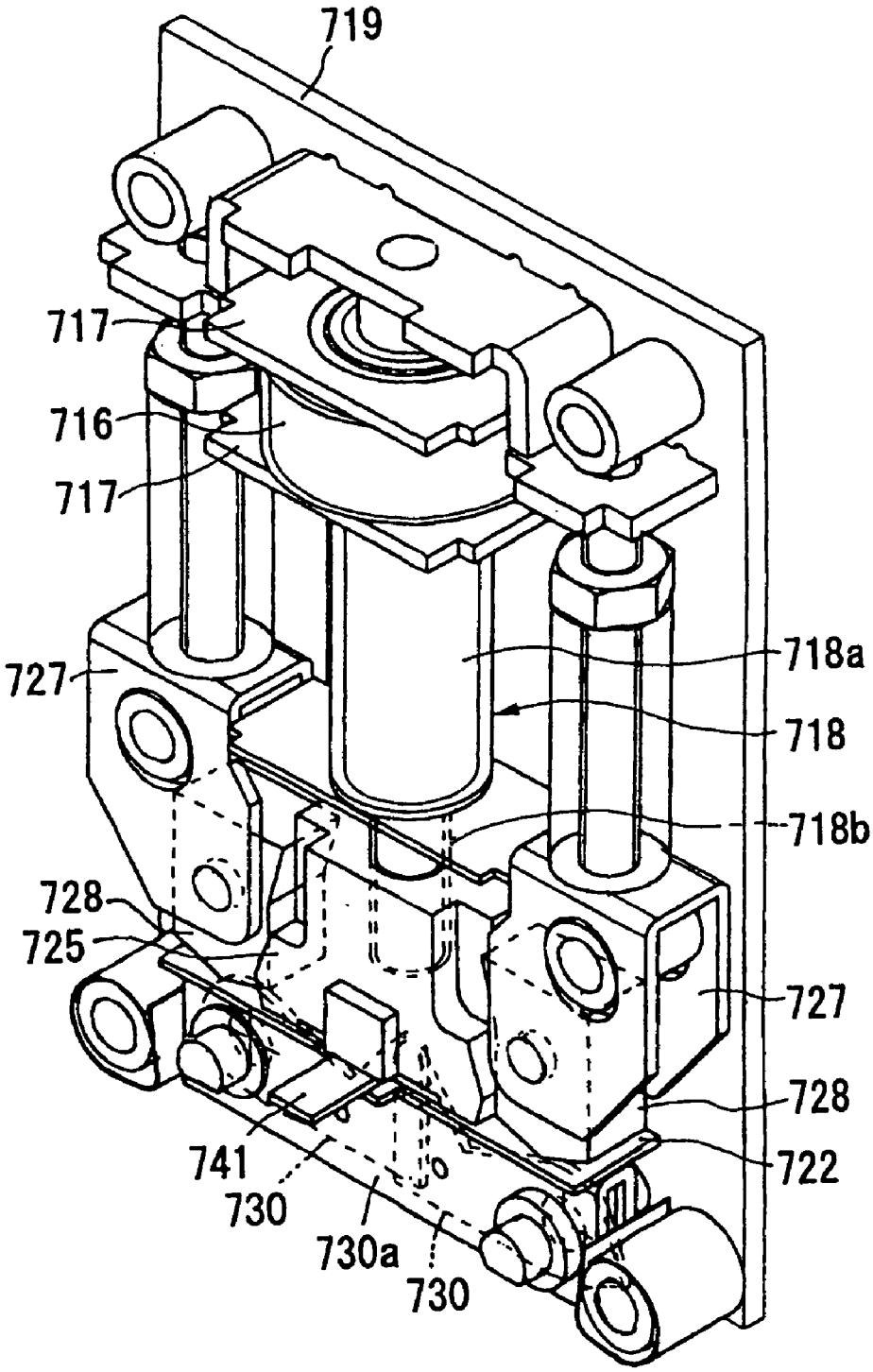
FIG. 57 is a perspective view showing a state of finishing to clinch of the clinch mechanism portion.
Figure 58:
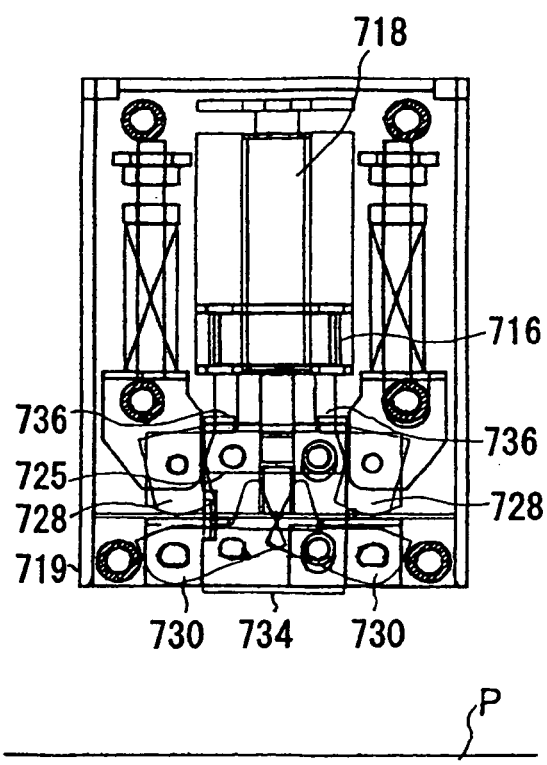
FIG. 58(*a*) and FIG. 58(*b*) show a step of operating the clinch mechanism portion, FIG. 58(*a*) is an explanatory view of an initial state and FIG. 58(*b*) is a perspective view showing a state of holding paper.
Figure 58:
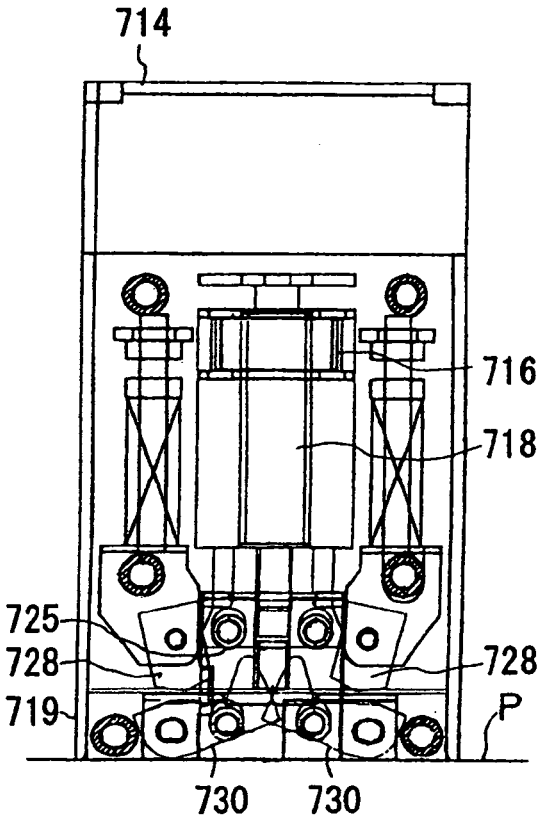

When the clincher pusher 725 reaches a lower end position to finish clinching as shown by FIG. 57 and FIG. 59(*b*), a claw 741 on a rear face of the clincher pusher 725 presses an actuator of the clinch sensor 743 to input a clinch finish signal to the control circuit, the control circuit drives to rotate regularly the driver drive motor and drives to rotate reversely the clincher drive motor 713. In the clincher unit 703, by rotating the gear 716 reversely, the clincher pusher 725 is pulled up along the small diameter portion 718*b* of the screw shaft 718 and a total of the clinch mechanism portion is pulled up to reach the upper initial position and the clincher drive motor 713 is stopped by pressing the initial position sensor 744 shown in FIG. 49 by the claw 741 shown in FIG. 52. Further, in the driver unit 704, an initial position return signal is outputted from the initial position detecting sensor 761 by returning the staple feed cam follower 757 to the upper dead center (initial position) by rotating the cam shaft 748 shown in FIG. 49 from the initial position and the control circuit stops the driver drive motor to thereby finish one cycle operation.

Figure 60:
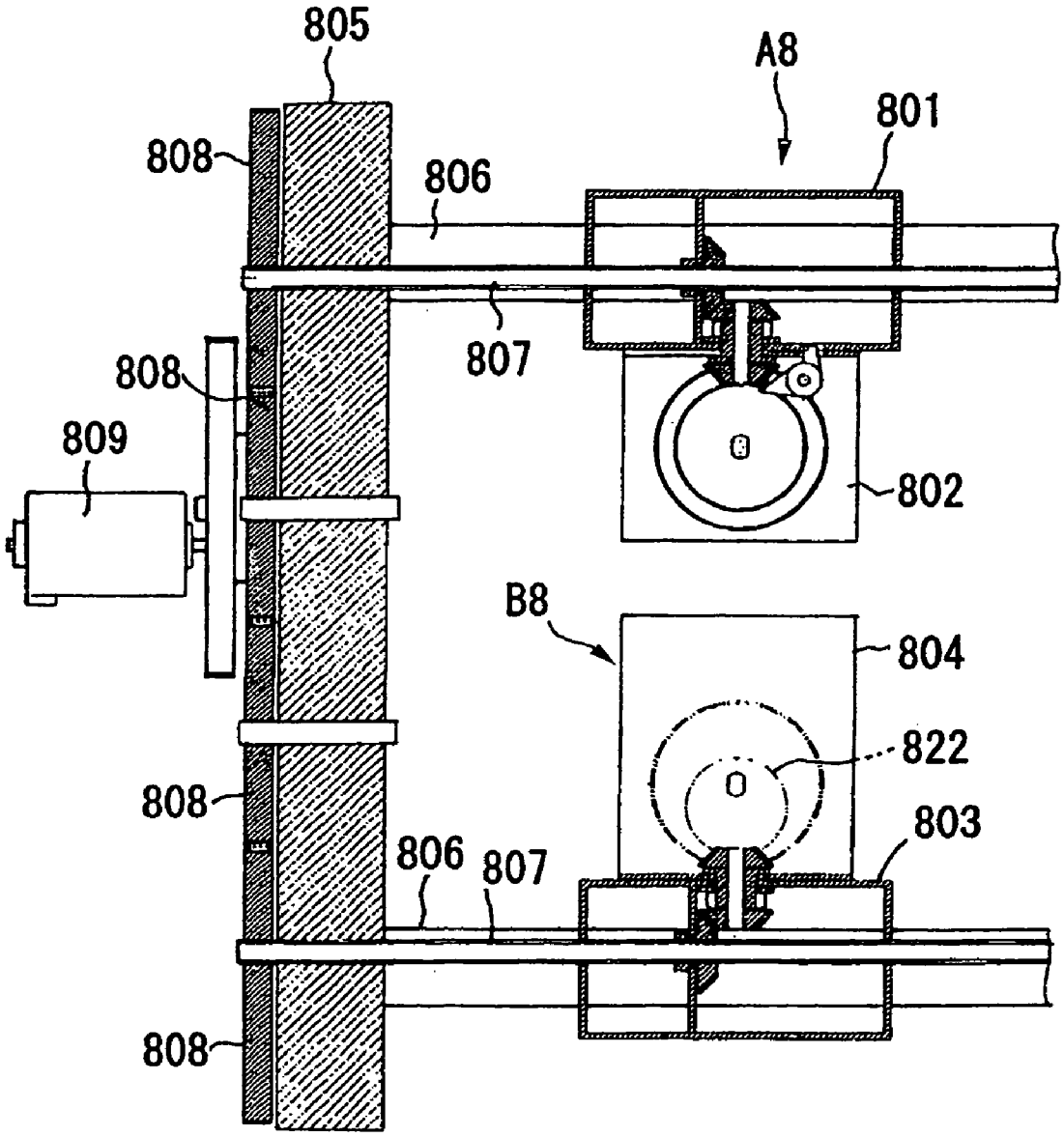
FIG. 60 is a front sectional view of an electric stapler showing an embodiment of the invention.
Figure 61:
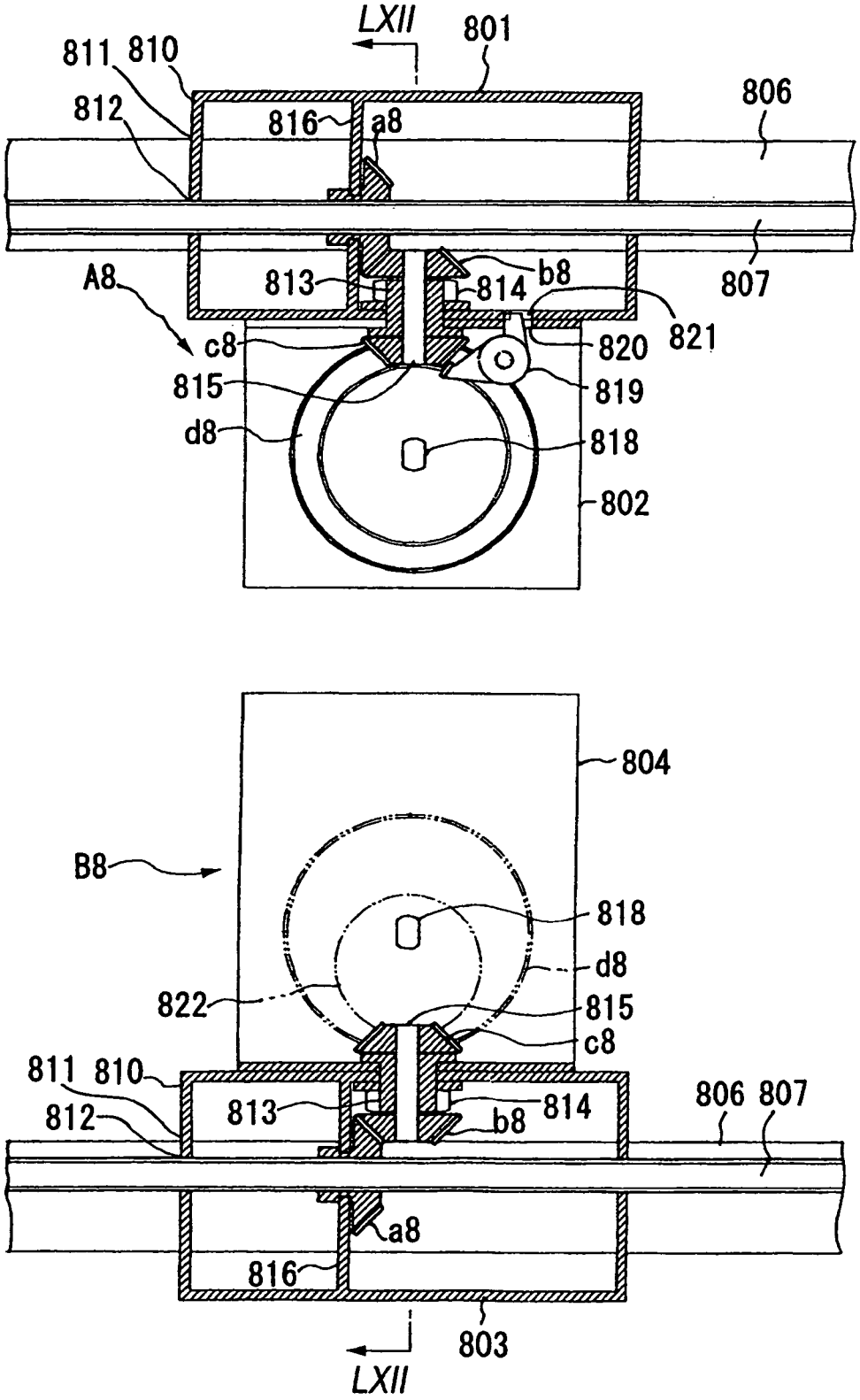
FIG. 61 is a front sectional view of a clincher portion A8 and a driver portion B8.

Next, a detailed description will be given of an eighth embodiment of the invention in reference to the drawings. FIG. 60 is a front sectional view of a left side portion of an electric stapler, the clincher portion A8 comprising the clincher carriage 801 and the clincher unit 802 is arranged on an upper side, the driver portion B8 comprising the driver carriage 803 and the driver unit 804 is arranged therebelow, and the clincher portion A8 and the driver portion B8 are opposed to each other by interposing a sheet table (not illustrated) arranged at a middle in an up and down direction. FIG. 61 is a front sectional view showing the clincher portion A8 and the driver portion B8 and FIG. 62 is a sectional view taken along a line LXII—LXII of FIG. 61.

Figure 62:
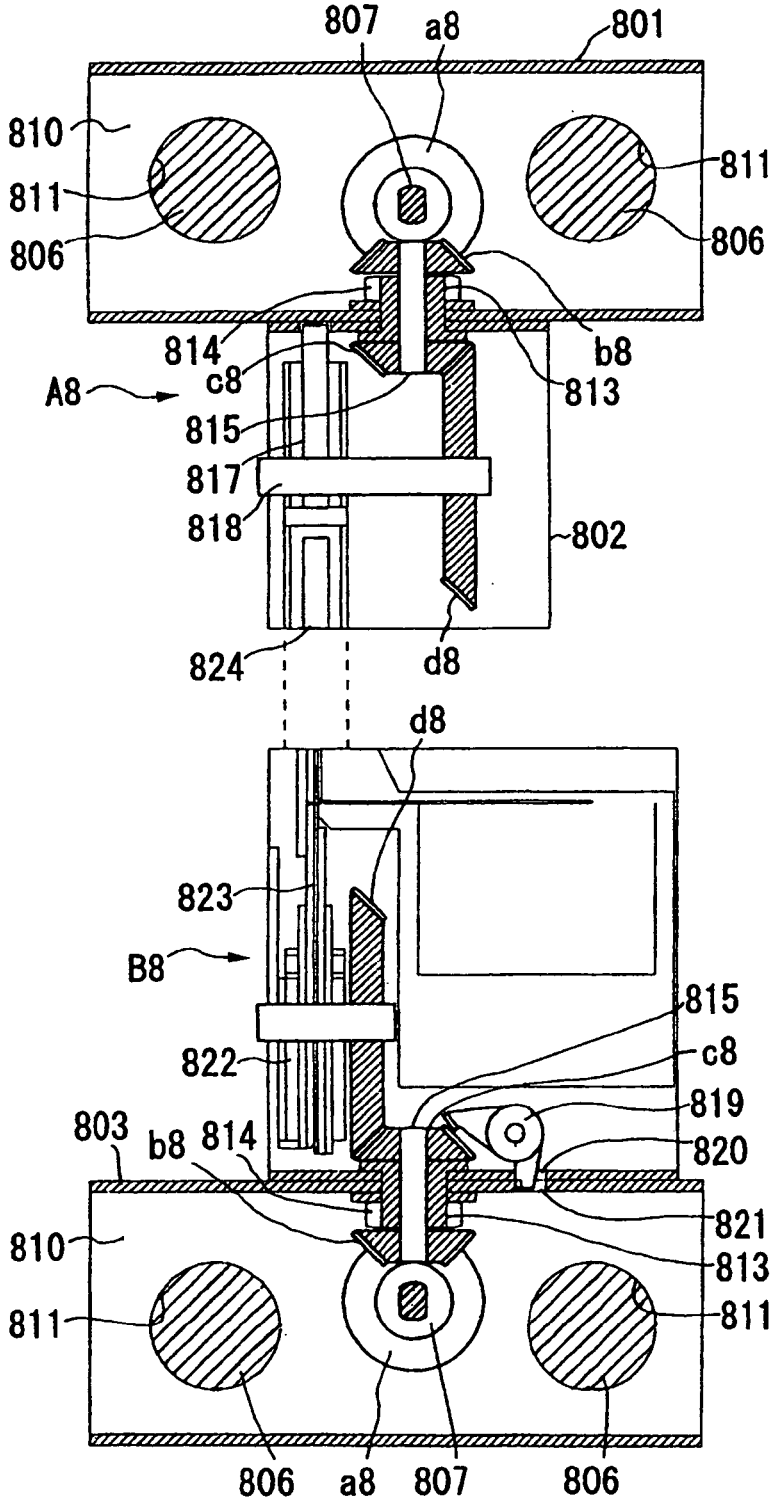
FIG. 62 is a sectional view taken along a line LXII—LXII of FIG. 61.

A left vertical frame 805 shown in FIG. 60 and a right vertical frame (not illustrated) opposed to the left vertical frame are hung with two respective upper and lower pieces of guide shafts 806 horizontally and by being shifted from each other in a front and rear direction and arranged with drive shafts 7 having a section in a noncircular shape constituted by cutting an outer peripheral face of a circular cylinder between the front and rear guide shafts 806 as shown by FIG. 62. The two upper and lower pieces of the drive shafts 807 are driven to rotate in the same direction by the motor 809 via a reduction gear 808 shown in FIG. 60. The clincher carriage 801 on the upper side and the drive carriage 803 on the lower side are constituted by the same shape, guide holes 811 formed at left and right side plates 810 are penetrated by two pieces of the guide shafts 806 and a hole 812 provided between the two guide holes 811 is penetrated by the drive shaft 807.

The clincher portion A8 and the driver portion B8 are moved in the left and right direction by a publicly-known moving mechanism using a timing belt. Although illustration is omitted, gear pulleys are arranged at vicinities of two left and right end portions of the guide shaft 806, the timing belt is hung around the left and right gear pulleys, a point of the time belt is made to stay to be attached to the clincher carriage 801 and the driver carriage 802, one of the gear pulleys is driven to rotate by a stapler moving motor, thereby, the clincher portion A8 and the driver portion B8 are traveled to the left or to the right in synchronism with each other.

Mechanical constitutions of driving and rotating the clincher portion A8 and the driver portion B8 are the same, in the following, an explanation will be given of the clincher portion A8 and with regard to the driver portion B8, constituent portions the same as those of the clincher portion A8 are attached with the same notation and an explanation thereof will be omitted. As shown by FIG. 61 and FIG. 62, the clincher carriage 801 and the clincher unit 802 attached to a lower face thereof are connected by a hollow flange shaft 813 and a bush 814 and the clincher unit 802 is supported rotatably in the horizontal direction. The bevel gears b8, c8 are attached to both ends of the gear shaft 815 penetrating a center hole of the flange shaft 814, the bevel gear b8 on the side of the clincher carriage 801 is brought in mesh with the bevel gear a8 at an initial stage attached to an inner bearing portion 816, and the bevel gear c8 on the side of the clincher unit 802 is brought in mesh with the large diameter bevel gear d8 at a final stage attached to a shaft 818 of a clincher cam 817. The bevel gear a8 at the first stage is slidably fitted to the drive shaft 807 and the clincher carriage 801 and the clincher unit 802 can be moved in the left and right direction along the drive shaft 807.

The brake lever 819 is arranged at a vicinity of the bevel gear c8 at inside of the clincher unit 802, and provided with brake lever pivoting means (not illustrated) of a solenoid or the like for pivoting brake lever 819. A front end of the brake lever 819 is opposed to a tooth face of the bevel gear c8 and other end thereof is brought into the groove hole 821 formed at a bottom plate of the clincher carriage 801 via a hole 820 formed at a frame of the clincher unit 802.

Figure 63:
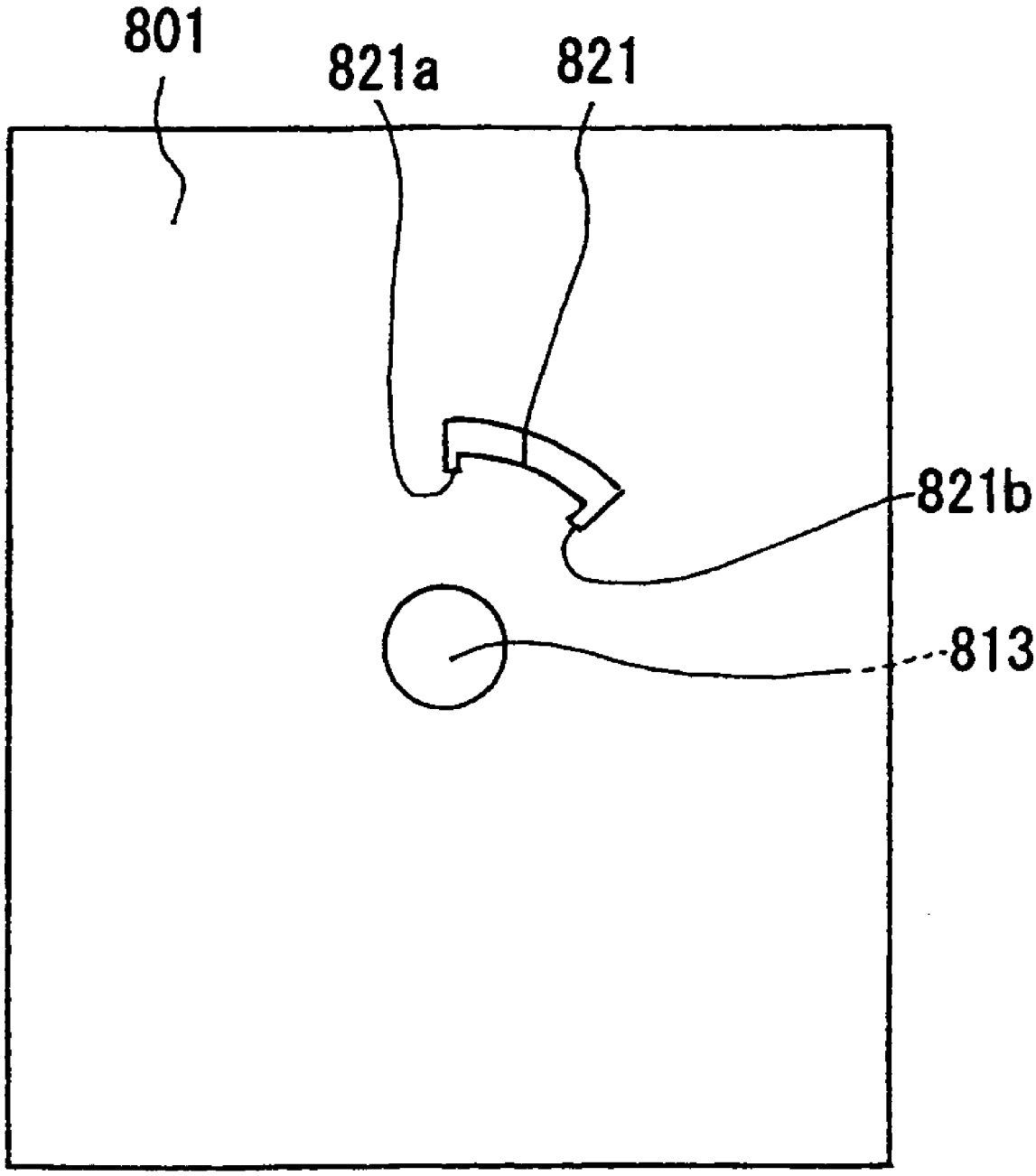
FIG. 63 is a bottom view of a clincher carriage.

FIG. 63 shows a shape of the groove hole 821 of the clincher carriage 801 and the groove hole 821 is a groove hole of a circular arc shape of 45 degrees centering on a shaft hole through which the flange shaft 813 passes and is formed with the recess portions 821*a*, 821*b* directed to the center at both ends thereof. As shown by FIG. 61, in an initial state, a front end of the brake lever 819 is remote from teeth of the bevel gear c8 and other end thereof is engaged with the 0 degree recess portion 821*a* of the groove 821, and the clincher unit 802 is fixed to a 0 degree rotated position relative to the clincher carriage 801 and made to be unable to rotate. Further, when the brake lever 819 is pivoted in the clockwise direction in FIG. 61, the front end of the brake lever 819 is brought in mesh with the teeth of the bevel gear c8, the other end is detached from the recess portion 821*a* of the groove hole 821 and the clincher unit 802 is made to be able to rotate.

Next, an explanation will be given of operation of the electric stapler. The electric stapler carries out back binding of binding two locations of the side of paper or skewed binding of striking a staple to a corner portion of paper by an angle of 45 degrees relative to a side thereof by being controlled by a control portion of the copier. When 1 copy set of paper is fed from a copying mechanism portion to the sheet table, in the case of back binding, a staple is struck at a left end position shown in FIG. 60, the clincher portion A8 and the driver portion B8 are moved to a right predetermined position by the stapler moving mechanism to strike the staple.

In a back binding mode, the brake lever 819 is maintained at the illustrated initial position and the clincher unit 802 and the driver unit 804 are fixed to the 0 degree rotated position. Further, when the motor 809 is driven at left and right predetermined binding positions, paper on the sheet table is bound by a series of operation of transmitting rotation of the drive shafts 807 to a clincher cam 817 and a driver cam 822 via the bevel gears a8, b8, c8, d8, moving down the clincher unit 802 to hold paper, moving up the driver 823 of the driver unit 804 inject a staple and moving down a clincher 8024 of the clincher unit 802 to fold to bend the leg portions of the staple.

When skewed binding is set, the clincher portion A8 and the driver portion B8 are moved to a skewed binding position at a right end by the stapler moving mechanism, the front end of the brake lever 819 is brought in mesh with teeth of the bevel gear of the c8 by being driven to rotate from the initial state, the bevel gears b8, c8, d8 are fixed to be unable to rotate relative to the clincher unit 802 and the driver unit 804, the other end of the brake lever 819 is detached from the recess portion 821*a* of the groove hole 821, the clincher unit 872 and the driver unit 804 are respectively brought into being rotatable relative to the carriages 801, 803. When the drive shafts 807 are driven to rotate under the state, the clincher unit 802 and the driver unit 804 are rotated integrally with the bevel gears b8, c8 and when the clincher unit 802 and the driver unit 804 are rotated by 45 degrees, the other end of the brake lever 819 impinges on the 45 degree final end position of the circular arc shape groove hole 821 to stop rotating the clincher unit 802 and the driver unit 804. At this occasion, when the brake lever 819 is released of being driven, the brake lever 819 returns to the initial position and the front end is detached from the bevel gear c8, the other end is engaged with the 45 degree recess portion 821*b* of the circular arc shape groove hole 821 and the clincher unit 802 and the driver unit 804 are fixed at the 45 degree rotated position. Thereafter, the driver shafts 807 are driven to rotate the motor 809 and rotation of the drive shafts 807 is transmitted to the clincher cam 817 and the driver cam 822 via the bevel gears a8, b8, c8, d8 and the driver 823 and the clincher 824 are started to carry out the binding processing.

After finishing the binding processing, the brake lever 819 is driven to rotate again from the initial state, the front end is brought in mesh with the bevel gear c8 to make the clincher unit 802 and the driver unit 804 rotatable, the drive shafts 807 are rotated reversely to return the clincher unit 802 and the driver unit 804 to the 0 degree rotated position, the brake lever 819 is returned to the initial state to fix the clincher unit 802 and the driver unit 804 to the 0 degree rotated position and the clincher portion A8 and the driver portion B8 are traveled to the left by the stapler moving mechanism to return to the left end initial position.

Although an explanation has been given of the constitution of driving and rotating the clincher unit 802 and the driver unit 804 by the single motor 809 as described above, the invention is not limited to the above-described embodiment but, for example, the invention can variously be modified such that a circular arc angle of the circular arc shape groove of 821 is set to 90 degrees, recess portions for engaging with the brake lever 819 are provided at a 0 degree rotated position, a 45 degree rotated position and a 90 degree rotated position, and the clincher unit 802 and the driver unit 804 can be rotated to the 0 degree rotated portion, the 45 degree rotated position and the 90 degree rotated position by controlling an amount of rotating the motor 809 and brake lever pivoting means.

Further, the invention is not limited to the above-described embodiments but can variously be modified within the technical range of the invention and the invention naturally covers the modifications.

The application is based on Japanese Patent Publication (Japanese Patent Application No. 2001-365132) filed on Nov. 29, 2001, Japanese Patent Application (Japanese Application No. 2001-365145) filed on Nov. 29, 2001, Japanese Patent Application (Japanese Patent Application No. 2001-369264) filed on Dec. 3, 2001, Japanese Patent Application (Japanese Patent Application No. 2001-370502) filed on Dec. 4, 2001, Japanese Patent Application (Japanese Patent Application No. 2001-397828) filed on Dec. 27, 2001, Japanese Patent Application (Japanese Patent Application No. 2000-010630) filed on Jan. 18, 2002, Japanese Patent Application (Japanese Patent Application No. 2002-010643) filed on Jan. 18, 2002, Japanese Patent Application (Japanese Patent Application No. 2002-013307) filed on Jan. 22, 2002, and Japanese Patent Application (Japanese Patent Application No. 2002-013313) filed on Jan. 22, 2002, and the contents thereof are incorporated here by reference.

INDUSTRIAL APPLICABILITY

As has been explained above, the electric stapler of the invention is constituted to provide the click stop mechanism by which respectives of the clincher unit and the driver unit separated upwardly and downwardly are fixed to two positions of the 0 degree position and the 45 degree rotated position, when the clincher unit and the driver unit are traveled to the skewed binding position, the clincher unit and the driver unit are rotated to the 45 degree rotated position by the stopper portion in the traveling path and when the clincher unit and the driver unit are traveled reversely to the initial position, the clincher unit and the driver unit return to the 0 degree position and therefore, a drive mechanism of a motor cam, a gear or the like for rotating the clincher unit and the driver unit is dispensed with. Further, the angles of rotating the clincher unit and the driver unit can be made to accurately coincide with each other by the simple mechanism to thereby achieve an effect in promoting simplification and operational accuracy in the rotating mechanism of the electric stapler.

Further, the electric stapler of the invention is constituted to receive the reaction force in operating respectives of the clincher unit and the driver unit separated upwardly and rearwardly by the slide ways and therefore, the reaction force is hardly exerted to the guide members of the guide shaft, the linear guide and the like with which the clincher unit and the driver unit are engaged and a failure in penetrating and buckling of the staple by bending the guide member can be prevented. Further, by alleviating the load applied to the guide member, cost can be reduced by using a guide member or a bearing for light load.

Further, the electric stapler of the invention is constituted such that the anvil for forming the linear staple is driven to move up and down, the anvil supports the horizontal crown portion of the staple immediately before the driver completely strikes the staple and thereafter, the anvil escapes from the path of the driver and therefore, buckling of the staple can firmly be prevented. Further, different from the constitution of the background art using the leaf spring as the buckling preventing means, there is not a load of driving the driver by the spring pressure and therefore, loss of drive power and striking energy is alleviated.

Further, the electric stapler of the invention is constituted to provide the mechanism of moving up and down the staple guide for restricting the attitude of injecting the staple, in injecting the staple, the staple guide is made to advance into the hole of the sheet table to be brought into contact with paper and comes out from the hole of the sheet table after injection and therefore, in constituting the moving type electric stapler for binding a plurality of locations of paper by moving the single piece of paper unit by the feed mechanism, it is not necessary to provide the long hole at the sheet table. Therefore, a concern of bringing about a hindrance in feeding paper by bringing an end portion of paper into the long hole as in the moving type electric stapler of the background art can be resolved and stability is promoted.

Further, the electric stapler of the invention is provided with the rotating mechanism for rotating the stapler horizontally by 90 degrees and therefore, the staple cartridge charging port at the rear face of the stapler can be directed to the operator by rotating the stapler in the copier by 90 degrees by the end portion of the transverse rail. Therefore, the staple cartridge can be interchanged or attached or detached without taking out a total of the electric stapler of the copier and the operation is extremely facilitated.

Further, by constituting such that the plurality of claw portions are provided at the stapler, the plurality of stopper members are arranged in the traveling path, and when the stapler is traveled to the end portion of the transverse rail, the plurality of claw portions successively impinge on the plurality of stopper members and the stapler is rotated by 90 degrees, special power and power transmitting mechanism for rotating the driver unit are dispensed with and formation of facilitating to attach and detach the staple cartridge can be realized by the concise constitution.

Further, the electric stapler of the invention is constituted to operate to move up and down and clinch the clincher portion by the feed screw mechanism and therefore, different from the electric stapler of the background art for bringing the clincher portion into press contact with paper by the spring pressure by using a suspension and a spring, drive energy can be saved by alleviating the load in pinching paper. Further, operational sound in returning to the initial position is more alleviated than that of the electric stapler of the background art to thereby achieve the effect in low noise formation.

Further, according to the electric stapler of the invention, when the position of the staple struck by the driver is shifted frontward or rearward, the position of the clincher holder in the front and rear direction of the clincher holder is automatically adjusted by the staple to thereby align the staple and the clincher and therefore, even when a relative positional shift relative to the clincher is brought about, the staple can stably and firmly be clinched to thereby achieve an effect in preventing a failure in clinching.

Further, the electric stapler of the invention is constituted to move up and down the clincher unit by the feed screw mechanism and carries out the clinching operation and therefore, different from the electric stapler of the background art for bringing the clincher unit into press contact with paper by the spring pressure by using a suspension and a spring, drive energy can be saved by alleviating the load in pinching paper. Further, also operational sound in returning to the initial position is more alleviated than that of the electric stapler of the background art to achieve an effect of low noise formation.

Further, the electric stapler of the invention is constructed by a concise constitution of driving and rotating the moving type stapler by the single motor arranged on the side of the frame and therefore, a number of parts is reduced in comparison with the electric stapler having a constitution of mounting motors for driving and rotating the moving type stapler to achieve an effect in small-sized and light weighed formation and a reduction in cost.

The invention claimed is:

1. An electric stapler comprising:

a clincher portion including a clincher pusher and a clincher;

a driver portion arranged to be opposed to the clincher portion and including a driver;

first driving means for moving the clincher portion to the driver portion; and second driving means for moving the clincher to the driver portion by way of a clincher pusher;

wherein the clincher portion is moved by the first driving means to pinch paper by the clincher portion and the driver portion, a staple is injected by the driver of the driver portion, and thereafter the clincher is moved and clinches a leg portion of the staple by the second driving means;

wherein the clincher portion and the clincher pusher are engaged by a single piece of feed screw and the first and the second driving means are constituted by a feed screw mechanism.

2. The electric stapler according to claim 1, further comprising:

first detecting means for detecting pinching of a sheet by the clincher portion and the driver portion;

second detecting means for detecting finishing of clinching the staple by the clincher; and controlling means for controlling the feed screw in accordance with detected signals of the first detecting means and the second detecting means.

3. The electric stapler according to claim 1, wherein the first driving means and the second driving means are driven by rotation of the feed screw.

4. An electric stapler comprising:

a clincher portion including a clincher pusher and a clincher;

a driver portion arranged to be opposed to the clincher portion and including a driver;

first driving means for moving the clincher portion to the driver portion;

second driving means for moving the clincher to the driver portion by way of a clincher pusher; and a gear;

wherein the clincher portion is moved by the first driving means to pinch paper by the clincher portion and the driver portion, a staple is injected by the driver of the driver portion, and thereafter the clincher is moved and clinches a leg portion of the staple by the second driving means;

wherein the clincher portion and the clincher pusher are engaged by a single piece of feed screw and the first and the second driving means are constituted by a feed screw mechanism;

wherein the feed screw comprises:

a large diameter screw portion screwed to a screw hole formed at a center of the gear; and a small diameter screw portion screwed to a screw hole formed at the clincher pusher, when the feed screw does not rotate relative to the clincher pusher, the clincher portion is moved up and down according to the rotation of the gear, and when the feed screw rotates relative to the clincher pusher, the clincher pusher moved up and down.

5. The electric stapler according to claim 4, when the feed screw rotates relative to the clincher pusher, the feed screw is locked with the gear so as to rotate integrally.

* * * * *